US008115785B2

(12) United States Patent
Arasawa et al.

(10) Patent No.: US 8,115,785 B2
(45) Date of Patent: Feb. 14, 2012

(54) METHOD FOR DRIVING LIQUID CRYSTAL DISPLAY DEVICE, LIQUID CRYSTAL DISPLAY DEVICE, AND ELECTRONIC DEVICE

(75) Inventors: Ryo Arasawa, Kanagawa (JP); Takahiro Fukutome, Tochigi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 950 days.

(21) Appl. No.: 12/055,841

(22) Filed: Mar. 26, 2008

(65) Prior Publication Data

US 2008/0266227 A1 Oct. 30, 2008

(30) Foreign Application Priority Data

Apr. 26, 2007 (JP) ..... 2007-116435

(51) Int. Cl.
*G09G 3/36* (2006.01)

(52) U.S. Cl. ..... 345/690; 345/87; 345/104; 345/204; 345/208; 345/210

(58) Field of Classification Search ..... 345/87–104, 345/204, 690, 208–210
See application file for complete search history.

(56) References Cited

U.S. PATENT DOCUMENTS 5,200,846 A 4/1993 Hiroki et al.
5,347,294 A 9/1994 Usui et al.
5,414,442 A 5/1995 Yamazaki et al.
5,465,102 A 11/1995 Usui et al.
5,844,533 A 12/1998 Usui et al.
6,215,466 B1 4/2001 Yamazaki et al.
6,326,941 B1 12/2001 Yamazaki et al.
7,061,511 B2 * 6/2006 Furuhashi et al. ..... 345/690
7,277,076 B2 10/2007 Shiomi et al.
2001/0026259 A1 * 10/2001 McKnight ..... 345/95
2004/0017344 A1 1/2004 Takemoto
2004/0160617 A1 8/2004 Okuda et al.
2004/0196304 A1 * 10/2004 Lee et al. ..... 345/690
2005/0104824 A1 5/2005 Shen et al.
2006/0007205 A1 * 1/2006 Reddy et al. ..... 345/204

(Continued)

FOREIGN PATENT DOCUMENTS

JP 04-238387 8/1992

(Continued)

OTHER PUBLICATIONS

N. Kimura et al.; "60.2: Invited Paper: New Technologies for Large-Sized High-Quality LCD TV"; SID Digest '05 : SID International Symposium Digest of Technical Papers; 2005; vol. XXXVI; pp. 1734-1737.

(Continued)

*Primary Examiner* — Richard Hjerpe
*Assistant Examiner* — Jeffrey Steinberg
(74) *Attorney, Agent, or Firm* — Fish & Richardson P.C.

(57) ABSTRACT

An object of the present invention is to provide a driving method of a liquid crystal display device for improvement of image quality and a liquid crystal display device in which the driving method is used. One frame period is divided up into an n (n: integer, n≧3) number of periods (hereinafter referred to as subframe periods). Furthermore, a voltage is applied to a liquid crystal so as to correct for a loss in luminance resulting from response speed of the liquid crystal. The voltage for correction is applied during subframe periods other than the first subframe period.

14 Claims, 24 Drawing Sheets

U.S. PATENT DOCUMENTS

| | | | | |
|---|---|---|---|---|
| 2006/0214897 | A1 | 9/2006 | Murai | |
| 2008/0198117 | A1 * | 8/2008 | Kumakura | 345/89 |

FOREIGN PATENT DOCUMENTS

| | | |
|---|---|---|
| JP | 05-017408 | 1/1993 |
| JP | 05-073005 | 3/1993 |
| JP | 06-046357 | 2/1994 |
| JP | 06-189232 | 7/1994 |
| JP | 07-084254 | 3/1995 |
| JP | 07-104715 | 4/1995 |
| JP | 07-121138 | 5/1995 |
| JP | 2002-169517 | 6/2002 |
| JP | 2004-220022 | 8/2004 |
| JP | 2004-246071 | 9/2004 |

OTHER PUBLICATIONS

Search Report (European Patent Application No. 08005871.2) dated Aug. 5, 2009.

European Office Action (Application No. 08005871.2) dated Sep. 19, 2011, in English, 6 pages.

* cited by examiner

METHOD FOR DRIVING LIQUID CRYSTAL DISPLAY DEVICE, LIQUID CRYSTAL DISPLAY DEVICE, AND ELECTRONIC DEVICE

BACKGROUND OF THE INVENTION

1. Field of the Invention

The present invention relates to driving methods for liquid crystal display devices in order to improve image quality and liquid crystal display devices and electronic devices in which the driving methods are used.

2. Description of the Related Art

In recent years, replacement of display devices in which conventional cathode-ray tubes with liquid crystal display devices are used as well as employment of liquid crystal display devices in miniature electronic devices has been progressing rapidly. Here, liquid crystal display device refers to a display device in which the alignment orientation of liquid crystal molecules is changed by application of a voltage to the liquid crystal molecules which are interposed between substrates and changes in optical characteristics produced thereby are used.

For a typical liquid crystal display device, for example, twisted nematic (TN) liquid crystal display devices can be given. TN display elements have a structure in which a nematic liquid crystal is interposed between two substrates and the major axis of each of the liquid crystal molecules is twisted continuously along 90° between the two substrates. Consequently, the direction of polarization of light incident on the liquid crystal molecules of the display elements in this state comes to be changed 90° along the twist of the liquid crystal molecules.

Here, when a voltage is applied to the liquid crystal molecules, the major axis of each of the liquid crystal molecules can be tilted in the direction of the electric field by application of a voltage greater than or equal to a certain threshold voltage $V_{th}$. That is, the condition of the twist of the liquid crystal molecules can be changed from 90°. At this time, the direction of polarization of light incident on the liquid crystal molecules also comes to be changed according to this twist. A TN system is a system in which this principle is used as a light shutter.

By an active matrix driving of the aforementioned TN system, a display device with better video display performance than that with passive matrix driving can be realized. Here, active matrix driving refers to driving of a pixel by use of transistors that are built into each pixel.

By combination of a TN system and active matrix driving in this way, a certain level of performance for the display device is secured. However, when compared to a display device in which a conventional cathode-ray tube is used, this display device is far from being in a state in which an acceptable pixel is obtained. In recent years, in order to improve image quality, development of liquid crystal materials with fast response has been progressing (for an example of this, refer to Patent Document 1). Furthermore, systems such as OCB (bend orientation) systems and IPS systems changing to TN systems are being employed more and more (for an example of this, refer to Patent Document 2).

Moreover, an approach differing from that given above is also being considered. For example, overdriving is such an approach (for an example of this, refer to Patent Document 3). Overdriving is a driving method in which a high voltage is applied briefly in order to improve the response speed of the liquid crystal molecules. The length of time until the desired luminance is reached can be shortened and the video performance is improved thereby.

Patent Document 1:Japanese Published Patent Application No. H5-17408

Patent Document 2:Japanese Published Patent Application No. H7-84254

Patent Document 3:Japanese Published Patent Application No. H7-104715

SUMMARY OF THE INVENTION

By use of overdriving, the response speed of liquid crystal molecules is undoubtedly improved. However, a problem arises in that power consumption is increased in exchange for response speed.

Furthermore, although details of the phenomenon have not yet been explained, there is a problem in that fluctuations in the applied voltage arise directly after overdrive is performed. When fluctuations in applied voltage are produced, display of a desired gradation becomes difficult to achieve. In particular, in cases where high-level gradation display is performed, the effects of fluctuations in applied voltage cannot be ignored.

In addition, for overdriving, because reference tables (look-up tables) specifying the relationship between display gradation and overdrive voltage are indispensable, a memory device used to store the reference tables is needed. In other words, as higher levels of gradation are being displayed, problems occur in that the memory device becomes unnecessarily enlarged.

In view of the aforementioned problems, it is an object of the present invention to provide a driving method, for a liquid crystal display device, used to improve image quality including video performance as well as a liquid crystal display device in which the driving method is used.

In the present invention, one frame period is divided up into an n (n: integer, $n \geqq 3$) number of periods (hereinafter referred to as subframe periods). That is, driving is performed at a frequency of 180 Hz or more. Moreover, a voltage is applied to the liquid crystal so as to correct for loss in luminance that originates with the response speed of the liquid crystal. Here, it is preferable that the compensatory voltage be applied during a subframe period other than the first subframe period.

One aspect of a driving method for a liquid crystal display device of the present invention is a driving method for a liquid crystal display device in which gradation (also referred to as grayscale) is expressed by application of a voltage to a pixel electrode, where a first frame period is divided up into n (n: integer, $3 \leqq n$) number of subframe periods; a signal voltage corresponding to a signal input from outside of the liquid crystal display device is applied to the pixel electrode during a subframe period other than an $m^{th}$ (m: integer, $2 \leqq m \leqq n$) subframe period out of the n number of subframe periods; and the signal voltage to which is added a correction voltage that corrects for a difference from intended gradation resulting from a delay in the response of a liquid crystal is applied to the pixel electrode during the $m^{th}$ subframe period out of the n number of subframe periods. The signal voltage is a voltage which corresponds to the intended grayscale. The difference corresponds to a difference between the intended grayscale and a grayscale that can be obtained by application of the signal voltage to the pixel electrode during the subframe period other than the $m^{th}$ subframe period.

In the driving method described above, it is preferable that the $m^{th}$ subframe period, during which the correction voltage is added, be selected so that the difference between a voltage applied during the $n^{th}$ subframe period of an intended frame period and a voltage applied during the first subframe period of the next frame period subsequent to the intended frame period is decreased. It is preferable that an order of occurrence of the $m^{th}$ subframe period in the first frame period be decided so that the amount of difference between a voltage applied to the pixel electrode during the $n^{th}$ subframe period of the first frame period and a voltage applied to the pixel electrode during a first subframe period of a second frame period is decreased. The second frame period is subsequent to the first frame period.

Another aspect of the driving method for a liquid crystal display device of the present invention is a driving method for a liquid crystal display device in which gradation (also referred to as grayscale) is expressed by application of a voltage to a pixel electrode, where one frame period is divided up into n (n: integer, $3 \leqq n$) number of subframe periods; a k (k: integer, $1 \leqq k \leqq n-1$) number of subframe periods other than the first subframe period are selected out of the n number of subframe periods; a signal voltage, corresponding to a signal input from outside of the liquid crystal display device, is applied to the pixel electrode during an (n−k) number of subframe periods other than the selected k number of subframe periods; and the signal voltage to which is added a voltage that corrects for a difference from intended gradation resulting from a delay in the response of a liquid crystal is applied to the pixel electrode during the selected $k^{th}$ subframe period. The signal voltage is a voltage which corresponds to the intended grayscale. The difference corresponds to a difference between the intended grayscale and a grayscale that can be obtained by application the signal voltage to the pixel electrode during the (n−k) number of subframe periods.

In the driving method described above, it is preferable that the $k^{th}$ subframe period, during which the correction voltage is added, be selected so that the difference between a voltage applied during the $n^{th}$ subframe period of an intended frame period and a voltage applied during the first subframe period of the frame period subsequent to the intended frame period is decreased. It is preferable that an order of occurrence of the k number of subframe periods in the first frame period be decided so that the amount of difference between a voltage applied to the pixel electrode during the $n^{th}$ subframe period of the first frame period and a voltage applied to the pixel electrode during a first subframe period of a second frame period is decreased. The second frame period is subsequent to the first frame period.

Another aspect of the driving method for a liquid crystal display device of the present invention is a driving method for a liquid crystal display device in which a desired gradation is obtained by application of a voltage to a pixel electrode, where one frame period is divided up into n (n: integer, $n \geqq 3$) number of subframe periods and a voltage that is the result of the correction voltage added to the signal voltage is applied to the pixel electrode during a subframe period other than the first subframe period out of a plurality of subframe periods, with the correction voltage being a voltage used to correct for a difference from intended gradation resulting from rising times of the liquid crystal.

Another aspect of a driving method for a liquid crystal display device of the present invention is a driving method for a liquid crystal display device in which a desired gradation is obtained by application of a voltage to a pixel electrode, where one frame period is divided up into n (n: integer, $n \geqq 3$) number of subframe periods and a voltage that is the result of the correction voltage added to the signal voltage is applied to the pixel electrode during the $n^{th}$ subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired gradation is obtained by application of a voltage to a pixel electrode, where one frame period is divided up into n (n: integer, $n \geqq 3$) number of subframe periods and a voltage that is the result of the correction voltage added to the signal voltage is applied to the pixel electrode during the $(n-1)^{th}$ subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired gradation is obtained by application of a voltage to a pixel electrode, where one frame period is divided up into n (n: integer, $n \geqq 3$) number of subframe periods, either the $(n-1)^{th}$ subframe period or $n^{th}$ subframe period of an intended frame period is selected in response to a signal voltage during a frame period subsequent to the intended frame period; and a voltage that is the result of the correction voltage added to the signal voltage is applied to the pixel electrode during the selected subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired luminance is obtained by application of a voltage to a pixel electrode, where one frame period is divided up into n (n: integer, $n \geqq 3$) number of subframe periods; when a signal voltage in a frame period subsequent to the intended frame period is greater than or equal to a signal voltage of the intended frame period, the $n^{th}$ subframe period is selected; when a signal voltage in a frame period subsequent to the intended frame period is lower than the signal voltage of the intended frame period, the $(n-1)^{th}$ subframe period is selected; and a voltage that is the result of the correction voltage added to the signal voltage is applied to the pixel electrode during the selected subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired luminance is obtained by application of a voltage to a pixel electrode, where one frame period is divided up into n (n: integer, $n \geqq 3$) number of subframe periods; when a signal voltage in a frame period subsequent to the intended frame period is higher than a signal voltage of the intended frame period, the $n^{th}$ subframe period is selected; when a signal voltage in a frame period subsequent to the intended frame period is less than or equal to the signal voltage of the intended frame period, the $(n-1)^{th}$ subframe period is selected; and a voltage that is the result of the correction voltage added to the signal voltage is applied to the pixel electrode during the selected subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired gradation is obtained by application of a voltage to a pixel electrode, where one frame period is divided up into n (n: integer, $n \geqq 3$)

number of subframe periods; a voltage that is the result of the correction voltage added to the signal voltage is applied to the pixel electrode during a subframe period other than the first subframe period out of a plurality of subframe periods; and a voltage that is the result of the signal voltage is applied to the pixel electrode during subframe periods other than the subframe period during which voltage that is the result of the correction voltage added to the signal voltage is applied, with the correction voltage being a voltage used to correct for a difference from intended gradation resulting from rising times of the liquid crystal.

Another aspect of the driving method for a liquid crystal display device of the present invention is a driving method for a liquid crystal display device in which a desired gradation is obtained by application of a voltage to a pixel electrode, where one frame period is divided up into n (n: integer, n≧3) number of subframe periods; a voltage that is the result of the correction voltage added to the signal voltage is applied to the pixel electrode during the $n^{th}$ subframe period; and a voltage equal to the signal voltage is applied to the pixel electrode during subframe periods other than the $n^{th}$ subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired gradation is obtained by application of a voltage to a pixel electrode, where one frame period is divided up into n (n: integer, n≧3) number of subframe periods; a voltage that is the result of the correction voltage added to the signal voltage is applied to the pixel electrode during the $(n-1)^{th}$ subframe period; and a voltage equal to the signal voltage is applied to the pixel electrode during subframe periods other than the $(n-1)^{th}$ subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired gradation is obtained by application of a voltage to a pixel electrode, where one frame period is divided up into n (n: integer, n≧3) number or subframe periods; either the $(n-1)^{th}$ subframe period or $n^{th}$ subframe period of an intended frame period is selected in response to a signal voltage during a frame period subsequent to the intended frame period; a voltage that is the result of the correction voltage added to the signal voltage is applied to the pixel electrode during the selected subframe period; and a voltage equal to the signal voltage is applied to the pixel electrode during subframe periods other than the selected subframe period, with the correction voltage being a voltage used to correct for a difference from intended gradation resulting from rising times of the liquid crystal.

Another aspect of the driving method for a liquid crystal display device of the present invention is a driving method for a liquid crystal display device in which a desired luminance is obtained by application of a voltage to a pixel electrode, where one frame period is divided up into n (n: integer, n≧3) number of subframe periods; when a signal voltage in a frame period subsequent to the intended frame period is greater than or equal to a signal voltage of the intended frame period, the $n^{th}$ subframe period is selected; when a signal voltage in a frame period subsequent to the intended frame period is lower than the signal voltage of the intended frame period, the $(n-1)^{th}$ subframe period is selected; a voltage that is the result of the correction voltage added to the signal voltage is applied to the pixel electrode during the selected subframe period; and a voltage equal to the signal voltage is applied to the pixel electrode during subframe periods other than the selected subframe period, with the correction voltage being a voltage used to correct for a difference from target gradation resulting from rising times of the liquid crystal.

Another aspect of the driving method for a liquid crystal display device of the present invention is a driving method for a liquid crystal display device in which a desired luminance is obtained by application of a voltage to a pixel electrode, where one frame period is divided up into n (n: integer, n≧3) number of subframe periods; when a signal voltage in a frame period subsequent to the intended frame period is higher than a signal voltage of the intended frame period, the $n^{th}$ subframe period is selected; when a signal voltage in a frame period subsequent to the intended frame period is less than or equal to the signal voltage of the intended frame period, the $(n-1)^{th}$ subframe period is selected, a voltage that is the result of the correction voltage added to the signal voltage is applied to the pixel electrode during the selected subframe period; and a voltage equal to the signal voltage is applied to the pixel electrode during subframe periods other than the selected subframe period, with the correction voltage being a voltage used to correct for a difference from target gradation resulting from rising times of the liquid crystal.

It is to be noted that, in the driving methods for a liquid crystal display device of the present invention, a backlight may be turned off during the first subframe period out of the n number of subframe periods. Furthermore, during the first subframe period out of the n number of subframe periods, an overdrive voltage may be applied instead of the signal voltage. Here, overdrive voltage is a voltage that is applied temporarily in order to increase the speed of the response of the liquid crystal and refers to a voltage applied in a direction in which a change in the alignment state of the liquid crystal during the intended frame period in which the overdrive voltage is to be applied further increases. In other words, overdrive voltage is a voltage applied temporarily in a direction in which the absolute value of the difference ($|x_b-x_a|$) between a response amount ($x_a$) of the liquid crystal when a voltage $V_a$ is applied to the liquid crystal during a given frame period and a response amount ($x_b$) of the liquid crystal when a voltage $V_b$ is applied to the liquid crystal during a subsequent frame period increases further Here, the response amount of the liquid crystal at a given voltage (V) is set to be the amount of change ($\delta S_{V-V0}$) in the alignment state of the liquid crystal from a state in which no voltage ($V_0$) is applied to a state in which enough time has lapsed since application of the given voltage (V). That is, the response amount of the liquid crystal is used to express the same meaning as that of luminance or display gradation. For example, when display gradation changes from low luminance to high luminance, by application of a voltage (that is, the overdrive voltage) by which the luminance of the liquid crystal changes to an even higher luminance than the target luminance, the response speed of the liquid crystal can be increased.

The use of the driving methods for a liquid crystal display device of the present invention can provide liquid crystal display devices with excellent image quality. It is to be noted that holding capacity can be reduced enough with the liquid crystal display devices in which the driving methods of the present invention are used. For example, liquid crystal display devices in which there is no capacitive wiring used to form capacitive elements in pixel sections thereof can be provided.

Furthermore, a variety of electronic devices in which the liquid crystal display devices described above are used can be provided.

By use of the driving methods of the present invention, high video performance can be realized. In addition, because the problems with overdriving can be solved, even higher image quality can be realized.

DETAILED DESCRIPTION OF THE INVENTION

Figure 1A:
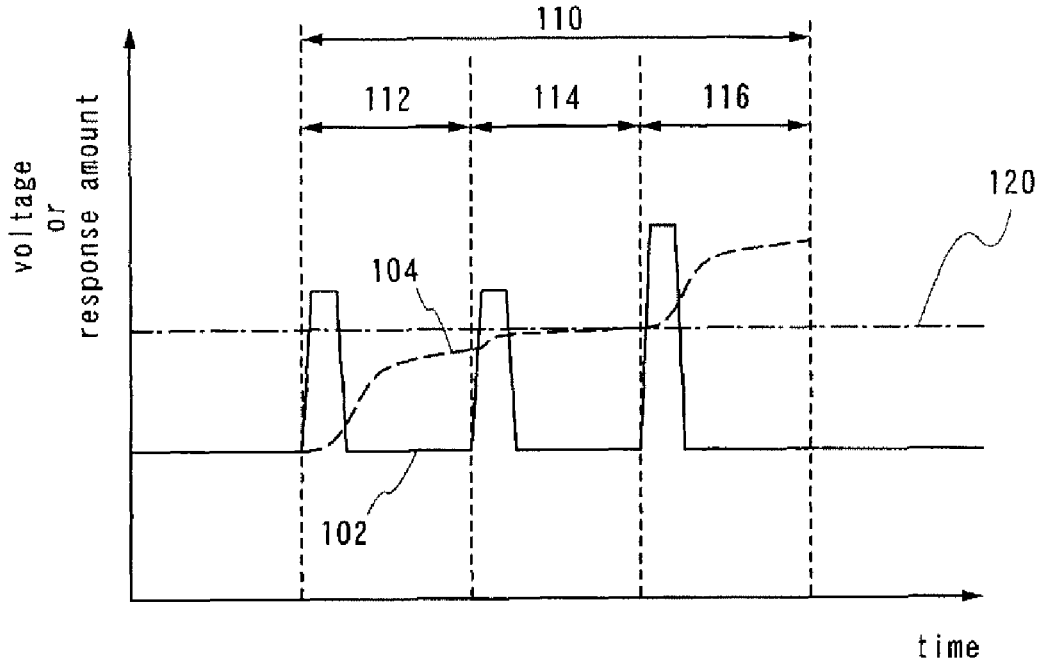
FIGS. 1A and 1B are graphs each used to illustrate a driving method of the present invention.

Embodiment Modes of the present invention will be described hereinafter with reference to the accompanying drawings. However, the present invention is not limited to the description given hereinafter, and it is to be easily understood to those skilled in the art that various changes and modifications can be made without any departure from the spirit and scope of the present invention. Therefore, the present invention is not to be construed as being limited to the description of the embodiment modes given hereinafter. It is to be noted that, in structures of the present invention described below, the same reference numerals are used in common to denote the same components in different drawings.

Embodiment Mode 1

In the present embodiment mode, driving methods of the present invention and principles thereof will be described hereinafter using FIGS. 1A and 1B, FIGS. 2A and 2B, and FIGS. 3A and 3B.

In FIG. 1A, a relationship between voltage 102 (solid line) applied during a writing period of one pixel and a response amount 104 (dashed line) of the liquid crystal is shown for when a driving method of a liquid crystal display device of the present invention is used. Here, the response amount of the liquid crystal corresponds to display gradation for a liquid crystal display element. In addition, the horizontal axis represents time, and the vertical axis represents voltage and response amount. It is to be noted that in a liquid crystal display device in which active matrix driving is used, a signal voltage is input to a pixel electrode only during a selected period of a pixel, and a voltage input by a holding capacitor (also referred to as storage capacitor) is retained for periods thereafter (referring to FIG. 10, for example).

First, one frame period is divided up into an n (n: integer, $n \geqq 3$) number of subframe periods. In the present embodiment mode, for sake of simplicity, a case in which one frame period 110 is divided into three subframe periods (a first subframe period 112, a second subframe period 114, and a third subframe period 116) will be described, however, the present invention is not to be taken as being limited to this case. It is to be noted that because rewriting of a pixel is generally performed at 60 Hz in a liquid crystal display device, the length of one frame period comes to be (1/60) s. In the present invention, because one frame period is further divided up into three subframe periods, driving comes to be performed at 180 Hz. That is, the length of one subframe period is (1/180) s. Needless to say, in cases where one frame period is divided up into an n number of subframe periods, driving comes to be performed at (60×n) Hz, and the length of one subframe period comes to be [1/(60×n)] s.

An image signal from external is input to a pixel electrode in relation to the three subframe periods. First, the same signal (signal voltage) is input during each of the first subframe period 112 and the second subframe period 114. It is to be noted that for the signal (signal voltage) that is input during the first subframe period 112 and the second subframe period 114, the image signal input from external may be used as is, or a signal resulting from correction being performed on the image signal, for example, a signal resulting from γ correction being performed on the image signal, or the like may be used. The signal voltage is a voltage which corresponds to the intended grayscale.

In this way, by the same signal being input twice, compared to when the signal is input only once, the response speed of the liquid crystal can be improved. Because the important point here is that the signal is input twice, there is no need for the input signal that is input to the pixel electrode during the first subframe period 112 and the second subframe period 114 to be the same signal, but for sake of simplicity, in the present embodiment mode, the same signal is set to be input twice. For examples in which the input signals are made to be different, cases where the signal input during the first subframe period 112 is made to be larger (or smaller) than the signal input during the second subframe period 114 and the like are given. In this way, by driving made to be like overdriving, operation speed may be increased. In this case, compared to cases for driving using overdrive only, improvements in image quality, including video performance, can be realized. It is to be noted that for cases where the one frame period 110 is divided up into three or more subframe periods, it is needless to say that the number of times an signal is to be input should also be increased accordingly.

After the same signal is input during each of the first subframe period 112 and the second subframe period 114, a signal is input to the third subframe period 116. It is preferable that the signal input to the pixel electrode here be a signal by which a response amount (or gradation) that is insufficient (or excessive) with respect to a target response amount (or gradation) of a liquid crystal is corrected. For example, because a constant insufficiency (or excess) in response amount always exists in the relationship of response speed of liquid crystal molecules during the first subframe period 112, a desired gradation cannot be displayed. By input of a signal during the third subframe period 116 so that this insufficiency (excess) is corrected, the average gradation 120 (also referred to as an average response amount) during the one frame period 110 can be made to approach a desired value.

It is to be noted that, in the present embodiment mode, a case in which the insufficiency in the response amount is corrected by addition of a voltage in a positive direction, that is, a case in which the correction voltage is positive, is shown; however, the present invention is not to be taken as being limited to this case. Cases in which the response amount is changed in a direction of decrease can be addressed by addition of a negative correction voltage, as well.

Figure 1B:
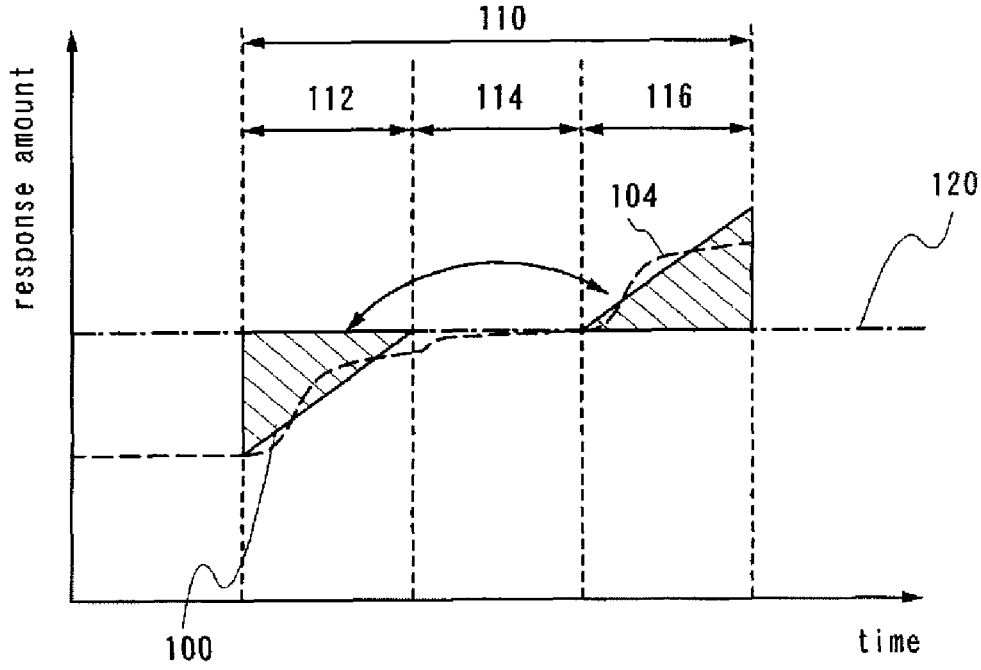

In FIG. 1B, an example of a calculation method for the insufficiency of the response amount and a calculation method for the signal input during the third subframe period 116 are shown as models. Here, for sake of simplicity, the voltage (solid line) that is applied during the rewriting period of one pixel in FIG. 1A is omitted. As shown in FIG. 1B, the insufficiency in the response amount during the first subframe period 112 is roughly expressed by the shape of a triangle 100. Here, because the area of the triangle 100 is equal to [(the difference between the target response amount and the initial response amount)×(the length of one subframe period)×(½)], this corresponds to the amount of insufficiency in the response amount. After the amount of insufficiency in the response amount is calculated, the voltage used to correct for the insufficiency in the response amount is obtained. Because the relationship between the voltage and the response amount changes depending on a variety of parameters of the liquid crystal display device, it is desirable that an examination be made in advance. The signal voltage that is input to the pixel electrode during the third subframe period 116 is equal to [(the signal voltage applied during the first subframe period 112 or the second subframe period 114)+(the voltage corresponding to the amount of insufficiency in the response amount)].

It is to be noted that the calculation method given above is nothing more than a mere example, and the present invention is not to be taken as being limited to this case. In the present embodiment mode, the amount of insufficiency in the response amount is calculated as by approximation of a triangle; however, the amount of insufficiency in the response amount may also be found by integration from the function of time and the response amount without use of approximation. Of course, the amount of insufficiency in the response amount may be found by approximation with a rectangular shape, a trapezoidal shape, or the like, as well.

Figure 2A:
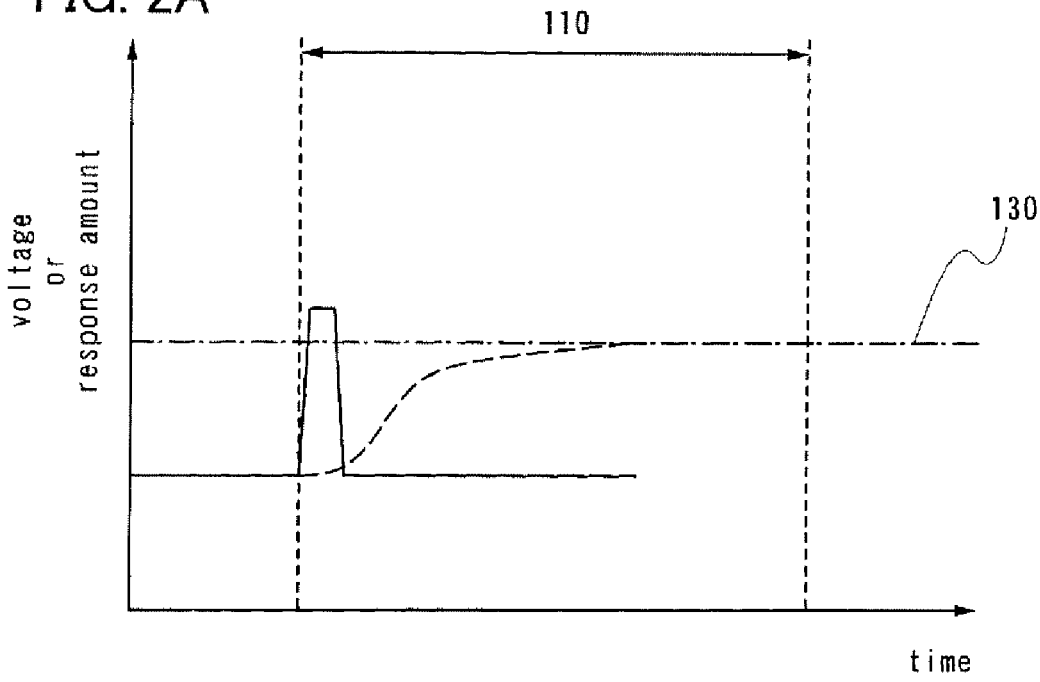
FIGS. 2A and 2B are graphs used to compare a conventional driving method with a driving method of the present invention.
Figure 2B:
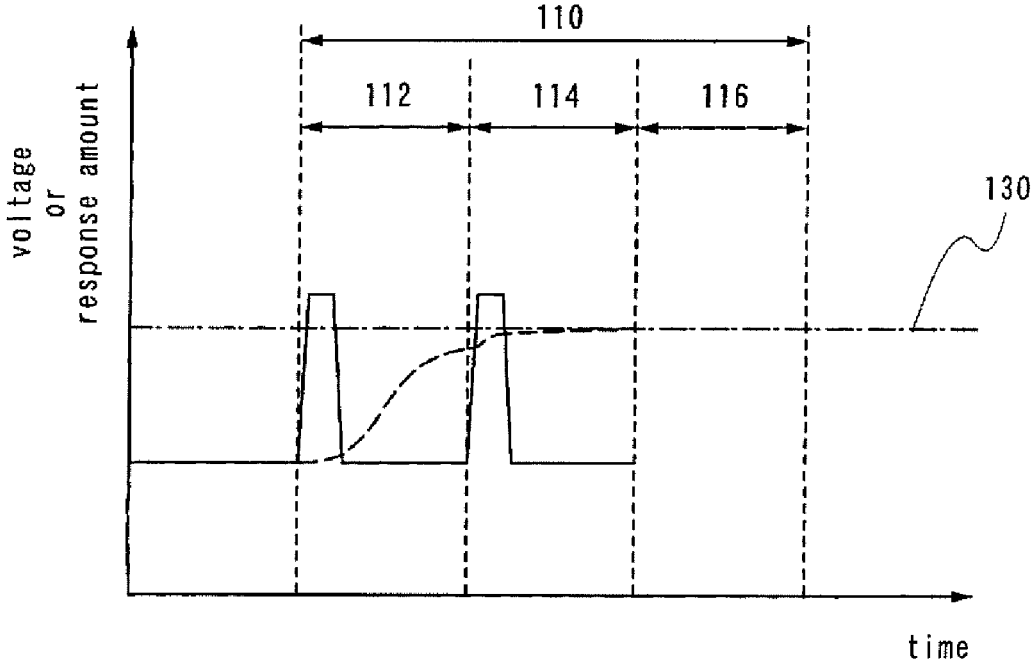

Next, the response amount of a liquid crystal for when a driving method in which one frame period is not divided into subframe periods shown in FIG. 2A and the response amount of a liquid crystal for when a driving method in which one frame period is divided into a plurality of subframe periods shown in FIG. 2B are compared. It is to be noted that, for sake of simplicity, in FIGS. 2A and 2B, a comparison is made of a first subframe period and a second subframe period (and periods corresponding thereto) only.

FIG. 2A is a diagram showing the response amount (dashed line) of a liquid crystal (a TN liquid crystal) for when a conventional driving method in which the one frame period 110 is not divided up into subframe periods is used. It is to be noted that, in FIGS. 2A and 2B, a solid line represents voltage applied during a writing period of one pixel. In FIG. 2A, the response amount of a liquid crystal increases with time; however, the desired luminance is not attained even if the final stage of a period corresponding to the second subframe period is reached. That is, it is understood that the length of time it takes to reach a target luminance 130 (also referred to as the target response amount) is longer than the length of time of the first subframe.

FIG. 2B is a diagram showing the response amount (dashed line) of a liquid crystal for when the same signal is input twice using a driving method in which the one frame period 110 is divided up into a plurality of subframe periods. From FIG. 2B, it can be seen that, when a signal is again input during the second subframe period 114, the response amount changes at a speed differing from that up to this point. That is, the target response amount 130 is approached more quickly in the case of FIG. 2B compared to the case of FIG. 2A.

The details of a phenomenon in which the response amount changes at a speed differing from that up to this point by input of the same signal a plural number of times in this way is unclear, however, a reason originating with the driving method of a liquid crystal display device can be given for one of the causes of this phenomenon. In cases in which a given image is displayed, a transistor of the pixel comes to be placed in a conductive state, a signal is input to the pixel electrode, and a voltage is applied to the liquid crystal. Then, by the transistor of the pixel being placed in a non-conductive state, a capacitive element of the pixel continues retaining the input signal, and the given signal continuing to be displayed comes to be possible. However, in actuality, even in cases in which a non-conductive state is selected, a slight amount of current continues flowing through the transistor of the pixel. Consequently, having an initial voltage be continued to be retained during one frame period is difficult, and as a result, the voltage applied to the liquid crystal decreases with time.

Furthermore, this tendency becomes more pronounced when the capacity of the holding capacitor is low. From the structure of the liquid crystal display device, increasing the capacity of the holding capacitor above a certain amount in order to maintain aperture ratio at a value above a certain amount is difficult. That is, there is a fixed limit on the amount of electric charge that can be retained by the holding capacitor. Due to generation of a low amount of leak current in cases in which the amount of electric charge that can be retained by the holding capacitor is low, the amount of voltage applied to the liquid crystal comes to decrease dramatically.

Figure 3A:
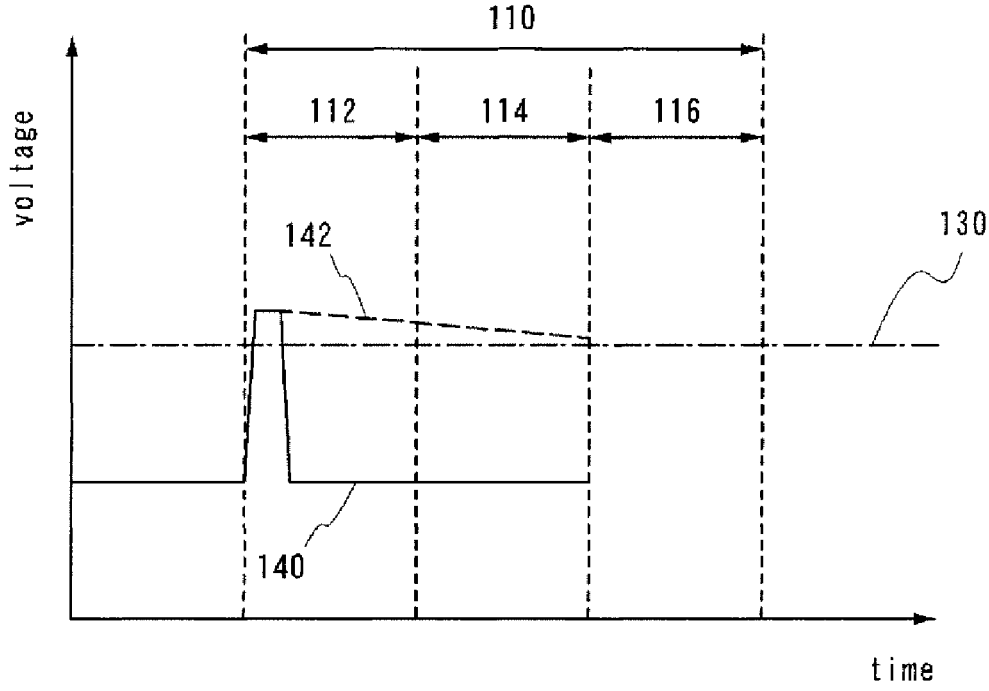
FIGS. 3A and 3B are graphs used to compare a conventional driving method with a driving method of the present invention.
Figure 3B:
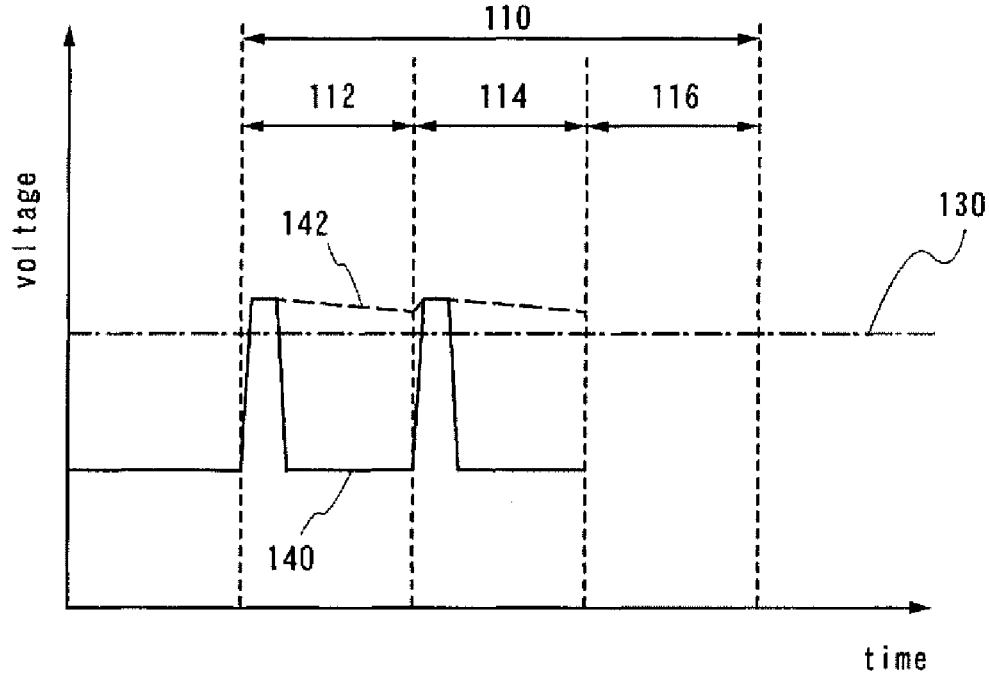

This situation is shown in FIG. 3A. FIG. 3A shows the relationship between input signal input to a given pixel and the voltage retained by a capacitive element of that pixel. Here, the horizontal axis represents time, and the vertical axis represents voltage. The solid line represents a voltage 140 of the input signal, and the dashed line represents a voltage 142 that is retained by the capacitive element. It is to be noted that, for sake of simplicity, only the first subframe period 112 and the second subframe period 114 (and periods corresponding thereto) are shown in FIGS. 3A and 3B. As shown in FIG. 3A, when input of a signal ends, the amount of electric charge stored in the capacitive element decreases as time progresses, and the initial voltage becomes unable to be stored.

At the same time, FIG. 3B shows the relationship between input signal input to a given pixel and the voltage retained by a capacitive element of that pixel in cases in which the same signal is input a plural number of times. As in FIG. 3A, the solid line represents the voltage 140 of the input signal, and the dashed line represents the voltage 142 that is retained by the capacitive element. First, when a signal is input to a pixel electrode during the first subframe period 112, as in the case shown in FIG. 3A, electric charge is stored in a capacitive element. Even in this case, when input of a signal ends, the amount of electric charge stored in the capacitive element decreases as time progresses. Next, the same signal is input to the pixel electrode during the second subframe period 114. Herewith, the voltage applied to the liquid crystal can be boosted. That is, the length of time it takes to reach the target response amount (luminance) can be shortened.

Moreover, by images input during one frame period being input during the first subframe period 112 and writing of the same data being repeated (refreshed) a plural number of times, compared to cases for 60 Hz driving, an image of at least one screen during one-third of a period or less can be set. This is because, compared to the screen being rewritten once every 1/60 s in cases in which driving is performed at 60 Hz, the screen is rewritten once every 1/180 s with 180 Hz driving. That is, the length of the period of time during which different images on the screen are mixed together and displayed (for example, an image displayed during one frame period and an image displayed during a subsequent frame period are mixed together and displayed) can be shortened. Consequently, because writing and definition of images can be performed quickly, blurring of moving images can be resolved, and image quality can be improved.

As can be seen from a comparison of FIG. 3A and FIG. 3B, an improvement in the so-called response speed can be realized by performance of only a simple operation in which a signal is input a plural number of times. It is to be noted that, here, for reasons why the response speed improves by input of a signal a plural number of times, problems with the capacity of the holding capacitor and the leak current of the transistor and the like can be given.

Next, the effects of cases in which the correction voltage is added during a subframe in the later half (during the third subframe period 116 in the present embodiment mode) are described below.

In a subframe in the later half, it can be considered that the response amount of the liquid crystal approaches a desired display gradation. That is, only a small amount of the response amount of the liquid crystal is needed for correction of gradation. If only a small amount of the response amount of the liquid crystal is needed, only a short amount of time is needed for response. That is, an improvement in response speed can be realized.

As shown in the present embodiment mode, one frame period is divided up into an n (n: integer, $n \geqq 3$) number of subframe periods, the same signal voltage is applied during the first through $(n-1)^{th}$ subframe periods, and a voltage that is the result of the correction voltage added to the signal voltage is applied during the $n^{th}$ subframe period, whereby an improvement in response speed and accurate gradation display can be realized. Furthermore, because the amount of correction voltage can be determined by a simple calculation, an improvement in image quality can be achieved easily, compared to overdriving.

Figure 10:
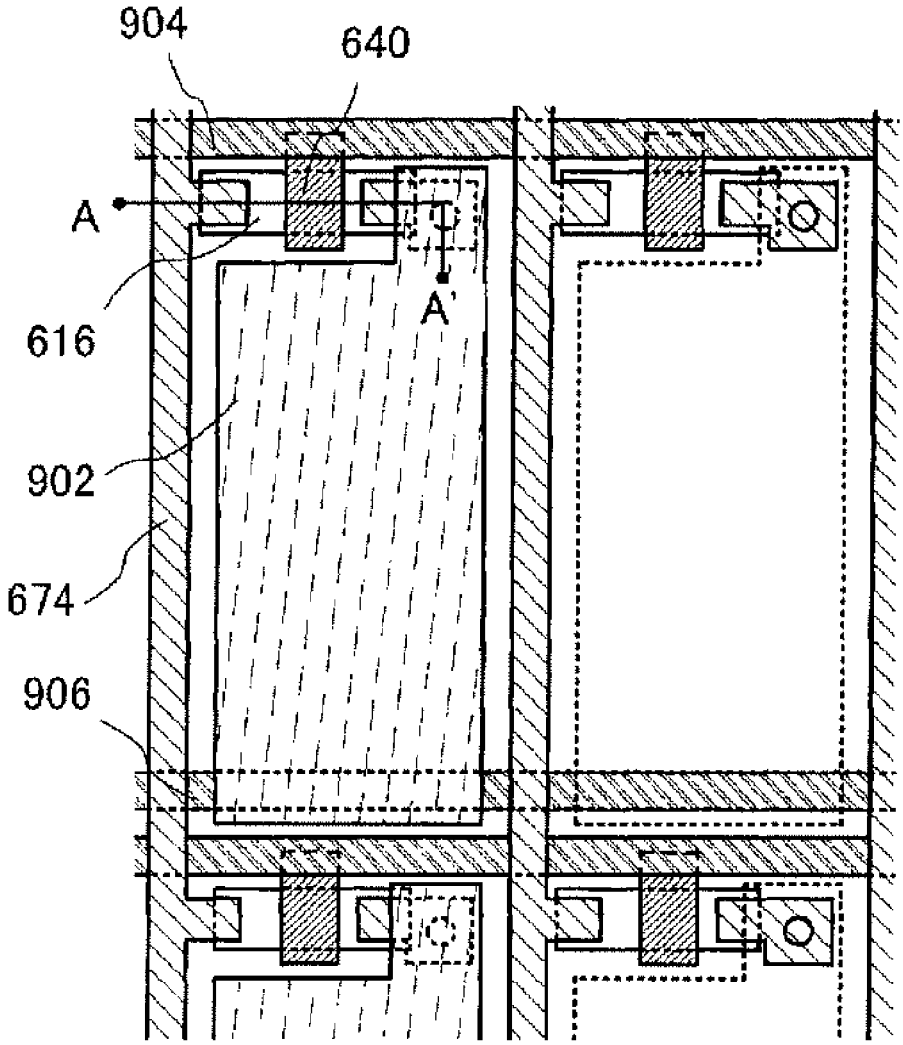
FIG. 10 is a diagram showing a top view of a liquid crystal display device of the present invention.

In addition, the use of the driving method of the present embodiment mode can decrease holding capacity. That is, because the liquid crystal display device becomes more insusceptible to effects of a decrease in voltage due to leak current by performance of writing a plural number of times during one frame period, it becomes possible to use a smaller holding capacitor than that required conventionally. By the size of the holding capacitor being decreased, a liquid crystal display device with a high aperture ratio and high video performance can be provided. In particular, by the number of writing times be increased (that is, by one frame period being divided up into several subframe periods) up to a point about equal to where a capacity overlapping with an opening is not needed, a liquid crystal display device that has an optimum aperture ratio and excellent video performance can also be provided. Moreover, under conditions by which the holding capacitor can be reduced enough, the structure can be set to be one in which a capacitive wiring used for a holding capacitor is not included (for example, a structure in which the capacitor wiring 906 in FIG. 10 is not included).

It is to be noted that, in the present embodiment mode, the subframe period during which the correction voltage is to be added is set to be the $n^{th}$ subframe period; however, the present invention is not limited to having this configuration. The effect of the present invention can be obtained as long as the subframe period during which the correction voltage is added is a subframe period during which the response amount of the liquid crystal approaches a desired display gradation. For example, in cases in which one frame period is divided up into an n (n: integer, $n \geqq 3$) number of subframe periods, the correction voltage may be added during an $m^{th}$ (m: integer, $n/2 \leqq m \leqq n$) subframe period.

Embodiment Mode 2

In the present embodiment mode, a driving method differing from the method described in Embodiment Mode 1 will be described using FIG. 4.

Figure 4:
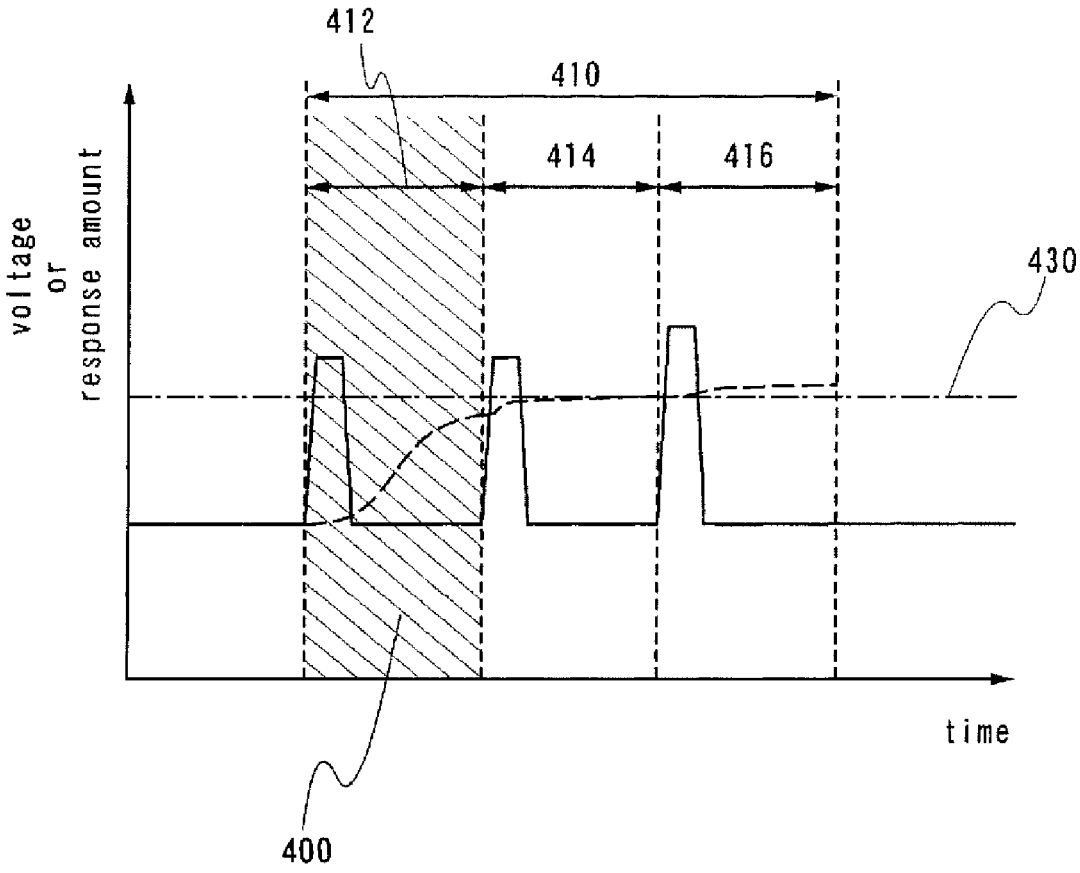
FIG. 4 is a graph used to illustrate a driving method of the present invention.

First, one frame period is divided up into an n (n: integer, $n \geqq 3$) number of subframe periods (FIG. 4). In the present embodiment mode, for sake of simplicity, a case in which one frame period 410 is divided into three subframe periods (a first subframe period 412, a second subframe period 414, and a third subframe period 416) will be described; however, the present invention is not to be taken as being limited to this case. It is to be noted that because rewriting of a pixel is generally performed at 60 Hz in a liquid crystal display device, the length of one frame period comes to be (1/60) s. In the present invention, because one frame period is further divided up into three subframe periods, driving comes to be performed at 180 Hz. That is, the length of one subframe period is (1/180) s. Needless to say, in cases where one frame period is divided up into an n number of subframe periods, driving comes to be performed at (60×n) Hz, and the length of one subframe period comes to be [1/(60×n)] s.

An image signal from external is input to a pixel electrode in relation to the three subframe periods. First, the same signal (signal voltage) is input during each of the first subframe period 412 and the second subframe period 414. It is to be noted that for the signal (signal voltage) that is input during the first subframe period 412 and the second subframe period 414, the image signal input from external may be used as is, or a signal resulting from correction being performed on the image signal, for example, a signal resulting from γ correction being performed on the image signal, or the like may be used. The signal voltage is a voltage which corresponds to the intended grayscale.

Because the effect and the like obtained by input of a signal a plural number of times is the same as that of Embodiment Mode 1,here, a discussion thereof will be omitted.

After the same signal is input during each of the first subframe period 412 and the second subframe period 414, a signal is input to the third subframe period 416. It is preferable that the signal input to the pixel electrode here be a signal by which a response amount (or gradation) that is insufficient (or excessive) with respect to a target response amount 430 of a liquid crystal (or gradation) is corrected. In Embodiment Mode 1,an example is shown in which a signal is input during the third subframe period 416 so as to correct for the amount of insufficiency (amount of excess) in the response amount during the first subframe period 412; however, in the present embodiment mode, a signal is input during the third subframe period 416 so as to correct for the amount of insufficiency (amount of excess) in the response amount during the second subframe period 414.

It is to be noted that, in the present embodiment mode, a case in which the insufficiency in the response amount is corrected by addition of a voltage in a positive direction, that is, a case in which the correction voltage is positive, is shown; however, the present invention is not to be taken as being limited to this case. Cases in which the response amount is changed in a direction of decrease can be addressed by addition of a negative correction voltage, as well.

Here, in the present embodiment mode, in comparison of the amount of insufficiency in the response amount during the first subframe period 412 and the amount of insufficiency in the response amount during the second subframe period 414, because the amount of insufficiency in the response amount during the first subframe period 412 is larger, in comparison to the driving method used in Embodiment Mode 1, a problem occurs in that the accuracy in displayed gradation decreases.

Then, in the present embodiment mode, the first subframe period 412 is set to be a period 400 during which the backlight is turned off. That is, the first subframe period 412, which is a transient state for the response, is set to be black display, and display is set to be performed using the second subframe period 414 and the third subframe period 416 only. In this way, by the first subframe period 412, which is a transient state for the response, not being involved in display, the accuracy of the display gradation can be improved. Furthermore, because impulse driving like that of a cathode ray tube can be realized by insertion of a black screen into each frame period, a further improvement in video performance becomes possible to attain.

Moreover, because a signal is input so as to correct the amount of insufficiency in the second subframe period 414 only, the amount of difference in gradation displayed during the second subframe period 414 and gradation displayed during the third subframe period 416 is decreased, and the number of causes for flicker can be reduced.

Because the calculation method and the like for the response amount of the amount of insufficiency is the same as that of Embodiment Mode 1,a description thereof will be omitted here. It is to be noted that, because the amount of insufficiency in the response amount during the second subframe period 414 is relatively low, the amount of effect due to differences in approximation methods is small, and calculation can be performed using an even easier method.

As shown in the present embodiment mode, one frame period is divided up into an n (n: integer, n≧3) number of subframe periods, the same signal voltage is applied during the first through $(n-1)^{th}$ subframe periods, and a voltage that is the result of the correction voltage added to the signal voltage is applied during the $n^{th}$ subframe period, whereby an improvement in response speed and accurate gradation display can be realized. Furthermore, because the amount of correction voltage can be determined by a simple calculation, there is an advantage in that this driving method is used more easily compared to overdriving. Of course, operation speed may be improved further by driving being made to be like overdriving. In this case, it is preferable that an overdrive voltage be applied during the first subframe period instead of the aforementioned signal voltage.

In addition, the use of the driving method of the present embodiment mode can decrease holding capacity. That is, because the liquid crystal display device becomes more insusceptible to effects of a decrease in voltage due to leak current by performance of writing of a signal a plural number of times during one frame period, it becomes possible to use a smaller holding capacitor than that required conventionally. By the size of the holding capacitor being decreased, a liquid crystal display device with a high aperture ratio and high video performance can be provided. In particular, by the number of writing times be increased (that is, by one frame period being divided up into several subframe periods) up to a point about equal to where a capacity overlapping with an opening is not needed, a liquid crystal display device that has a maximum aperture ratio and excellent video performance can also be provided. Under conditions in which the holding capacitor can be reduced enough, the structure can be set to be one in which a capacitive wiring used for a holding capacitor is not included (for example, a structure in which the capacitor wiring 906 in FIG. 10 is not included).

In addition, by the driving method of the present embodiment mode, by the first subframe period 412, which is a transient state for the response, not being involved in display, the accuracy of the display gradation can be greatly improved. Furthermore, because impulse driving like that of a cathode ray tube can be realized by insertion of a black screen into each frame period, a further improvement in video performance becomes possible to attain. Furthermore, by the number of writing times be increased (that is, by one frame period being divided up into several subframe periods) up to a point about equal to where a capacity overlapping with an opening is not needed, a liquid crystal display device that has a maximum aperture ratio and excellent video performance can also be provided. Moreover, because a signal is input so as to correct the amount of insufficiency in the second subframe period 414 only, the amount of difference in gradation displayed during the second subframe period 414 and gradation displayed during the third subframe period 416 is decreased, and the number of causes for flicker can be reduced.

It is to be noted that, in the present embodiment mode, the amount of insufficiency in the response amount during the second subframe period 414 is corrected for during the third subframe period 416; however, the structure of the present invention is not limited to being this kind of structure. For example, when one frame period is divided up into an n (n: integer, n≧3) number of subframe periods, a correction is made for the amount of insufficiency in the response amount during subframe periods other than the first subframe period (for example, a correction is made in the amount of insufficiency in the response amount during the second subframe period and the third subframe period). Because the amount of insufficiency in the response amount of the liquid crystal is particularly great during subframe periods of the later half, it is preferable that the amount of insufficiency be corrected for during a subframe period that comes directly after the subframe period during which the backlight is turned off. Furthermore, the subframe period during which the correction voltage is added can be also selected, as appropriate.

The present embodiment mode can be used in combination with Embodiment Mode 1.

Embodiment Mode 3

In the present embodiment mode, another driving method of the present invention will be described using FIGS. 5A and 5B.

First, one frame period is divided up into an n (n: integer, n≧3) number of subframe periods (FIG. 5). In the present embodiment mode, for sake of simplicity, a case in which one frame period is divided into four subframe periods will be described; however, the present invention is not to be taken as being limited to this case. Of course, cases in which one frame period is divided into three subframe periods can be applied, as well. It is to be noted that because rewriting of a pixel is generally performed at 60 Hz in a liquid crystal display device, the length of one frame period comes to be (1/60) s. In the present invention, because one frame period is further divided up into four subframe periods, driving comes to be performed at 240 Hz. That is, the length of one subframe period is (1/240) s. Needless to say, in cases where one frame period is divided up into an n number of subframe periods, driving comes to be performed at (60×n) Hz, and the length of one subframe period comes to be [1/(60×n)] s.

An image signal from external is input to a pixel electrode in relation to the four subframe periods. First, the same signal (signal voltage) is input during each of the first subframe period and the second subframe period. It is to be noted that for the signal (signal voltage) that is input during the first subframe period and the second subframe period, the image signal input from external may be used as is, or a signal resulting from correction being performed on the image signal, for example, a signal resulting from γ correction being performed on the image signal, or the like may be used. The signal voltage is a voltage which corresponds to the intended grayscale.

Because the effect and the like obtained by input of a signal a plural number of times is the same as that of Embodiment Mode 1,a description thereof will be omitted here.

After the same signal is input during each of the first subframe period and the second subframe period, a signal of the third subframe period and the fourth subframe period is input. In the present embodiment mode, the signal voltage is applied during one of the third subframe period and the fourth subframe period, and the voltage that is the result of the correction voltage added to the signal voltage is applied during the other one of the third subframe period and the fourth subframe period. It is preferable that during which of the third subframe period and the fourth subframe period is the signal voltage applied and during which of the third subframe period and the fourth subframe period is the voltage that is the result of the correction voltage added to the signal voltage applied be determined based on the relationship between the signal voltage of the one frame period during which the correction voltage is to be added and the signal voltage of the subsequent frame period.

For example, when the signal voltage of the subsequent frame period is higher than the signal voltage of the frame period during which the correction voltage is to be added, then the voltage that is the result of the correction voltage added to the signal voltage may be applied during the fourth subframe period; when the signal voltage of the subsequent frame period is lower than the signal voltage of the frame period during which the correction voltage is to be added, then the voltage that is the result of the correction voltage added to the signal voltage may be applied during the third subframe period.

Figure 5A:
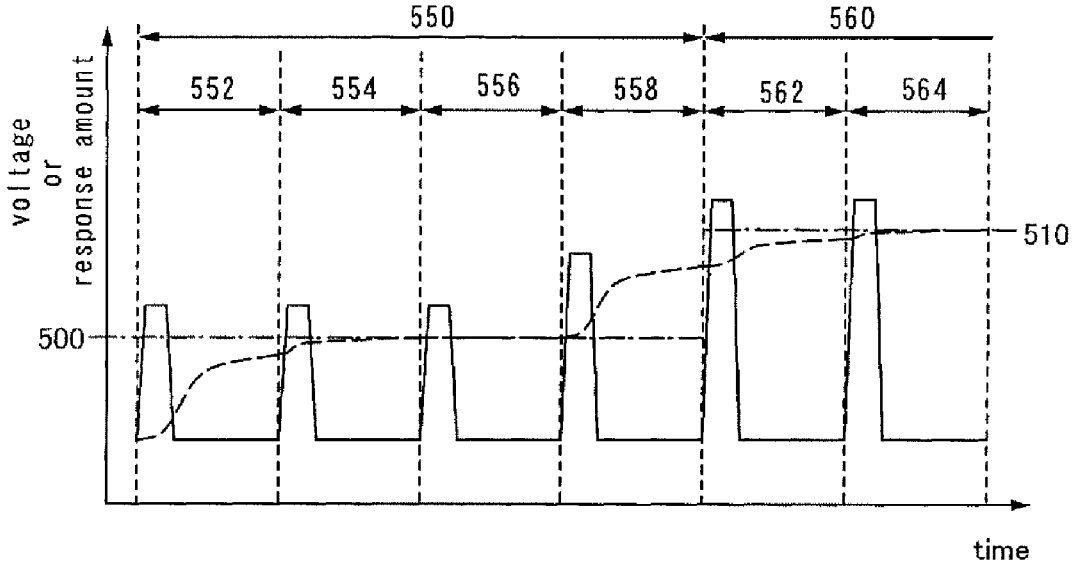
FIGS. 5A and 5B are graphs each used to illustrate a driving method of the present invention.
Figure 5B:
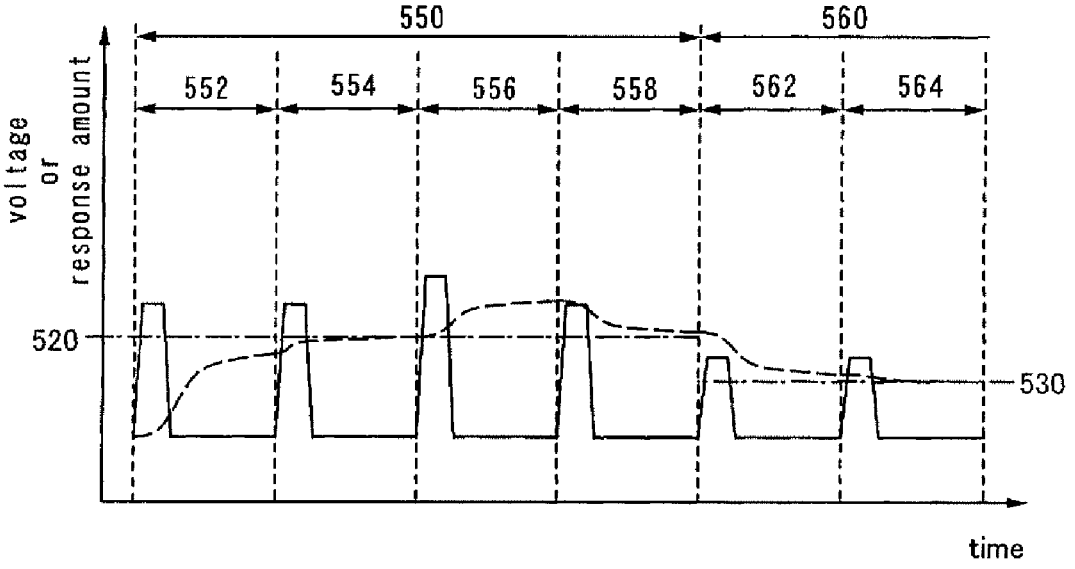

FIGS. 5A and 5B show the relationship between applied voltage and response amount for when the driving method as described above is used. In FIG. 5A, a case is shown in which the signal voltage applied during a second frame period 560 (subframe periods after a first subframe period 562, a second subframe period 564, and a third subframe period 566 are omitted) is higher than the signal voltage of a first frame period 550 (a first subframe period 552, a second subframe period 554, a third subframe period 556, and a fourth subframe period 558). In this way, when the response amount changes in a direction of increase, it is preferable that the voltage that is the result of the correction voltage added to the signal voltage be applied during the fourth subframe period 558. By the above driving method, the amount of change in the response amount of the liquid crystal when display changes from the first frame period 550 to the second frame period 560 can be reduced, decrease in image quality resulting from a delay in the response of the liquid crystal can be prevented.

In the same way, in FIG. 5B, a case is shown in which the signal voltage applied during the second frame period 560 is lower than the signal voltage of the first frame period 550. In this way, when the response amount changes in a direction of decrease, it is preferable that the voltage that is the result of the correction voltage added to the signal voltage be applied during the third subframe period 556. By the above driving method, the amount of change in the response amount of the liquid crystal when display changes from the first frame period 550 to the second frame period 560 can be reduced, decrease in image quality resulting from a delay in the response of the liquid crystal can be decreased.

In the driving method described above, the subframe period during which the voltage that is the result of the correction voltage added to the signal voltage is applied is determined based on the relationship between the signal voltage of the intended frame period during which the correction voltage is applied and the signal voltage of the subsequent frame period; however, the present invention is not limited to having this configuration. For example, the subframe period during which the voltage that is the result of the correction voltage added to the signal voltage is applied may also be determined based on the relationship between the signal voltage and correction voltage of the intended frame period during which the correction voltage is to be added and the signal voltage and correction voltage of the subsequent frame period. Furthermore, the subframe period during which the voltage that is the result of the correction voltage added to the signal voltage is applied may be determined based on the relationship between the target response amount of the intended frame period during which the correction voltage is to be added and the target response amount of the subsequent frame period. It is to be noted that the case shown in FIG. 5A corresponds to a case in which a target response amount 510 of the second frame period 560 is higher than a target response amount 500 of the first frame period 550, and the case shown in FIG. 5B corresponds to a case in which a target response amount 530 of the second frame period 560 is lower than a target response amount 520 of the first frame period 550.

It is to be noted that because the calculation method and the like for the response amount of the amount of insufficiency is the same as that of Embodiment Mode 1,a discussion thereof will be omitted here.

It is to be noted that, in the present embodiment mode, a case in which the amount of insufficiency in the response amount is corrected by application of a voltage in the positive direction, that is, a case in which the correction voltage is positive, is shown; however, the present invention is not limited to this kind of case. Cases where the response amount changes in a direction of decrease can be handled with the correction voltage being negative.

As shown in the present embodiment mode, one frame period is divided up into an n (n: integer, $n \geqq 3$) number of subframe periods, when the signal voltage of the subsequent frame period is higher than (or greater than or equal to) the signal voltage of the intended frame period, the $n^{th}$ subframe period is selected; when the signal voltage of the subsequent frame period is less than or equal to (or lower than) the signal voltage of the intended frame period, the $(n-1)^{th}$ subframe period is selected; the voltage that is the result of the correction voltage added to the signal voltage is applied to the pixel electrode during the selected subframe period; and the same voltage as the signal voltage is applied to the pixel electrode during periods other than the selected subframe period, whereby an improvement in response speed and accurate gradation display can be realized. Furthermore, because the amount of correction voltage can be determined by a simple calculation, there is an advantage in that this driving method is used more easily compared to overdrving. Of course, operation speed may be improved further by driving being made to be like overdriving. In this case, it is preferable that an overdrive voltage be applied during the first subframe period instead of the aforementioned signal voltage.

In addition, the use of the driving method of the present embodiment mode can decrease holding capacity. That is, because the liquid crystal display device becomes more insusceptible to effects of a decrease in voltage due to leak current by performance of writing of a signal a plural number of times during one frame period, it becomes possible to use a smaller holding capacitor than that required conventionally. By the size of the holding capacitor being decreased, a liquid crystal display device with a high aperture ratio and high video performance can be provided. In particular, by the number of writing times be increased (that is, by one frame period being divided up into several subframe periods) up to a point about equal to where a capacity overlapping with an opening is not needed, a liquid crystal display device that has a maximum aperture ratio and excellent video performance can also be provided. Under conditions in which the holding capacitor can be reduced enough, the structure can be set to be one tin which a capacitive wiring used for a holding capacitor is not included.

Furthermore, in the driving method of the present embodiment mode, because the subframe period during which the correction voltage is applied is selected in accordance with the response amount (target value) of the liquid crystal during the subsequent frame period, the length of the response time during the subsequent frame period can be shortened. As a consequence, the response speed can be increased even more. It is to be noted that when the selected subframe periods differ, there is a need to note that the values of the correction voltages differ, as well. For example, in the cases given in FIGS. 5A and 5B, the amount of correction voltage applied for the case of FIG. 5A is low compared to that of the case of FIG. 5B. This is because the amount of insufficiency in the response amount may be corrected using the third subframe and the fourth subframe in the case shown in FIG. 5B, whereas the amount of insufficiency in the response amount needs to be corrected using the fourth subframe only in the case shown in FIG. 5A.

It is to be noted that, even in the driving method of the present embodiment mode, the structure given in Embodiment Mode 2 in which the backlight is turned off can be employed. By the first subframe period, which is a transient state for the response, not being involved in display, the accuracy of the display gradation can be greatly improved. Furthermore, because impulse driving like that of a cathode ray tube can be realized by insertion of a black screen into each frame period, a further improvement in video performance becomes possible to attain. Furthermore, by the number of writing times be increased (that is, by one frame period being divided up into many different subframe periods) up to a point about equal to where a capacity overlapping with an aperture is not needed, a liquid crystal display device that has an optimum aperture ratio and excellent video performance can also be provided. Moreover, because a signal is input so as to correct the amount of insufficiency in the second subframe period only, the amount of difference in gradation displayed during the second subframe period and gradation displayed during the third subframe period is decreased, and causes for flicker can be reduced.

The present embodiment mode can be used in combination with Embodiment Mode 1 and Embodiment Mode 2,as appropriate.

Embodiment Mode 4

In the present embodiment mode, the application pattern of the correction voltage described in Embodiment Mode 3 will be described by being divided up into a number of different cases. Specifically, conditions in which the subframe period during which the correction voltage is applied is selected based on the magnitude relationship of signal voltage of an intended frame period A, a frame period B immediately preceding the intended frame period A, and a frame period C immediately following the intended frame period A will be described.

FIGS. 24A to 24H are diagrams showing the magnitude relationship of signal voltage of an intended frame period A, a frame period B immediately preceding the intended frame period A, and a frame period C immediately following the intended frame period A divided up into a number of different patterns. Here, for sake of simplicity, signal voltage represented by two values of high voltage (referred to as H hereinafter) and low voltage (referred to as L hereinafter) is shown; however, cases in which signal voltage is represented by a plurality of different values can be addressed in the same way.

Figure 24A:
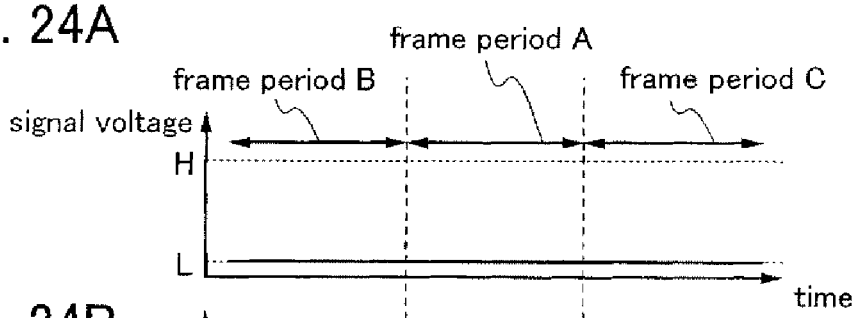
FIGS. 24A to 24H are graphs divided into a number of patterns, each showing a magnitude relation of signal voltage.
Figure 24B:
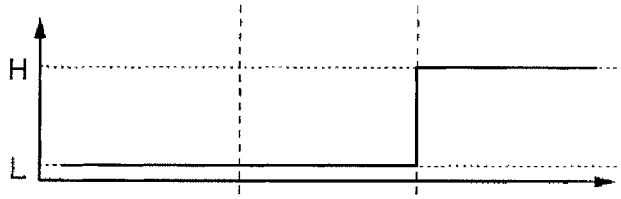

In FIG. 24A, a case is shown in which the signal voltage is L, L, and L in respective frame periods and does not change. In FIG. 24B, a case where the signal voltage is L, L, and H in respective frame periods is shown; in FIG. 24C, a case where the signal voltage is L, H, and L in respective frame periods; in FIG. 24D, H, L, and L; in FIG. 24E, L, H, and H; in FIG. 24F, H, L, and H; and in FIG. 24G H, H, and L. Furthermore, in FIG. 24H, a case is shown in which the signal voltage is H, H, and H in respective frame periods and does not change.

In FIGS. 24A, 24B, 24G and 24H, there is no difference in the signal voltages of the intended frame period A and the frame period B immediately preceding the intended frame period A. In this kind of case, there is no need to apply a correction voltage during the intended frame period A.

Figure 24C:
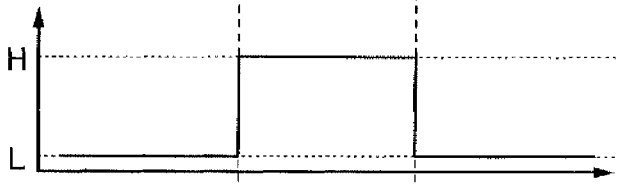
Figure 24D:
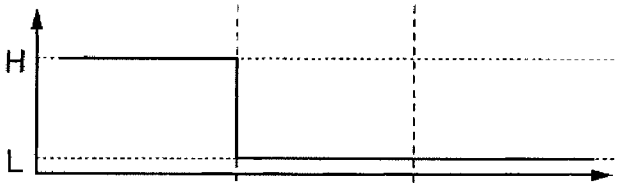
Figure 24E:
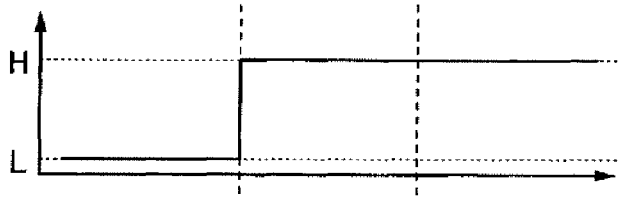

In FIGS. 24C and 24E, the signal voltage of the intended frame period A is high compared to that of the frame period B immediately preceding the intended frame period A. Because a delay in rising of the liquid crystal occurs in this kind of case, a positive correction voltage needs to be applied.

Here, the signal voltages of the intended frame period A and the frame period C immediately following the intended frame period A are compared. In the case of FIG. 24C, the signal voltage of the frame period C immediately following the intended frame period A is lower than that of the intended frame period A. In the case of FIG. 24C, because a positive voltage comes to be applied for the correction voltage, it is preferable that selection of the last subframe period be avoided as the subframe period during which the correction voltage is applied. More specifically, this refers to a case in which, for example, when one frame period is divided up into an n number of subframe periods, it is preferable that a subframe period other than the first subframe period or the nth subframe period be selected as the period during which the correction voltage is applied. The same is true in cases in which, as shown in FIG. 24E, there is no difference in the signal voltages of the intended frame period A and the frame period C immediately following the intended frame period A.

It is to be noted that, in the present embodiment mode, because an explanation is given using a case with two values, the case in which the signal voltage of the frame period C immediately following the intended frame period A comes to be high compared to the signal voltage of the intended frame period A is not shown; however, this kind of situation may occur in cases with a plurality of values, In these cases, it is preferable that subframe periods including the last subframe period be selected as the subframe periods during which the correction voltage is to be added. When one frame period is divided up into an n number of subframe periods, it can be said that it is preferable that one or a plurality of subframe periods including at least the $n^{th}$ subframe period be selected as the subframe period or periods during which the correction voltage is to be added.

Figure 24F:
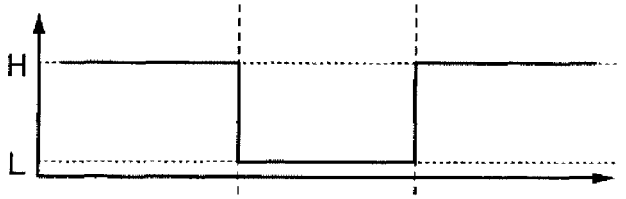
Figure 24G:
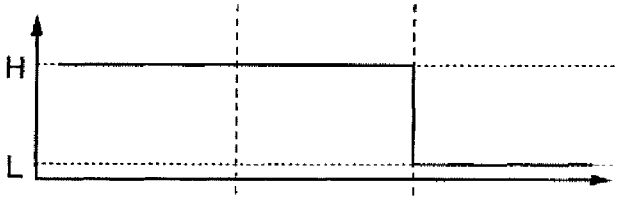
Figure 24H:
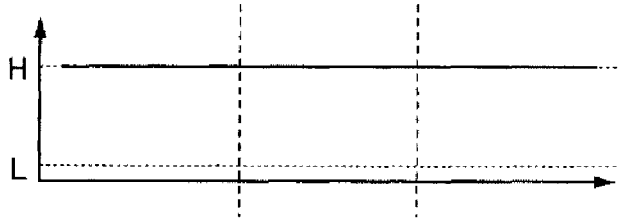

In FIGS. 24D and 24F, the signal voltage of the intended frame period A is low compared to that of the frame period B immediately preceding the intended frame period A. Because a delay in falling of the liquid crystal occurs in this kind of case, a negative correction voltage needs to be applied.

As in the case in which a positive correction voltage is applied, the signal voltages of the intended frame period A and the frame period C immediately following the intended frame period A are compared. In the case of FIG. 24F, the signal voltage of the frame period C immediately following the intended frame period A is higher than that of the intended frame period A. In the case of FIG. 24F, because a negative voltage comes to be applied for the correction voltage, it is preferable that selection of the last subframe period be avoided as the subframe period during which the correction voltage is applied. More specifically, this refers to a case in which, for example, when one frame period is divided up into an n number of subframe periods, it is preferable that a subframe period other than the first subframe period or the nth subframe period be selected as the period during which the correction voltage is applied. The same is true in cases in which, as shown in FIG. 24D, there is no difference in the signal voltages of the intended frame period A and the frame period C immediately following the intended frame period A.

It is to be noted that, in the present embodiment mode, because an explanation is given using a case with two values, the case in which the signal voltage of the frame period C immediately following the intended frame period A comes to be low compared to the signal voltage of the intended frame period A is not shown; however, this kind of situation may occur in cases with a plurality of values. In these cases, it is preferable that subframe periods including the last subframe period be selected as the subframe periods during which the correction voltage is to be added. When one frame period is divided up into an n number of subframe periods, it can be said that it is preferable that one or a plurality of subframe periods including the $n^{th}$ subframe period at least be selected as the subframe period or periods during which the correction voltage is to be added.

This is summarized as follows:

When the correction voltage is positive:

(a) When the signal voltage of the subsequent frame period is lower than the signal voltage of the intended frame period (and when there is no difference in signal voltages of the subsequent frame period and the intended frame period): subframe periods other than the first subframe period and the last subframe period are selected as the subframe periods during which the correction voltage is to be added.

(b) When the signal voltage of the subsequent frame period is higher than the signal voltage of the intended frame period: subframe periods including the last subframe period are selected as the subframe periods during which the correction voltage is to be added.

When the correction voltage is negative:

(c) When the signal voltage of the subsequent frame period is higher than the signal voltage of the intended frame period (and when there is no difference in signal voltages of the subsequent frame period and the intended frame period): subframe periods other than the first subframe period and the last subframe period are selected as the subframe periods during which the correction voltage is to be added.

(d) When the signal voltage of the subsequent frame period is lower than the signal voltage of the intended frame period: subframe periods including the last subframe period are selected as the subframe periods during which the correction voltage is to be added.

As shown above, by application of a correction voltage during selected subframe periods so that the difference between the voltage applied during the $n^{th}$ subframe period of the intended frame period and the voltage applied during the first subframe period of the frame period subsequent to the intended frame period comes to be low, effects of response delay in the liquid crystal can be greatly decreased.

The present embodiment mode can be used in combination with Embodiment Mode 1 through Embodiment Mode 3,as appropriate.

Embodiment Mode 5

Examples of a fabrication method of an active matrix substrate that can be used in a liquid crystal display device of the present invention will be described using FIGS. 6A to 6D, FIGS. 7A to 7C, and FIGS. 8A to 8C. It is to be noted that cases in which a crystalline semiconductor film is used will be described in the present embodiment mode; however, an amorphous semiconductor film or a single-crystal semiconductor film may be used, as well.

Figure 6A:
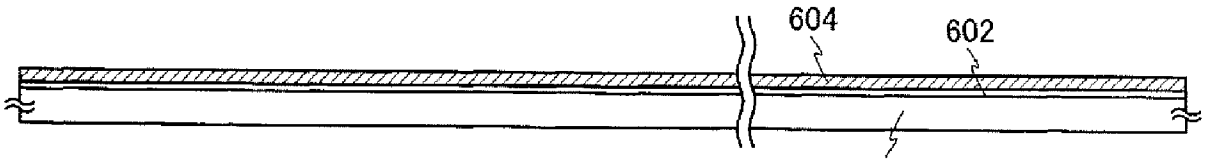
FIGS. 6A to 6D are diagrams used to illustrate a fabrication process of an active matrix substrate of the present invention.

First, as shown in FIG. 6A, a base film 602 is formed over a substrate 600 For the substrate 600, for example, a glass substrate of barium borosilicate glass, aluminum borosilicate glass, or the like; a quartz substrate; a stainless steel substrate; or the like can be used. Furthermore, a flexible substrate formed of a synthetic resin such as a plastic typified by PET, PES, or PEN; acrylic; or the like can also be used.

The base film 602 is provided to prevent an alkali metal, such as Na or the like, or an alkaline earth metal contained within the substrate 600 from diffusing into a semiconductor film and imparting adverse effects on the characteristics of a semiconductor element. Consequently, the base film 602 is formed using an insulating material of silicon nitride or silicon oxide that contains nitrogen by which the diffusion of an alkali metal or alkaline earth metal into a semiconductor film can be suppressed. In the present embodiment mode, a silicon oxide film that contains nitrogen is formed for the base film 602 so as to have a film thickness of from 10 nm to 400 nm (preferably, from 50 nm to 300 nm) using a plasma CVD method.

Next, a semiconductor film 604 is formed over the base film 602. The film thickness of the semiconductor film 604 is set to be from 25 nm to 100 nm (preferably from 30 nm to 60 nm). It is to be noted that the semiconductor film 604 may be formed of an amorphous semiconductor or a polycrystalline semiconductor. In addition, for the semiconductor, not only silicon (Si) but also silicon germanium (SiGe) or the like can be used. When silicon germanium is used, it is preferable that the concentration of germanium be from approximately 0.01 at. % to approximately 4.5 at. %.

Figure 6B:
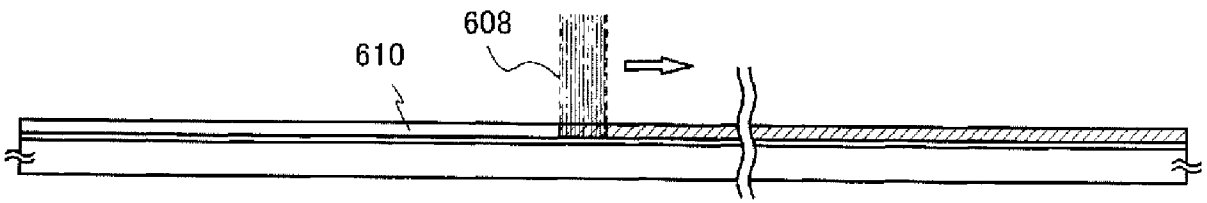

Next, as shown in FIG. 6B, crystallization is performed by irradiation of the semiconductor film 604 with a linear laser beam 608. When laser crystallization is performed as in the present embodiment mode, in order to increase the tolerance of the semiconductor film 604 to a laser beam, a heat treatment step performed at a temperature of 500° C. for one hour may be added before the laser crystallization step.

In the laser crystallization step, for example, a continuous wave laser (a CW laser), a quasi-continuous wave laser (a pulsed laser with a repetition rate of 10 MHz or more, preferably, 80 MHz or more), or the like can be used.

Specifically, for a continuous wave laser, an Ar laser, a Kr laser, a $CO_2$ laser, a YAG laser, a $YVO_4$ laser, a YLF laser, a $YAlO_3$ laser, a $GdVO_4$ laser, a $Y_2O_3$ laser, a ruby laser, an alexandrite laser, a Ti:sapphire laser, a helium-cadmium laser, and the like can be given.

Furthermore, for a quasi-CW laser, a pulsed laser such as an Ar laser, a Kr laser, an excimer laser, a $CO_2$ laser, a YAG laser, a $YVO_4$ laser, a YLF laser, a $YAlO_3$ laser, a $GdVO_4$ laser, a $Y_2O_3$ laser, a ruby laser, an alexandrite laser, a Ti:sapphire laser, a copper vapor laser, or a gold vapor laser can be given.

This kind of pulsed laser comes to exhibit the same effects as a continuous wave laser if the repetition rate is increased.

For example, when a solid-state laser capable of continuous oscillation is used, by irradiation at the second through fourth harmonics of a fundamental frequency, crystals with a large grain size can be obtained. Typically, the second harmonic (532 nm) or third harmonic (355 nm) of a YAG laser (a fundamental of 1064 nm) can be used. The power density may be set to be from 0.01 $MW/cm^2$ to 100 $MW/cm^2$ (preferably, from 0.1 $MW/cm^2$ to 10 $MW/cm^2$).

As described above, by irradiation of the semiconductor film 604 with a laser beam, a crystalline semiconductor film 610 with even higher crystallinity is formed.

Figure 6C:
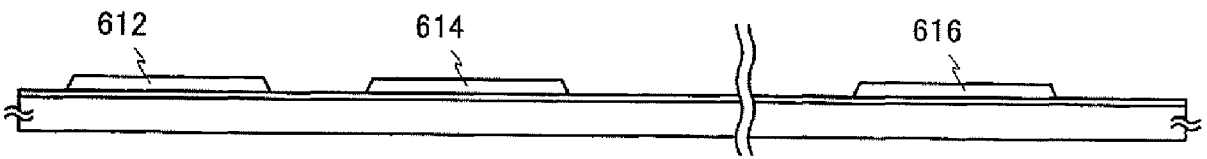

Next, by etching of the crystalline semiconductor film 610 as selected, as shown in FIG. 6C, island-shaped semiconductor films 612, 614, and 616 are formed.

Next, an impurity element is introduced into each of the island-shaped semiconductor films 612, 614, and 616 in order to control threshold voltage In the present embodiment mode, boron (B) is introduced by doping with diborane ($B_2H_6$)

Next an insulating film 618 is formed so as to cover the island-shaped semiconductor films 612, 614, and 616. For the insulating film 618, for example, silicon oxide, silicon nitride, silicon oxide that contains nitrogen ($SiO_xN_y$, where x>y>0), or the like can be used. Furthermore, for a film formation method, a plasma CVD method, a sputtering method, or the like can be used.

Next, after a first conductive film 620 and a second conductive film 622 are formed over the insulating film 618, gate electrodes 636, 638, and 640 are formed by selective etching of the conductive films 620 and 622 (FIG. 6D and FIGS. 7A to 7C).

For the first conductive film 620 and second conductive film 622, one or a plurality of elements selected from aluminum (Al), tantalum (Ta), titanium (Ti), molybdenum (Mo), tungsten (W), neodymium (Nd), chromium (Cr), nickel (Ni), platinum (Pt), gold (Au), silver (Ag), copper (Cu), magnesium (Mg), scandium (Sc), cobalt (Co), zinc (Zn), niobium (Nb), silicon (Si), phosphorus (P), boron (B), arsenic (As), gallium (Ga), indium (In), and tin (Sn); a compound or alloy material that contains one of the given elements as its main component (for example, indium tin oxide (ITO), indium zinc oxide (IZO), indium tin oxide that contains silicon (ITSO), zinc oxide (ZnO), aluminum-neodymium (Al—Nd), magnesium-silver (MgAg), or the like); a material that is a combination of any of these compounds; or the like can be used. In addition to what is given above, a silicide (for example, aluminum-silicon, molybdenum-silicon, or nickel silicide), a compound that contains nitrogen (for example, titanium nitride, tantalum nitride, or molybdenum nitride), silicon (Si) that has been doped with an impurity element such as phosphorus (P) or the like, or the like may be used. It is to be noted that in the present embodiment mode, the structure of conductive films is set to be a two-layer structure of the first conductive film 620 and the second conductive film 622, but the structure may be a single layer or a stacked-layer structure of three or more layers, as well.

Figure 6D:
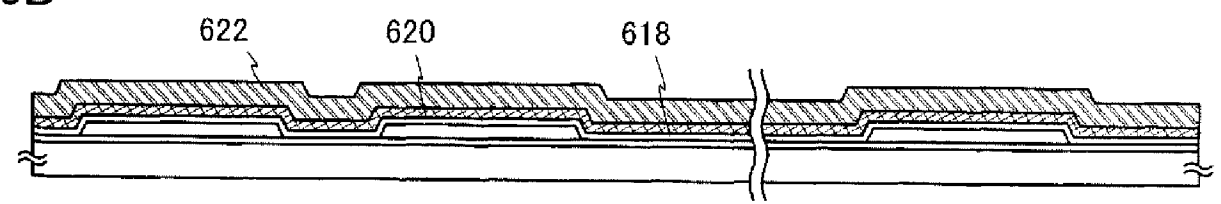

In the present embodiment mode, the gate electrodes 636, 638, and 640 are formed as described hereinafter First, for the first conductive film 620, for example, a tantalum nitride film is formed at a film thickness of from 10 nm to 50 nm, typically, at a film thickness of 30 nm. In addition, for the second conductive film 622 formed over the first conductive film 620, for example, a tungsten film is formed at a film thickness of from 200 nm to 400 nm, typically, at a film thickness of 370 nm, and a stacked-layer film of the first conductive film 620 and the second conductive film 622 is formed (FIG. 6D).

Figure 7A:
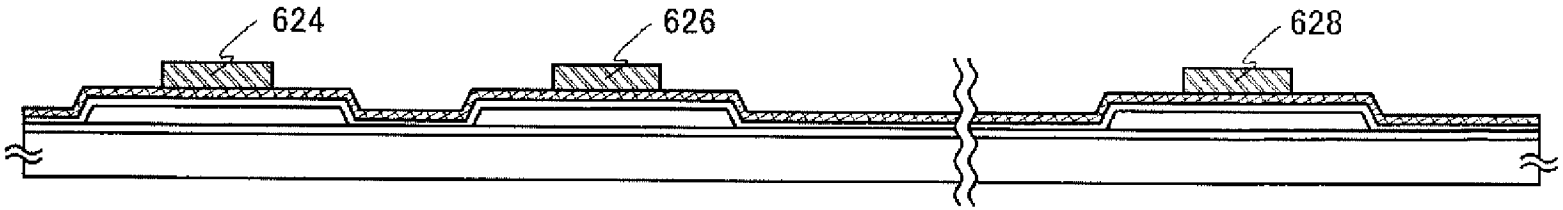
FIGS. 7A to 7C are diagrams used to illustrate a fabrication process of an active matrix substrate of the present invention.
Figure 7B:
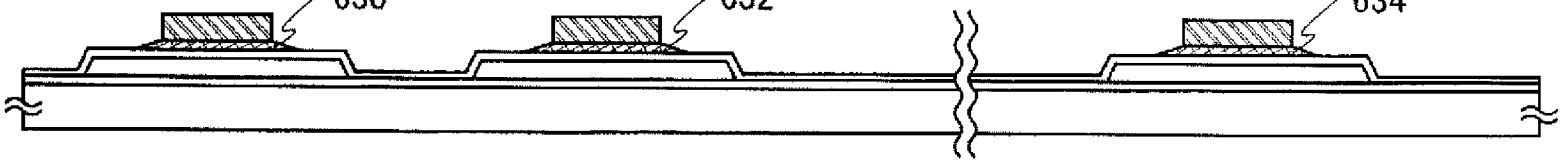

Next, the second conductive film 622 is patterned by anisotropic etching, whereby upper layer gate electrodes 624, 626, and 628 are formed (FIG. 7A). Subsequently, the first conductive film 620 is patterned by isotropic etching, whereby bottom layer gate electrodes 630, 632, and 634 are formed (FIG. 7B). The gate electrodes 636, 638, and 640 are formed by the aforementioned steps.

The gate electrodes 636, 638, and 640 may each be formed as a part of a gate wiring, or the structure may be one in which the gate electrodes 636, 638, and 640 are connected to a gate wiring that is formed separately.

Next, an impurity imparting a conductivity (either n-type or p-type conductivity) is added to each of the island-shaped semiconductor films 612, 614, and 616 using the gate electrodes 636, 638, and 640; a resist formed as selected; and the like as masks, whereby source regions, drain regions, low-concentration impurity regions, and the like are formed.

Figure 7C:
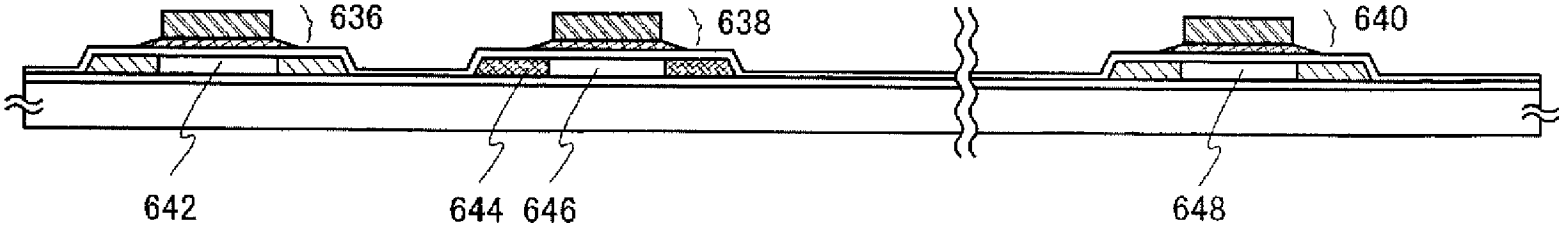

First, phosphorus (P) is added to the island-shaped semiconductor films 612 and 616 using phosphine ($PH_3$). For introduction conditions, it is preferable that the accelerating voltage be set to be from 60 kV to 120 kV and that the dose amount be set to be from $1\times10^{13}$ $atoms\cdot cm^{-2}$ to $1\times10^{5}$ $atoms\cdot cm^{-2}$. By introduction of this impurity, channel formation regions 642 and 648 of n-channel TFTs 678 and 682 that are to be formed in a later step are formed (FIG. 7C).

Moreover, boron (B) is added to the island-shaped semiconductor film 614 using diborane ($B_2H_6$). For introduction conditions, it is preferable that the applied voltage be set to be from 60 kV to 100 kV and that the dose amount be set to be from $1\times10^{13}$ atoms·cm$^{-2}$ to $1\times10^{15}$ atoms·cm$^{-2}$. Hereby, each of a source region or drain region 644 and a channel formation region 646 of a p-channel TFT 680 that is to be formed in a later step are formed (FIG. 7C).

Next, gate insulating films 650, 652, and 654 are formed by selective etching of the insulating film 618.

Figure 8A:
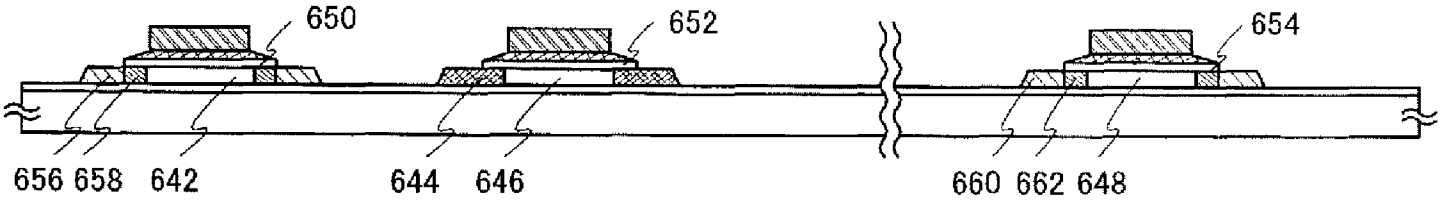
FIGS. 8A to 8C are diagrams used to illustrate a fabrication process of an active matrix substrate of the present invention.

After the gate insulating films 650, 652, and 654 are formed, phosphorus (P) is introduced into the island-shaped semiconductor films that form the n-channel TFTs 678 and 682 using phosphine ($PH_3$) at an applied voltage of from 40 kV to 80 kV and a dose amount of from $1.0\times10^{15}$ atoms·cm$^{-2}$ to $2.5\times10^{16}$ atoms·cm$^{-2}$. Hereby, low-concentration impurity regions 658 and 662 and regions 656 and 660, each of which is a source region or a drain region, of n-channel TFTs 678 and 682 are formed (FIG. 8A).

In the present embodiment mode, the regions 656 and 660, each of which is a source region or a drain region, each contain phosphorus (P) at a concentration of from $1\times10^{19}$ atoms·cm$^{-3}$ to $5\times10^{21}$ atoms·cm$^{-3}$. Furthermore, the low-concentration impurity regions 658 and 662 each contain phosphorus (P) at a concentration of from $1\times10^{18}$ atoms·cm$^{-3}$ to $5\times10^{19}$ atoms·cm$^{-3}$. In addition, the region 644, which is a source region or drain region contains boron (B) at a concentration of from $1\times10^{19}$ atoms·cm$^{-3}$ to $5\times10^{21}$ atoms·cm$^{-3}$.

Figure 8B:
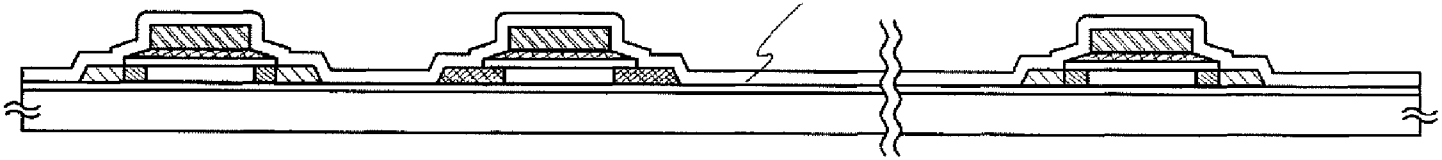

Next, a first interlayer insulating film 664 is formed so as to cover the island-shaped semiconductor films 612, 614, and 616 and the gate electrodes 636, 638, and 640 (FIG. 8B).

It is preferable that the interlayer insulating film 664 be formed of a single layer or stacked layer of an insulating film that contains silicon, for example, a silicon oxide film, a silicon nitride film, a silicon oxide film that contains nitrogen (a film of $SiO_xN_y$, where x>y>0), or the like using a plasma CVD method or a sputtering method. Of course, the fabrication method and materials of the first interlayer insulating film 664 are not limited to being those given above. For example, a single layer or stacked layer structure of other insulating films may be used, as well.

Figure 8C:
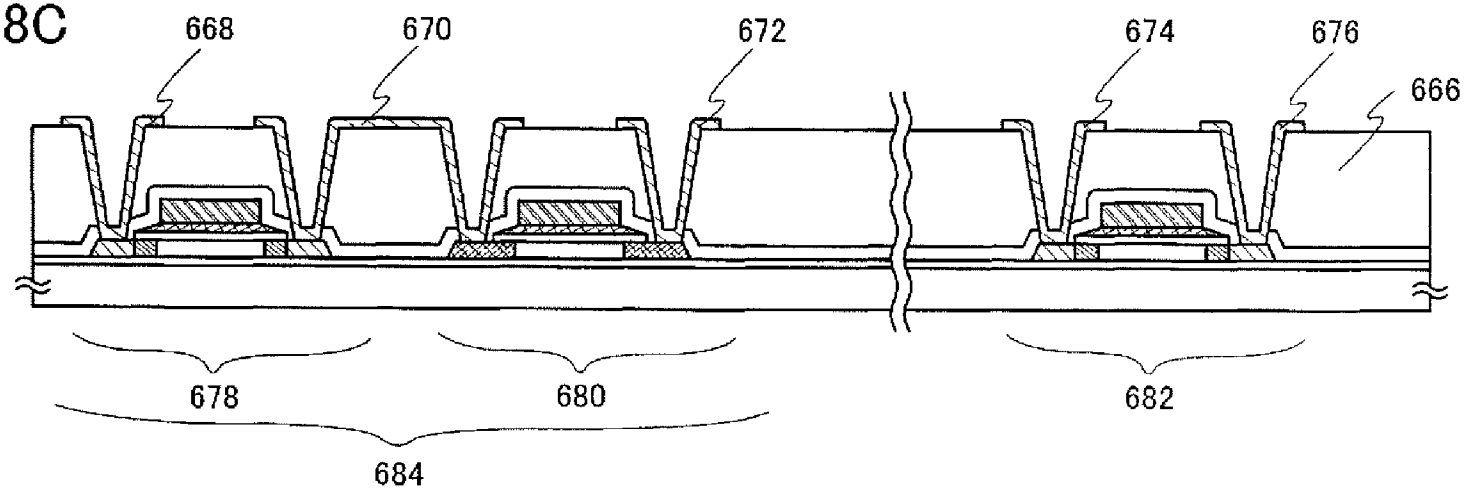

Next, a second interlayer insulating film 666 that functions as a planarizing film is formed to cover the first interlayer insulating film 664 (FIG. 8C).

For the second interlayer insulating film 666, a photosensitive or non-photosensitive organic material (polyimide, acrylic, polyamide, polyimide amide, a resist, or benzocyclobutene), siloxane formed with a skeleton structure of bonds of silicon (Si) and oxygen (O) (Si—O—Si bonds), or the like can be used. The second interlayer insulating film 666 may have a single-layer structure or a stacked-layer structure. For a photosensitive organic material, a positive photosensitive organic resin or negative photosensitive organic resin can be used.

In the present embodiment mode, siloxane is formed for the second interlayer insulating film 666 by a spin-coating method.

Next, the first interlayer insulating film 664 and the second interlayer insulating film 666 are etched, whereby a contact hole that reaches the island-shaped semiconductor films 612, 614, and 616 is formed.

It is to be noted that a third interlayer insulating film may be formed over the second interlayer insulating film 666 and the contact hole may be formed in the first interlayer insulating film through the third interlayer insulating film, as well. For the third interlayer insulating film, it is preferable that a film through which moisture, oxygen, and the like do not readily pass be used. Typically, a silicon nitride film, a silicon oxide film, a silicon nitride film that contains oxygen (a film of $SiN_xO_y$, where x>y>0 or $SiO_xN_y$, where x>y>0), a thin film that contains carbon as its main component (for example, a DLC film or a CN film), or the like formed by a sputtering method or a CVD method can be used.

Through the contact hole formed in the second interlayer insulating film 666, a third conductive film is formed, and the third conductive film is etched as selected, whereby electrodes and/or wirings 668, 670, 672, 674, and 676 are formed.

For the third conductive film, one or a plurality of elements selected from aluminum (Al), tantalum (Ta), titanium (Ti), molybdenum (Mo), tungsten (W), neodymium (Nd), chromium (Cr), nickel (Ni), platinum (Pt), gold (Au), silver (Ag), copper (Cu), magnesium (Mg), scandium (Sc), cobalt (Co), zinc (Zn), niobium (Nb), silicon (Si), phosphorus (P), boron (B), arsenic (As), gallium (Ga), indium (In), and tin (Sn); a compound or alloy material that contains one of the given elements as its main component (for example, indium tin oxide (ITO), indium zinc oxide (IZO), indium tin oxide that contains silicon oxide (ITSO), zinc oxide (ZnO), aluminum-neodymium (Al—Nd), magnesium-silver (MgAg), or the like); a material that is a combination of any of these compounds; or the like can be used. In addition to what is given above, a silicide (for example, aluminum-silicon, molybdenum-silicon, or nickel silicide), a compound that contains nitrogen (for example, titanium nitride, tantalum nitride, or molybdenum nitride), silicon (Si) that has been doped with an impurity element such as phosphorus (P) or the like, or the like may be used.

In the present embodiment mode, after a titanium (Ti) film, a titanium nitride film, a silicon-aluminium (Si—Al) alloy film, and a titanium (Ti) film of thicknesses of 60 nm, 40 nm, 300 nm, and 100 nm, respectively, are stacked together, the films are etched as selected so as to be formed into desired shapes, whereby the electrodes and/or wirings 668, 670, 672, 674, and 676 are formed.

It is to be noted that the electrodes and/or wirings 668, 670, 672, 674, and 676 may be formed of an aluminum alloy film that contains at least one type of element of nickel (Ni), cobalt (Co), or iron (Fe) and carbon (C), as well. With use of this kind of aluminum alloy film, there is an advantage in that mutual diffusion of silicon and the materials of which the electrodes or the like are formed can be prevented even if the electrodes or the like make contact with silicon (Si). In addition, this kind of aluminum alloy film has a characteristic such that oxidation-reduction reactions do not occur even if this aluminum alloy film makes contact with a transparent conductive film, for example, a transparent conductive film formed using indium tin oxide (ITO), and the two films can be made to be in direct contact with each other Furthermore, because this kind of aluminum alloy film has low resistivity and excellent heat resistance, it is suitable for use as a wiring material.

Moreover, for each of the electrodes and/or wirings 668, 670, 672, 674, and 676, a structure in which an electrode and a wiring are formed at the same time may be used, or a structure in which an electrode and a wiring are formed separately and then connected together may be used, as well.

By the sequence of steps described above, an active matrix substrate that includes a CMOS circuit 684, which includes the n-channel TFT 678 and the p-channel TFT 680, and the n-channel TFT 682 can be formed (FIG. 8C). It is to be noted that a fabrication method of an active matrix substrate that can be used in the present invention is not limited to being the fabrication process described above. For example, a process by which a TFT is formed using an amorphous semiconductor film or a process by which a TFT is formed using a single-crystal semiconductor film may be employed, as well. Furthermore, the TFTs are not limited to being top-gate TFTs, and bottom-gate TFTs may be used, as well.

Moreover, an active matrix substrate that can be used in a liquid crystal display device of the present invention is not limited to having a structure in which the driving circuit is formed over a single substrate. For example, the driving circuit (or a part thereof) may be formed over a single-crystal substrate and that IC chip connected by chip-on-glass (COG) and placed over a glass substrate. In addition, the IC chip may be connected to a glass substrate using tape automated bonding (TAB) or a printed circuit board.

The present embodiment mode can be used in combination with any of Embodiment Mode 1 through Embodiment Mode 4,as appropriate.

Embodiment Mode 6

Figure 11:
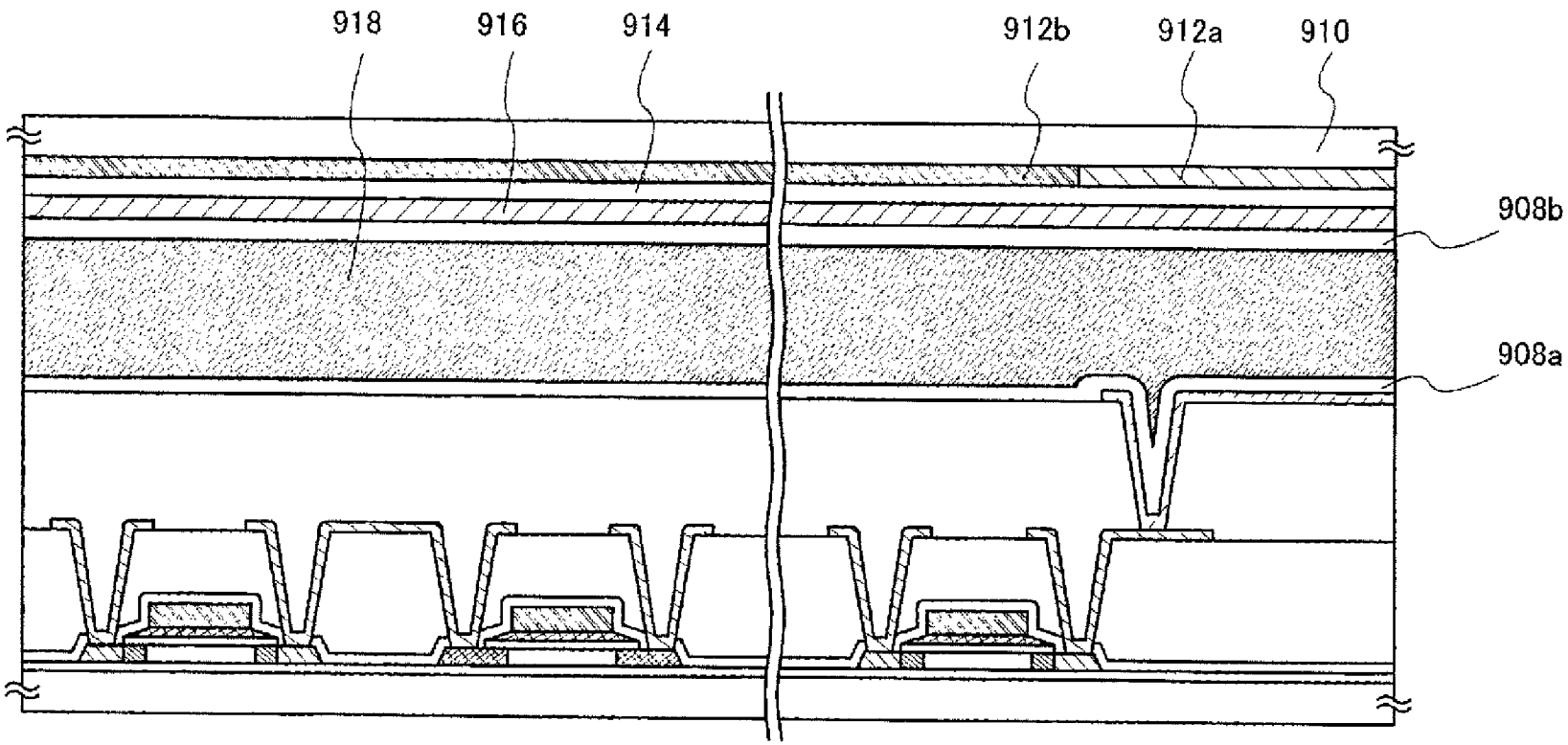
FIG. 11 is a diagram showing a cross-sectional view of a liquid crystal display device of the present invention.

In the present embodiment mode, a fabrication process of a liquid crystal display device in which a driving method of the present invention is used will be described using FIG. 9, FIG. 10, and FIG. 11.

The fabrication method of a liquid crystal display device described in the present embodiment mode is a method in which a pixel section, which includes pixel TFTs, and TFTs of a driver circuit section provided in the periphery of the pixel section are fabricated at the same time. However, for sake of simplicity, for the driver circuit, only a CMOS circuit, which is a basic unit, is shown.

First, an active matrix substrate is fabricated using methods and the like given in Embodiment Mode 5. Here, in the present embodiment mode, an explanation will be given using the active matrix substrate fabricated using the method outlined in Embodiment Mode 5;however, the fabrication method of a liquid crystal display device of the present invention is not to be limited to this method.

First, the process up through formation of the electrodes and/or wirings 668, 670, 672, 674, and 676 is performed in accordance with Embodiment Mode 5 (FIG. 8C). It is to be noted that in drawings used hereinafter, the same reference numerals are used to denote components that are the same as those of Embodiment Mode 5.

Figure 9:
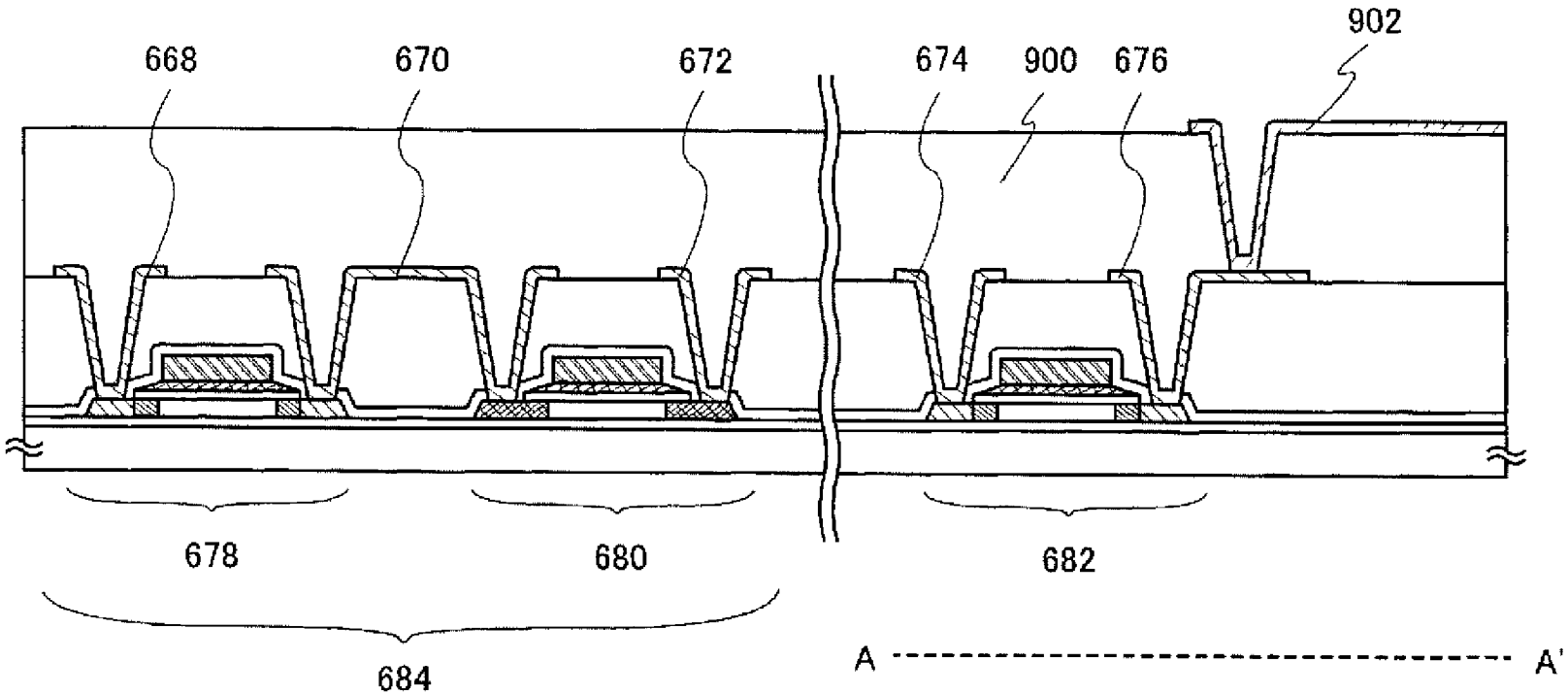
FIG. 9 is a diagram used to illustrate a fabrication process of a liquid crystal display device of the present invention.

Next, a third interlayer insulating film 900 is formed over the second interlayer insulating film 666 and the electrodes and/or wirings 668, 670, 672, 674, and 676 (FIG. 9). It is to be noted that the third interlayer insulating film 900 can be formed using the same materials as those used to form the second interlayer insulating film 666.

Next, a resist mask is formed using a photo mask, and a part of the third interlayer insulating film 900 is removed by dry etching to form a contact hole. In formation of the contact hole, carbon tetrafluoride ($CF_4$), oxygen ($O_2$), and helium (He) at flow rates of 50 sccm, 50 sccm, and 30 sccm, respectively, are used as etching gases. It is to be noted that the bottom of the contact hole reaches the electrode and/or wiring 676.

After the resist mask is removed, a fourth conductive film is formed over the entire surface. Next, the fourth conductive film is etched as selected, whereby a pixel electrode 902 that is electrically connected to the electrode and/or wiring 676 is formed (FIG. 9). In cases in which a reflective liquid crystal display device is fabricated, the pixel electrode 902 may be formed of a metal material of silver (Ag), gold (Au), copper (Cu), tungsten (W), aluminum (Al), or the like that reflects light by a sputtering method. In cases in which a transmissive liquid crystal display device is fabricated, the pixel electrode 902 can be formed using a transparent conductive film of indium tin oxide (ITO), indium tin oxide that contains silicon oxide, zinc oxide (ZnO), tin oxide ($SnO_2$), or the like.

Furthermore, the present invention can be applied without being limited to being applied to a reflective type or a transmissive type. For example, the present invention may be applied to a so-called transflective liquid crystal display device in which a part of the pixels are of the reflective type and a part of the pixels are of the transmissive type. A transflective liquid crystal display device has the advantages in that luminance is easily secured and power consumption is easily reduced by use thereof because the transflective liquid crystal display device can be used as a reflective type when the amount of light from external is great and as a transmissive type when such is not the case.

An enlarged top-view diagram of a part of the pixel section that includes the pixel TFTs is shown in FIG. 10. In FIG. 10, a diagram showing the pixel section midway through formation of the pixel electrode, and a pixel electrode is formed in a pixel on the left side, but no pixel electrode is formed in a pixel on the right side. It is to be noted that a line A-A' in FIG. 10 corresponds to the line A-A' of the pixel section in FIG. 9, and the same reference numerals are used for parts in FIG. 10 that correspond to parts in FIG. 9.

As shown in FIG. 10, the gate electrode 640 is connected to a gate wiring 904. Moreover, the electrode and/or wiring 674 is formed integrated together with a source wiring. Furthermore, a capacitive wiring 906 is formed, and a holding capacitor is formed from the first interlayer insulating film 664, the pixel electrode 902, and the capacitive wiring 906. It is to be noted that, in the present embodiment mode, a structure in which a holding capacitor is provided is given; however, by use of the present invention, the holding capacitor can be made smaller Consequently, if the structure is set to be one in which no capacitive wiring is provided, the aperture ratio of the pixels can be improved. In particular, in a transmissive liquid crystal display device, this effect is significant.

By the process given above, the top-gate pixel TFT (n-channel TFT) 682; the CMOS circuit 684 that is formed of the top-gate, n-channel TFT 678 and the top-gate, p-channel TFT 680; and the pixel electrode 902 are formed over the substrate 600. In the present embodiment mode, an example in which top-gate TFTs are formed is given; however, bottom-gate TFTs may be formed, as well.

Next an alignment film 908*a* is formed so as to cover the pixel electrode 902. It is to be noted that the alignment film 908*a* may be formed using a liquid droplet discharge method, a screen printing method, an offset printing method, or the like. After the alignment film 908*a* is formed, rubbing treatment is performed on the surface of the alignment film 908*a*.

Next, a counter substrate 910 that is to be attached to the substrate 600 is prepared. Here, on the counter substrate 910, a color filter formed of a colored layer 912*a*, a light-blocking layer (black matrix) 912*b*,and an overcoat layer 914 is provided, and a counter electrode 916, further formed of a light-transmissive electrode or a light-reflective electrode, and an alignment film 908*b* are formed (FIG. 11). For the counter substrate 910, a substrate that has the same size or the same shape as the substrate 600 can be used. Here, there is no need for the same size and the same shape to be exactly the same, and the "same size" and "same shape" refer to a size and shape that are more or less adequate in formation of a panel.

Next, the substrate 600 and the counter substrate 910 obtained by the aforementioned process are attached to each other through a sealant. Here, a spacer may be provided between the alignment film 908*a* and the alignment film 908*b* in order that the gap between the two substrates be maintained at an equal distance. Next, a liquid crystal 918 is injected into the space between the two substrates, and the liquid crystal display device is completed by sealing of the two substrates using a sealing material (FIG. 11).

In addition, in a liquid crystal display device of the present invention, a twisted nematic (TN) method, an in-plane switching (IPS) method, a fringe field switching (FFS) method, a multi-domain vertical alignment (MVA) method, a patterned vertical alignment (PVA) method, an axially symmetric aligned micro-cell (ASM) method, an optical compensated birefringence (OCB) method, a ferroelectric liquid crystal (FLC) method, an anti-ferroelectric liquid crystal (AFLC) method, or the like can be used.

The present embodiment mode can be used in combination with Embodiment Mode 1 through Embodiment Mode 5,as appropriate.

Embodiment Mode 7

In the present embodiment mode, a liquid crystal display device in which a silicon on insulator (SOI) substrate is used will be described hereinafter. It is to be noted that the SOI substrate of the present embodiment mode is a substrate that is formed by being transferred from a single-crystal semiconductor substrate to a substrate of a different type (hereinafter, this substrate will also be referred to as a "base substrate").

Figure 12A:
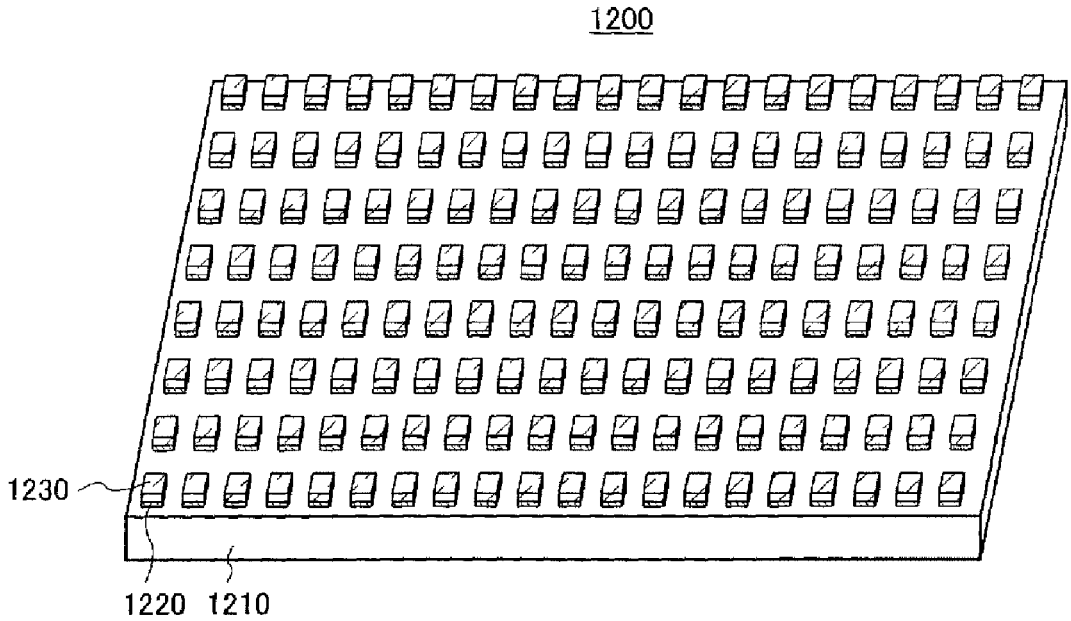
FIGS. 12A and 12B are diagrams each showing an SOI substrate of the present invention.
Figure 12B:
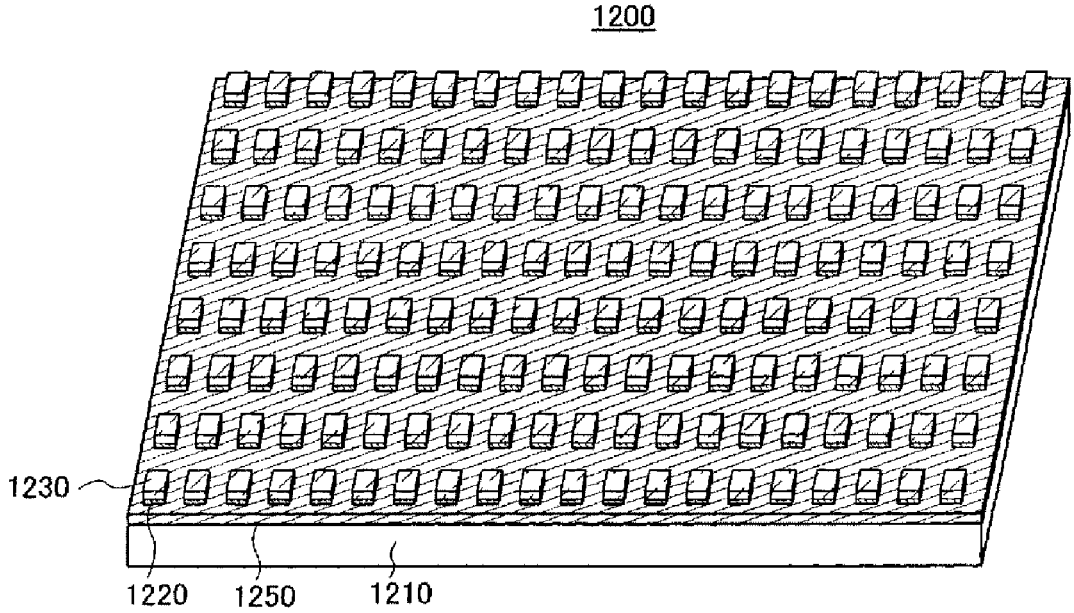

In FIGS. 12A and 12B, perspective-view diagrams of SOI substrates used in the present invention are shown. Furthermore, in FIGS. 13A and 13B and FIGS. 14A and 14B, cross-sectional-view diagrams of SOI substrates used in the present invention are shown.

Figure 13A:
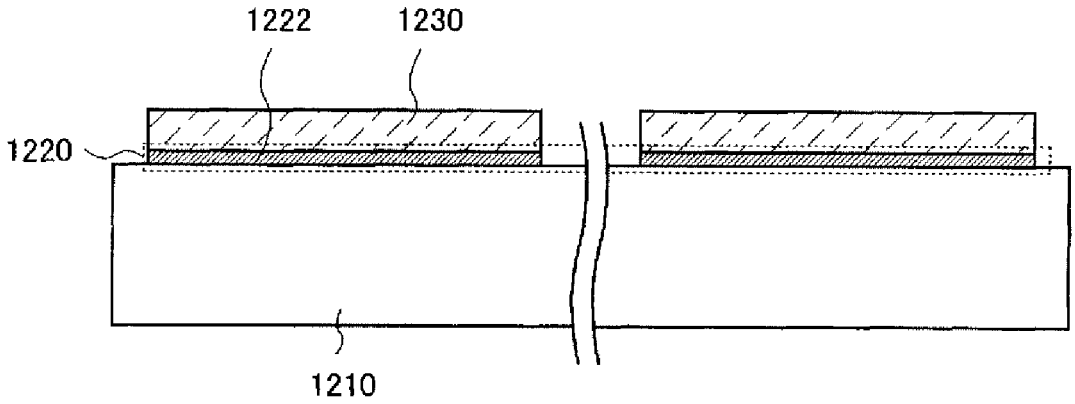
FIGS. 13A and 13B are diagrams each showing an SOI substrate of the present invention.
Figure 13B:
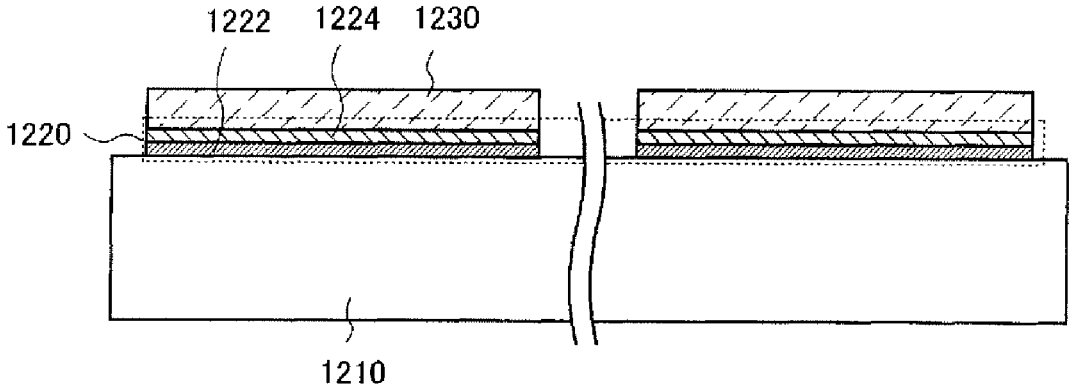

In each of FIG. 12A and FIGS. 13A and 13B, an SOI substrate 1200 has a structure in which a plurality of stacked-layer bodies, in each of which an insulating layer 1220 and an SOI layer 1230 are stacked in the order given, are provided over one surface of a base substrate 1210. Each of the SOI layers 1230 is provided over the base substrate 1210 with one of the insulating layers 1220 interposed between each of the SOI layers and the base substrate 1210. That is, a plurality of SOI layers is provided over a single base substrate 1210 to form a single SOI substrate 1200. It is to be noted that, in FIGS. 13A and 13B, for sake of simplicity, only two of the SOI layers 1230 are shown.

The SOI layer 1230 is a single-crystal semiconductor, and typically, single-crystal silicon is employed therein. In addition to a single-crystal silicon layer, a crystalline semiconductor layer of silicon, germanium, or the like; a compound semiconductor of gallium arsenic, indium phosphide, or the like; or the like that can be separated from a single-crystal semiconductor substrate or polycrystalline semiconductor substrate using a hydrogen ion implantation separation method or the like can be applied, as well.

There are no particular limitations on the shape of the SOI layer 1230; however, setting the shape of the SOI layer 1230 to be rectangular (including a square shape) is preferable because processing is made easier and the SOI layer 1230 can be attached to the base substrate 1210 with a favorable degree of integration if the SOI layer 1230 is rectangular. Furthermore, if the SOI substrate 1200 is set to be a panel of a display device or the like, it is preferable that the aspect ratio of the SOI layer 1230 be set so as to be 4:3. By the SOI layer 1230 being set to have a size approximately equal to a desired panel size, in manufacture of different types of liquid crystal display devices in which display panels manufactured using completed SOI substrates are combined, the incurrence of damage by elements can be prevented. Consequently, an improvement in yield can be achieved. Furthermore, by the SOI layer 1230 being set to have a size approximately equal to a desired panel size, elements for each panel can be formed of a single SOI layer, and the amount of variation in characteristics can be suppressed.

For the base substrate 1210, a substrate that has an insulating surface or an insulating substrate is used. Specifically, a glass substrate of any of different types of glass used in the electronics industry, such as aluminosilicate glass, aluminoborosilicate glass, barium borosilicate glass, or the like; a quartz substrate; a ceramic substrate; and a sapphire substrate can be given as examples. Preferably, a glass substrate is used, and for example, a mother glass substrate with a large area referred to as sixth-generation (1500 mm×1850 mm), seventh-generation (1870 mm×2200 mm), or eighth-generation (2200 mm×2400 mm) can be used. By use of a mother glass substrate with a large area for the base substrate 1210, increasing the area of an SOI substrate can be realized. Moreover, by each of the individual SOI layers 1230 being set to have a size equal to a desired panel size, the number of display panels (the number of chamfers) that can be fabricated using a single base substrate can be increased. As a consequence, productivity of final products (display devices) into which the display panels are incorporated can be increased.

The insulating layers 1220 are each provided between the base substrate and each of the SOI layers 1230. The insulating layer 1220 may be set to have a single-layer structure or a stacked-layer structure, and the surface (hereinafter referred to as a bonding surface) of the insulating layer 1220 that comes into contact with the base substrate 1210 is set to be a hydrophilic surface that is smooth. In FIG. 13A, an example is shown in which a bonding layer 1222 is formed for the insulating layer 1220. A silicon oxide layer is suitable for use as the bonding layer 1222 that can be formed of a hydrophilic surface that is smooth. In particular, use of a silicon oxide layer that is fabricated by a chemical vapor deposition method using an organic silane is preferable. For the organic silane, an organic compound that contains silicon such as tetraethoxysilane (abbreviated designation: TEOS, chemical formula: $Si(OC_2H_5)_4$), tetramethylsilane (TMS, chemical formula: $Si(CH_3)_4$), trimethylsilane ($(CH_3)_3SiH$), tetramethylcyclotetrasiloxane (TMCTS), octamethylcyclotetrasiloxane (OMCTS), hexamethyldisilazane (HMDS), triethoxysilane ($SiH(OC_2H_5)_3$), tris dimethyl aminosilane ($SiH(N(CH_3)_2)_3$), or the like can be used.

It is preferable that the bonding layer 1222 that is formed of a hydrophilic surface that is smooth be formed at a film thickness in a range of from 5 nm to 500 nm. By the film thickness of the bonding layer 1222 being set to be within the range given, along with surface roughness of a surface that is to be formed being planarized. smoothness of the surface of the film that is growing can be secured. In addition, the amount of distortion within a substrate (in FIG. 13A, the base substrate 1210) to which the film is to be bonded can be reduced. It is to be noted that a silicon oxide layer such as that of the bonding substrate 1222 may be provided for the base substrate 1210, as well. In bonding of the SOI layer 1230 to the base substrate 1210, which is a substrate that has an insulating surface or is an insulating substrate, by provision of a bonding layer that is preferably made up of a silicon oxide layer formed using an organic silane as a source material over one or both of the surfaces that are to be bonded together, a strong bond can be formed.

In FIG. 13B, an example in which the insulating layer 1220 is set to have a stacked-layer structure is shown. Specifically, an example is shown in which the insulating layer 1220 is formed of a stacked-layer structure of the bonding layer 1222 and an insulating layer 1224 that contains nitrogen. It is to be noted that, because the bonding layer 1222 is set so as to be formed over the surface to which the base substrate 1210 is to be bonded, the structure is set to be one in which the insulating layer 1224 is provided between the SOI layer 1230 and the bonding layer 1222. The insulating layer 1224 that contains nitrogen is formed of a single-layer structure or stacked-layer structure using any of a silicon nitride layer, a silicon nitride oxide layer, and a silicon oxynitride layer. For example, a silicon oxynitride layer and a silicon nitride oxide layer can be stacked together from the SOI layer 1230 side and set to be the insulating layer 1224 that contains nitrogen. While the bonding layer 1222 is formed to be bonded to the base substrate 1210, the insulating layer 1224 that contains nitrogen is formed to prevent impurities such as mobile ions, moisture, and the like from being diffused into and contaminating the SOI layer 1230.

It is to be noted that "silicon oxynitride layer" refers to a layer in which, for composition, the amount of oxygen contained therein is greater than the amount of nitrogen and, for concentration ranges, oxygen is contained at a range of greater than or equal to 50 at. % and less than or equal to 70 at. %; nitrogen, a range of greater than or equal to 0.5 at. % and less than or equal to 15 at. %; silicon, a range of greater than or equal to 25 at. % and less than or equal to 35 at. %; and hydrogen, a range of greater than or equal to 0.1 at. % and less than or equal to 10 at. %. Furthermore, "silicon nitride oxide layer" refers to a layer in which, for composition, the amount of nitrogen contained therein is greater than the amount of oxygen and, for concentration ranges, oxygen is contained at a range of greater than or equal to 5 at. % and less than or equal to 30 at. %; nitrogen, a range of greater than or equal to 20 at. % and less than or equal to 55 at. %; silicon, a range of greater than or equal to 25 at. % and less than or equal to 35 at. %; and hydrogen, a range of greater than or equal to 10 at. % and less than or equal to 25 at. %. The aforementioned ranges are ranges for cases measured using Rutherford backscattering spectrometry (RBS) and hydrogen forward scattering (HFS). Moreover, the total for the content ratio of the constituent elements is taken to be a value that does not exceed 100 at. %.

Figure 14A:
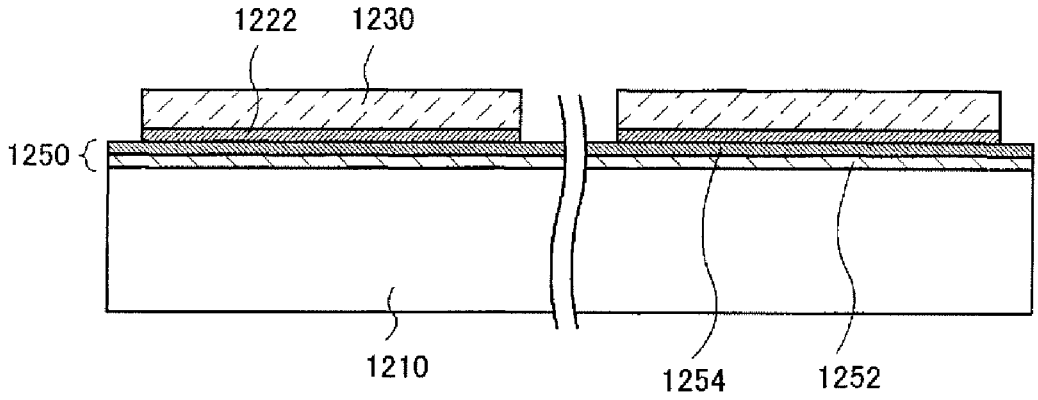
FIGS. 14A and 14B are diagrams each showing an SOI substrate of the present invention.
Figure 14B:
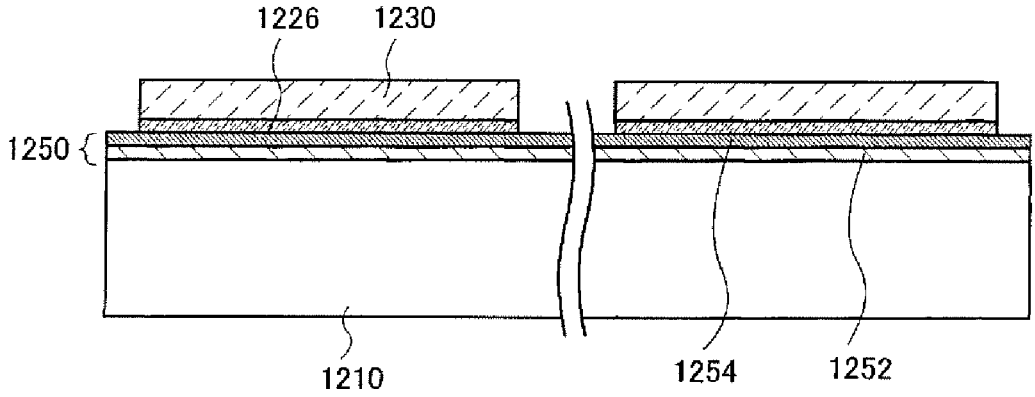

FIG. 12B and FIGS. 14A and 14B show examples in which an insulating layer 1250 that includes a bonding layer is formed over the base substrate 1210. The insulating layer 1250 may be formed as a single-layer structure or a stacked-layer structure, and the surface of the insulating layer 1250 that comes into contact with the SOI layer 1230 is formed so as to be a hydrophilic surface that is smooth. It is to be noted that it is preferable that a barrier layer used to prevent the diffusion of mobile ions of an alkali metal, alkaline earth metal, or the like from a glass substrate that is used as the base substrate 1210 be provided between the base substrate 1210 and the bonding layer.

In FIG. 14A, an example is shown in which a stacked-layer structure of the barrier layer 1252 and a bonding layer 1254 is formed for the insulating layer 1250. For the bonding layer 1254, the same kind of silicon oxide layer as for the bonding layer 1222 may be provided. Alternatively, a bonding layer appropriate to the SOI layer 1230 may be provided, as well. In FIG. 14A, an example is shown in which the bonding layer 1222 is provided over the SOI layer 1230 as well. By the structure being set to be this kind of structure, because a bond is formed by bonding layer to bonding layer in bonding of the base substrate 1210 and the SOI layer 1230, an even stronger bond can be formed. The barrier layer 1252 is formed as a single-layer structure or stacked-layer structure using any of a silicon oxide layer, a silicon nitride layer, a silicon oxynitride layer, and a silicon nitride oxide layer. Preferably, the barrier layer 1252 is formed using an insulating layer that contains nitrogen.

In FIG. 14B, an example is shown in which a bonding layer is provided over the base substrate 1210. Specifically, a stacked-layer structure of the barrier layer 1252 and the bonding layer 1254 are provided over the substrate 1210 as the insulating layer 1250. Furthermore, a silicon oxide layer 1226 is provided over the SOI layer 1230. In bonding of the SOI layer 1230 to the base substrate 1210, the silicon oxide layer 1226 forms a bond with the bonding layer 1254. It is preferable that the silicon oxide layer 1226 be formed by a thermal oxidation method. Furthermore, a chemical oxide can also be applied for the silicon oxide layer 1226. A chemical oxide can be formed, for example, by treatment of a surface of a semiconductor substrate with water that contains ozone. Use of a chemical oxide is favorable because chemical oxides are formed reflecting the planarity of the surface of the semiconductor substrate.

Next, a fabrication method of an SOI substrate will be described. Here, an example of a fabrication method of the SOI substrate shown in FIG. 13A will be described using FIGS. 15A and 15B, FIGS. 16A and 16B, and FIGS. 17A to 17C.

Figure 15A:
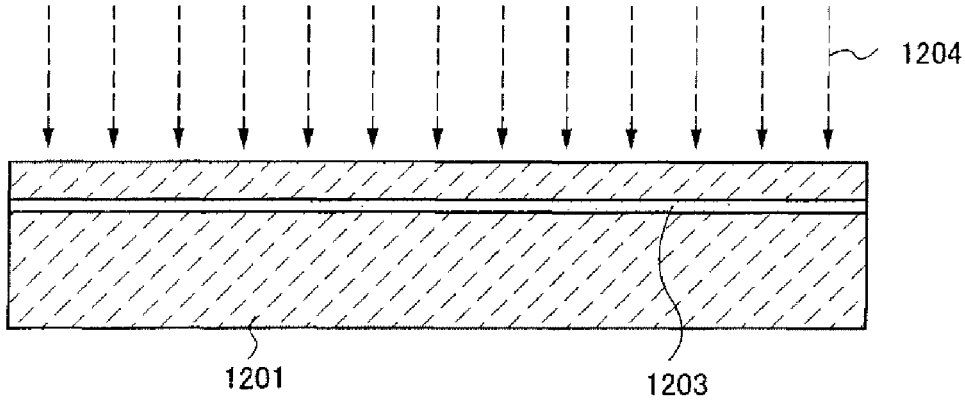
FIGS. 15A to 15C are diagrams used to illustrate a fabrication process of an SOI substrate of the present invention.
Figure 17A:
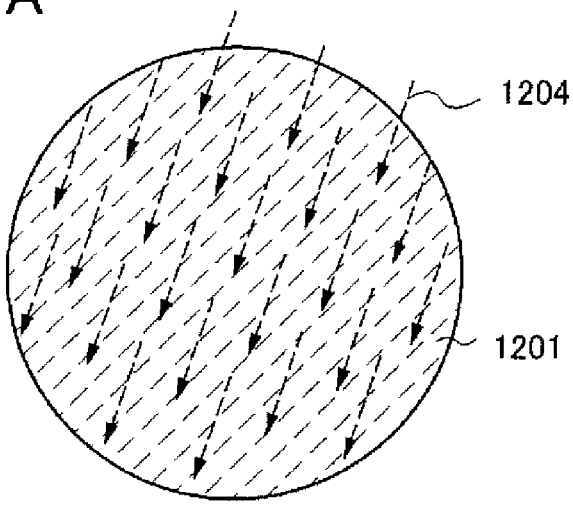
FIGS. 17A to 17C are diagrams used to illustrate a fabrication process of an SOI substrate of the present invention.

First, a semiconductor substrate 1201 is prepared (FIG. 15A and FIG. 17A). For the semiconductor substrate 1201, a commercially available semiconductor substrate may be used, and for example, a silicon substrate; a germanium substrate, a compound semiconductor substrate of gallium arsenide, indium phosphide, or the like; and the like can be given. For a commercially available silicon substrate, a substrate with a size of a diameter of 5 inches (125 millimeters), a diameter of 6 inches (150 millimeters), a diameter of 8 inches (200 millimeters), or a diameter of 12 inches (300 millimeters) is typical, and the shape of the substrate is often round. In addition, a film thickness of up to approximately 1.5 mm can be selected as appropriate.

Next, ions 1204 accelerated by an electric field are implanted into the semiconductor substrate 1201 at a given depth from the surface of the semiconductor substrate 1201, whereby an ion doping layer 1203 is formed (FIG. 15A and FIG. 17A). Implantation of the ions 1204 is performed in consideration of the film thickness of an SOI layer that is to be transferred to a base substrate during a subsequent step. Preferably, the film thickness of the SOI layer is set so as to be a thickness of from 5 nm to 500 nm, more preferably, a thickness of from 10 nm to 200 nm. The acceleration voltage and ion dose amount are selected as appropriate in consideration of the film thickness of the SOI layer that is to be transferred. For the ions 1204, ions of hydrogen; helium; or a halogen such as fluorine or the like can be used. It is to be noted that, for the ions 1204, use of ion species of a single type of atom or made from a plurality of the same type of atom generated by plasma excitation of a source gas selected from hydrogen, helium, or a halogen element is preferable. Cases of implantation of hydrogen ions are preferable because, along with $H^+$, $H_2^+$, and $H_3^+$ ions being included, when the proportion of the number of $H_3^+$ ions is increased, implantation efficiency of ions can be increased and the length of time for implantation can be shortened. Furthermore, by the structure being set to be this kind of structure, separation can be performed easily.

It is to be noted that, in order to form the ion doping layer 1203 at the given depth, there are cases in which implantation of the ions 1204 under conditions of high dosing becomes necessary. In these cases, the surface of the semiconductor substrate 1201 may be roughened depending on the conditions. For this reason, a silicon nitride layer, a silicon nitride oxide layer, or the like may be provided at a film thickness within the range of from 50 nm to 200 nm over the surface of the semiconductor substrate into which the ions are to be implanted as a protective layer.

Figure 15B:
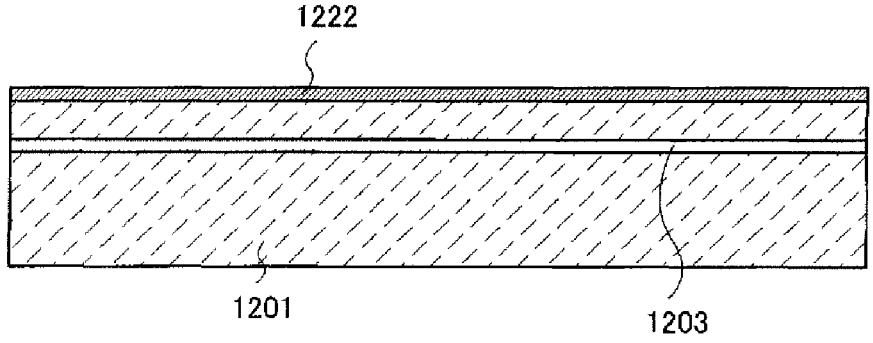
Figure 17B:
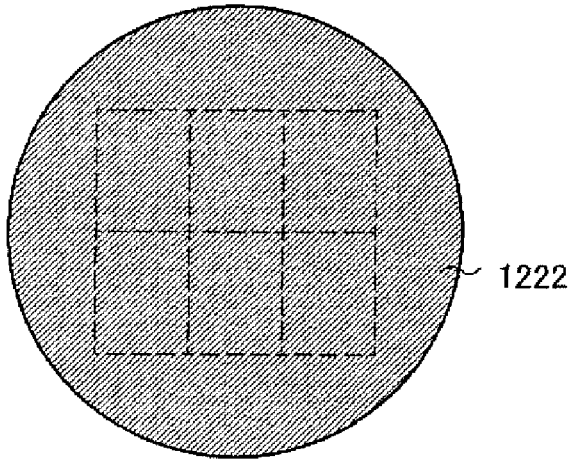

Next, the bonding layer 1222 is formed over the semiconductor substrate 1201 (FIG. 15B and FIG. 17B). The bonding layer 1222 is formed over the surface of the semiconductor substrate 1201 that is to form a bond with the base substrate. For the bonding layer 1222 formed here, use of a silicon oxide layer formed by film formation by a chemical vapor deposition method using an organic silane as a source gas as described above is preferable. In addition, a silicon oxide layer formed by film formation by a chemical vapor deposition method in which a silane is used as a source gas can be applied, as well. In the film formation by a chemical vapor deposition method, temperatures of a degree at which degassing from the ion doping layer 1203 formed over the semiconductor substrate 1201 does not occur are applied. For example, a film formation temperature of 350° C. or less is applied. It is to be noted that, for thermal treatment in separation of an SOI layer from a semiconductor substrate such as a single-crystal semiconductor substrate, a polycrystalline semiconductor substrate, or the like, a thermal treatment temperature that is higher than the film formation temperature in a chemical vapor deposition method is applied.

Figure 15C:
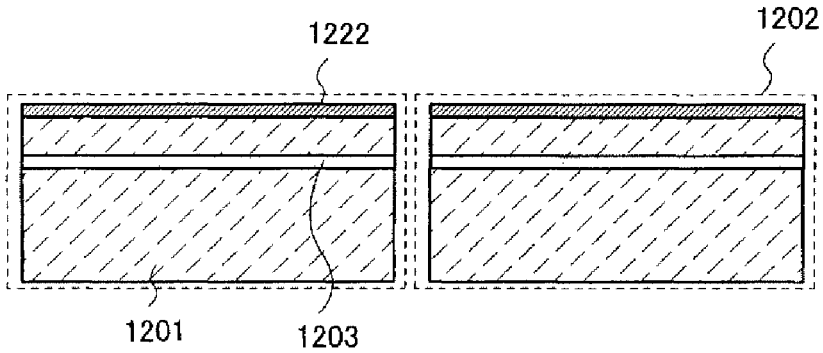
Figure 17C:
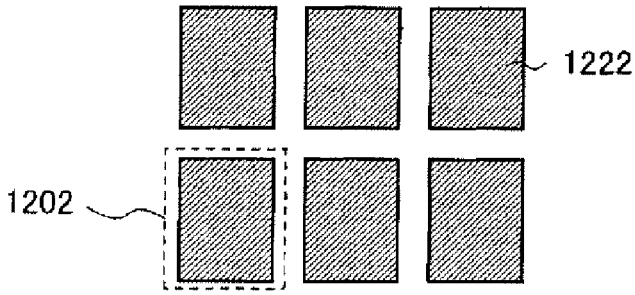

Next, the semiconductor substrate 1201 is processed into a desired size and shape (FIG. 15C and FIG. 17C). In FIG. 17C, an example is shown in which a round semiconductor substrate 1201 is divided up and rectangular semiconductor substrates 1202 are formed. In this case, the bonding layer 1222 and the ion doping layer 1203 are also divided up. That is, the semiconductor substrates 1202 that each have a desired size and shape, in each of which is formed the ion doping layer 1203 at a given depth and over a surface (the surface that is to be bonded to the base substrate) of each of which is formed the bonding layer 1222, are obtained.

It is preferable that the size of the semiconductor substrate 1202 be set to be a panel size of a display device. The panel size may be selected based on the combined final product and the like. For example, when the semiconductor substrate 1202 is to be applied to a cellular phone with a screen size of 2.4 inches along the diagonal, the panel size is set in consideration of a screen frame size for a screen size of 2.4 inches along the diagonal. The shape of the semiconductor substrate 1202 may also be selected as appropriate based on intended usage of the final product and the like, however, when the semiconductor substrate 1202 is applied to a display device of a display or the like, it is preferable that the shape of the semiconductor substrate 1202 be set to be a rectangle with an aspect ratio of about 3:4. Moreover, the shape of the semiconductor substrate 1202 being set to be rectangular is preferable because processing during a subsequent fabrication step comes to be performed more easily and, furthermore, the semiconductor substrate 1202 can be cut out from the semiconductor substrate 1201 efficiently, as well. Division of the semiconductor substrate 1201 can be performed using a cutting apparatus such as a dicer, a wire saw, or the like or by laser cutting, plasma cutting, or electron beam cutting or any other given cutting means It is to be noted that the order of steps up through the step for formation of a bonding layer over a surface of a semiconductor substrate can be switched around as appropriate. In FIGS. 15A and 15B and FIGS. 17A to 17C, an example is shown in which, after an ion doping layer is formed in a semiconductor substrate and a bonding layer is formed over a surface of the semiconductor substrate, the semiconductor substrate is processed into a desired panel size. However, another process can be used, for example, a process in which, after a semiconductor substrate is processed into a desired panel size, an ion doping layer is formed in the semiconductor substrate that has been processed into a desired panel size and a bonding layer is formed over the surface of the semiconductor substrate of the desired panel size.

Figure 16A:
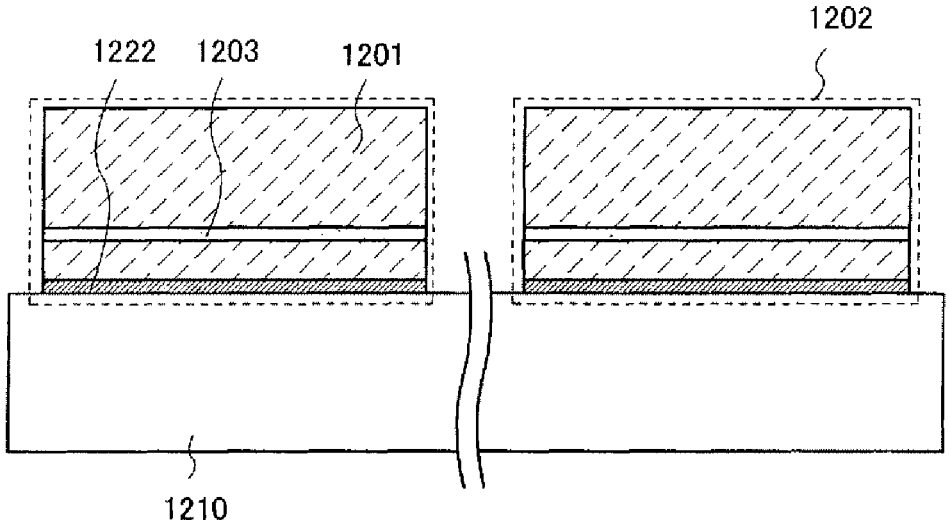
FIGS. 16A and 16B are diagrams used to illustrate a fabrication process of an SOI substrate of the present invention.

Next, the base substrate 1210 and the semiconductor substrate 1202 are bonded together. In FIG. 16A, an example is shown in which the base substrate 1210 and a surface formed by the bonding layer 1222 of the semiconductor substrate 1202 are placed in contact with each other, and the base substrate 1222 and the bonding layer 1222 are bonded together, whereby the semiconductor substrate 1202 is attached to the base substrate 1210. It is to be noted that it is preferable that the surfaces (bonding surfaces) over which the bond is to be formed be sufficiently cleaned. By the base substrate 1210 and the bonding layer 1222 being placed in contact with each other, a bond is formed. Van der Waals forces are acting in this bond, and by pressure being applied to the base substrate 1210 and the semiconductor substrate 1202, a strong bond can be formed by hydrogen bonds.

In addition, in order to form a favorable bond between the base substrate 1210 and the bonding layer 1222, the bonding surfaces may be activated. For example, one or both of the surfaces by which the bond is formed are irradiated with an atom beam or an ion beam. When an atom beam or an ion beam is used, a neutral atom beam of an inert gas of argon or the like or an ion beam of an inert gas can be used. In addition, the bonding surfaces may be activated by performance of plasma irradiation or radical treatment. By this kind of surface treatment, formation of bonds between different kinds of materials even at temperatures of 400° C. or less becomes easy to perform.

Moreover, it is preferable that heat treatment or pressure treatment be performed after the base substrate 1210 and the semiconductor substrate 1202 are bonded together with the bonding layer 1222 interposed therebetween. By performance of heat treatment or pressure treatment, bonding strength can be increased. It is preferable that the temperature for heat treatment be a temperature lower than or equal to the upper temperature limit of the base substrate 1210. Pressure treatment is performed such that pressure is applied in a direction perpendicular to the bonding surfaces, in consideration of the resistance to pressure of the base substrate 1210 and the semiconductor substrate 1202.

Figure 16B:
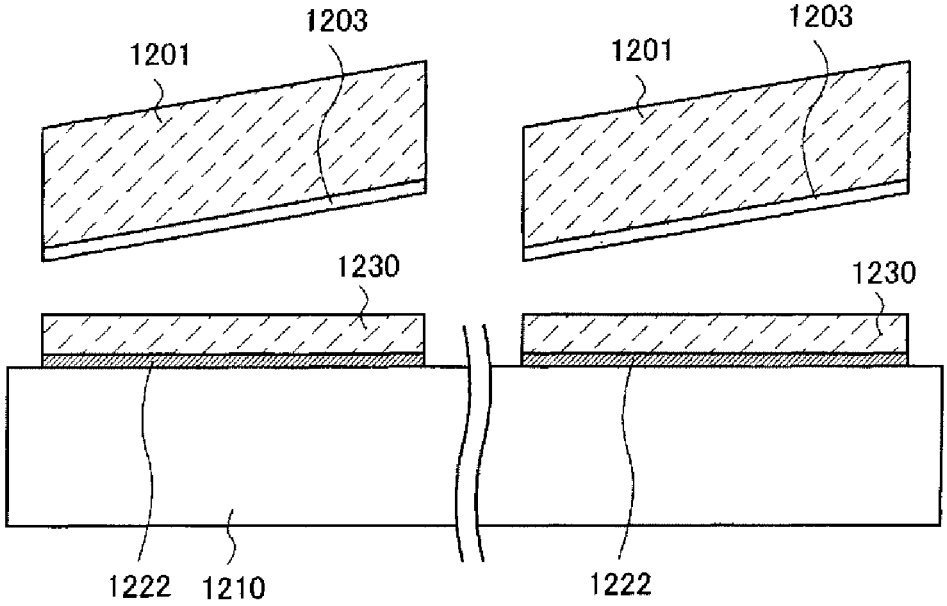

Next, heat treatment is performed, and a part of the substrate 1202 is separated from the base substrate 1210 using the ion doping layer 1203 as a cleavage plane (FIG. 16B). It is preferable that heat treatment be performed at a temperature higher than or equal to the temperature for film formation of the bonding layer 1222 and lower than or equal to the upper temperature limit of the base substrate 1210. For example, by performance of heat treatment at a temperature of from 400° C. to 600° C., changes in the volume of minute cavities formed in the ion doping layer 1203 occur, and cleavage along the ion doping layer 1203 becomes possible. Because the bonding layer 1222 is bonded to the base substrate 1210, the SOI layer 1230 that has the same crystallinity as the semiconductor substrate 1202 comes to be left remaining over the base substrate 1210.

By the above process, an SOI structure in which the SOI layer 1230 is provided over the base substrate 1210 with the bonding layer 1222 interposed therebetween is formed. It is to be noted that the SOI substrate described in the present embodiment mode is a structure in which a plurality of SOI substrates are provided over a single base substrate with bonding layers interposed between each of the SOI substrates and the base substrate; however, the SOI substrate of the present invention is not limited to having this structure.

It is to be noted that it is preferable that the surface of the SOI layer obtained by separation be polished by chemical mechanical polishing (CMP) so as to be planarized. Moreover, the surface of the SOI layer may be planarized by irradiation of the surface with a laser beam without any use of a physical polishing means such as CMP or the like. It is to be noted that it is preferable that irradiation by laser beam be performed under a nitrogen atmosphere that contains oxygen at a concentration of 10 ppm or less. This is because the surface of the SOI layer may be made rough when irradiation by laser beam is performed under an oxygen atmosphere. In addition, CMP or the like may be performed in order to thin the obtained SOI layer, as well.

Figure 18A:
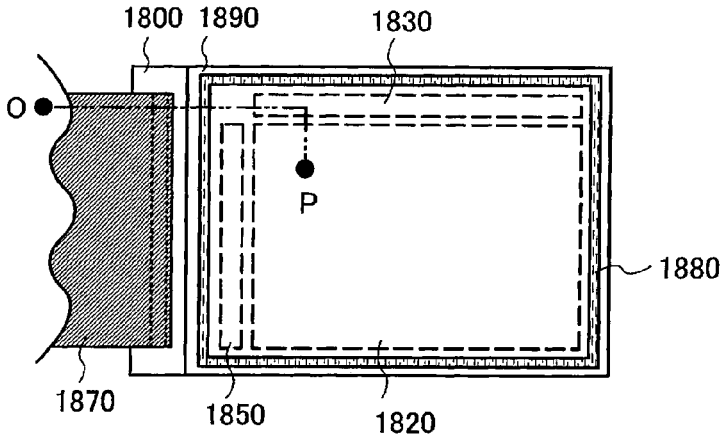
FIGS. 18A to 18C are diagrams showing a liquid crystal display device of the present invention.

A liquid crystal display device in which the SOI substrate fabricated as described above is used can be fabricated. FIG. 18A is a top-view schematic diagram, FIG. 18B is a cross-sectional-view diagram taken along a line OP of FIG. 18A, and FIG. 18C is a perspective-view diagram of the liquid crystal display device.

A liquid crystal display device of the present embodiment mode has a display section 1820, a first driver circuit section 1830, and a second driver circuit section 1850 provided over a first substrate 1800. The display section 1820, the first driver circuit section 1830, and the second driver circuit section 1850 are sealed in between the first substrate 1800 and a second substrate 1890 by a sealant 1880. Furthermore, a terminal region 1870 that is connected to an external input terminal that transmits a signal from external to the first driver circuit section 1830 and the second driver circuit section 1850 is provided over the first substrate 1800.

Figure 18B:
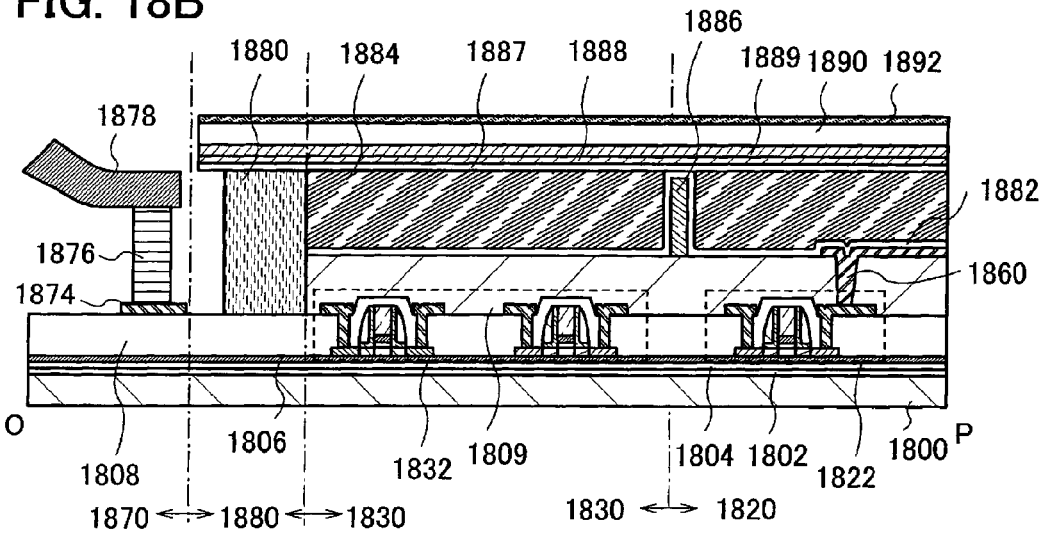
Figure 18C:
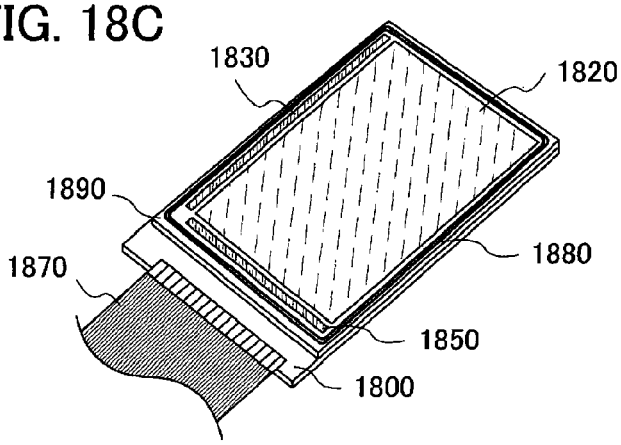

As shown in FIG. 18B, a pixel circuit section 1828 that has a transistor is provided in the display section 1820. Furthermore, a peripheral circuit section 1838 that has a transistor is provided in the first driver circuit section 1830. Interposed between the first substrate 1800 and the pixel circuit section 1828 and peripheral circuit section 1838, an insulating layer 1802 and an insulating layer 1804 that each function as a base insulating layer and a bonding layer 1806 are stacked together in the order given. In the pixel circuit section 1828 and peripheral circuit section 1838 or as upper layers thereover, an insulating layer 1808 and an insulating layer 1809 that each function as a base insulating layer are provided. A source electrode or drain electrode of the transistor formed in the pixel circuit section 1828 is electrically connected to a pixel electrode 1860 through an opening formed in the insulating layer 1809. It is to be noted that a circuit in which transistors are used is integrated into the pixel circuit section 1828; however, here, for sake of simplicity, a cross-sectional-view diagram of only one transistor is shown. In the same way, a circuit in which transistors are used is integrated into the peripheral circuit section 1838; however, for sake of simplicity, a cross-sectional-view diagram of only two transistors is shown.

Over the pixel circuit section 1828 and peripheral circuit section 1838, an alignment film 1882 formed so as to cover the pixel electrode 1860, an alignment film 1887, and a liquid crystal layer 1884 that is interposed between the alignment film 1882 and the alignment film 1887 are provided. For the liquid crystal layer 1884, the distance (cell gap) is controlled by a spacer 1886. Over the alignment film 1887, a second substrate 1890 is provided with a counter electrode 1888 and a color filter 1889 interposed between the alignment film 1887 and the second substrate 1890. The first substrate 1800 and the second substrate 1890 are fixed in place by the sealant 1880.

Moreover, a polarizing plate 1892 is placed over the outer side of the second substrate 1890. It is to be noted that, in the present embodiment mode, because a reflective liquid crystal display device is shown, an example is given in which the polarizing plate 1892 is provided over the second substrate 1890. For example, when the liquid crystal display device is set to be a transmissive liquid crystal display device, polarizing plates may be provided over both the first substrate 1800 and the second substrate 1890.

Furthermore, a terminal electrode 1874 is provided in the terminal region 1870. The terminal electrode 1874 is electrically connected to an external input terminal 1878 through an anisotropic conductive layer 1876.

Next, an example of a fabrication method of the liquid crystal display device shown in FIGS. 18A to 18C will be described.

Figures 19A, 19B, 19C, 19D:
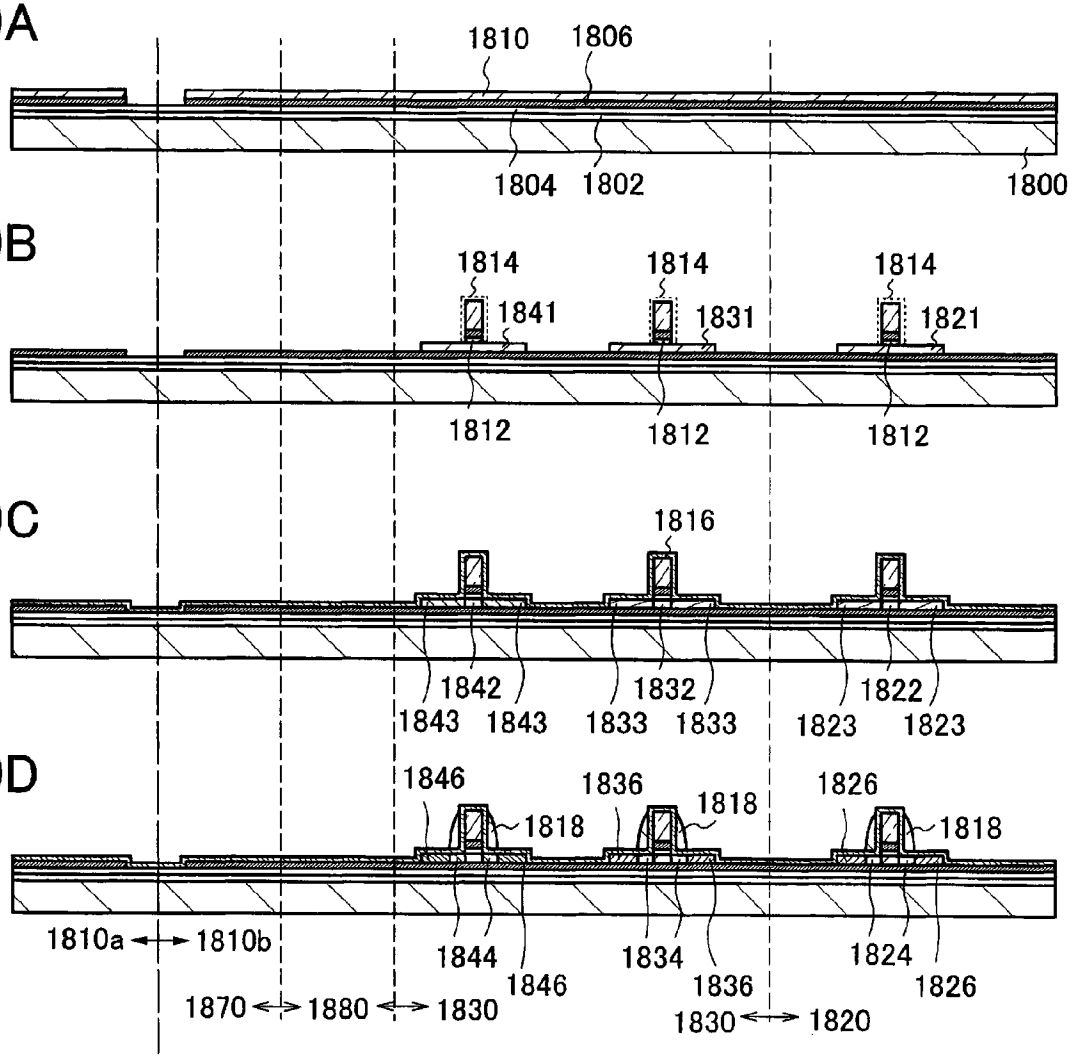
FIGS. 19A to 19D are diagrams used to illustrate a fabrication process of a liquid crystal display device of the present invention.

First, an SOI substrate is prepared (FIG. 19A). Here, an example is shown in which an SOI substrate like the one shown in FIG. 13A is applied.

Over the substrate 1800, which is a base substrate, a plurality of SOI layers 1810 are provided with the insulating layer 1802, the insulating layer 1804, and the bonding layer 1806 provided between the substrate 1800 and each of the plurality of SOI layers 1810. Each of the SOI layers 1810 is processed into a desired panel size. Here, for sake of simplicity, an example will be described in which a liquid crystal display device is fabricated using a panel formation region 1810*b* that includes only one SOI layer; however, the liquid crystal display device may be one in which adjacent panel formation regions 1810*a* are fabricated simultaneously, as well.

For the substrate 1800, a substrate that has an insulating surface or an insulating substrate is used. For example, a glass substrate of any of different types of glass used in the electronics industry, such as aluminosilicate glass, aluminoborosilicate glass, barium borosilicate glass, and the like, a quartz substrate; a ceramic substrate; a sapphire substrate, or the like can be used. Here, a glass substrate is set to be used.

The insulating layer 1802 and the insulating layer 1804 are provided in order to prevent the diffusion of mobile ions of an alkali metal, an alkaline earth metal, and the like from a glass substrate. Specifically, insulating layers that are the same as the barrier layer described above may be provided. It is to be noted that it is preferable that an insulating layer that contains nitrogen, such as a silicon nitride layer or a silicon nitride oxide layer, be provided for at least one of the insulating layer 1802 and the insulating layer 1804. In addition, a silicon oxide layer may be provided in the bonding layer 1806.

In the present embodiment mode, an example is shown in which, after the insulating layer 1802 and the insulating layer 1804 are formed over the substrate 1800, the bonding layer 1806 is formed on the semiconductor substrate side at which separation of the SOI layer is performed, and the substrate 1800 and the semiconductor substrate are bonded together, part of the semiconductor substrate is separated from the rest of the semiconductor substrate to form an SOI layer 1810. Specifically, a surface formed by the insulating layer 1804 of the substrate 1800 and a surface formed by the bonding layer 1806 of the semiconductor substrate are placed in contact with each other, the insulating layer 1804 and the bonding layer 1806 are bonded to each other, and the substrate 1800 and the semiconductor substrate are attached to each other. Ions of hydrogen, helium, or a halogen are implanted into the semiconductor substrate to form an ion doping layer Then, heat treatment is performed, part of the semiconductor substrate is separated from the rest of the semiconductor substrate using the ion doping layer formed in the semiconductor substrate as a cleavage plane, and the SOI layer 1810 is obtained. Here, because the bonding layer 1806 is formed on the semiconductor substrate side, the bonding layer 1806 comes to be the same size approximately as the SOI layer 1810. That is, the bonding layer 1806 is divided at the interface between the adjacent panel formation region 1810*a* and panel formation region 1810*b* in the same way as the SOI layer 1810. Furthermore, because the insulating layer 1802 and the insulating layer 1804 are formed over the substrate 1800, which is a base substrate, the insulating layer 1802 and the insulating layer 1804 form a continuous layer across the adjacent panel formation region 1810*a* and panel formation region 1810*b*. It is to be noted that there are no particular limitations on the SOI substrate that is to be applied, and any of the structures of FIGS. 13A and 13B and FIGS. 14A and 14B described above may be applied. For example, a bonding layer may be formed on the base substrate side, and an insulating layer of a thermally oxidized film or the like may be provided between the semiconductor substrate and the bonding layer.

Next, the SOI layer 1810 is etched as selected, whereby a first SOI layer 1821 is formed in the display section 1820. Furthermore, a second SOI layer 1831 and a third SOI layer 1841 are formed in the first driver circuit section 1830. Then, gate electrodes 1814 are formed over each of the first SOI layer 1821, the second SOI layer 1831, and the third SOI layer 1841 with gate insulating layers 1812 interposed between the gate electrodes 1814 and the first SOI layer 1821, the second SOI layer 1831, and the third SOI layer 1841 (FIG. 19B).

The first SOI layer 1821, the second SOI layer 1831, and the third SOI layer 1841 are processed into desired shapes by selective etching of the SOI layer 1810. Here, the SOI layer 1810 is processed into a plurality of island shapes and divided up. When it is desired that the film thickness of each of the first SOI layer 1821, the second SOI layer 1831, and the third SOI layer 1841 be thinner than that of the SOI layer of the prepared SOI substrate, the SOI layer may be etched and made to be thin. Moreover, the quality of a part of the SOI layer may be changed, and the part of the SOI layer of which the quality has been changed may then be etched as selected and made to be thin, as well. Here, the change in the quality of the SOI layer refers to, for example, performance of oxidation, nitridation, or the like. In addition, by control of etching conditions and the like, as appropriate, the ends of each of the first SOI layer 1821, the second SOI layer 1831, and the third SOI layer 1841 may be formed so as to be nearly perpendicular tapered shapes or so as to be gently sloping tapered shapes. For example, the ends of each of the first SOI layer 1821, the second SOI layer 1831, and the third SOI layer 1841 may be formed into shapes so that the taper angle is greater than or equal to 45° and less than 95°, preferably, greater than or equal to 60° and less than 95°, or into gradually sloping shapes so that the taper angle is less than or equal to 45°.

It is to be noted that, in order to control threshold voltage of a completed transistor, an impurity element imparting one type of conductivity at low concentration may be added to the first SOI layer 1821, the second SOI layer 1831, and the third SOI layer 1841. In this case, the impurity element is also added to the channel formation region of the transistor, as well. It is to be noted that the impurity element that is added here is added at a lower concentration than the concentration of a high-concentration impurity region that functions as a source region or a drain region and a low-concentration impurity region that functions as a LDD region.

For the gate electrodes 1814, after a conductive layer is formed over the entire surface of the substrate, the conductive layer is etched as selected and processed into desired shapes. Here, after a stacked-layer structure of the conductive layer is formed for the gate electrodes 1814, the conductive layer is etched as selected, and the separated conductive layers are processed so as to cross over each of the first SOI layer 1821,the second SOI layer 1831, and the third SOI layer 1841.

The conductive layers forming the gate electrodes 1814 can be formed such that, after a conductive layer is formed over the entire surface of the substrate using a metal element such as tantalum (Ta), tungsten (W), titanium (Ti), molybdenum (Mo), chromium (Cr), aluminum (Al), copper (Cu), niobium (Nb), or the like or an alloy material or a compound material containing one or more of these metal elements by a CVD method or a sputtering method, the conductive layer is etched as selected to form the conductive layers forming the gate electrodes 1814. In addition, the conductive layers forming the gate electrodes 1814 can be formed using a semiconductor material typified by polycrystalline silicon to which is added an impurity element such as phosphorus or the like that imparts one type of conductivity.

It is to be noted that, here, an example is shown in which the gate electrodes 1814 are each formed of a stacked-layer structure of conductive layers of two layers; however, the gate electrodes may each have a single-layer structure or a stacked-layer structure of three or more layers. In addition, side surfaces of the conductive layers may be set to each have a tapered shape. When the gate electrode is set to have a stacked-layer structure of conductive layers, the width of the bottom layer of the conductive layers may be increased and side surfaces of each layer may be set to have a taper shape of differing angles of taper.

The gate insulating layers 1812 are formed between the first SOI layer 1821, the second SOI layer 1831, and the third SOI layer 1841 and each of the gate electrodes 1814. The gate insulating layers 1812 are formed using a material such as silicon oxide, silicon oxynitride, hafnium oxide, aluminum oxide, tantalum oxide, or the like using a CVD method, a sputtering method, an ALD method, or the like. Furthermore, the gate insulating layers 1812 can be formed by solid-state oxidation or solid-state nitridation of the first SOI layer 1821, the second SOI layer 1831, and the third SOI layer 1841 by plasma treatment. Alternatively, the gate insulating layers 1812 may be formed such that, after an insulating layer is formed by a CVD method or the like, the insulating layer is oxidized by solid-state oxidation or nitrided by solid-state nitridation to form the gate insulating layers 1812.

It is to be noted that, in FIG. 19B, an example is shown in which side edges of each of the gate insulating layers 1812 and each of the gate electrodes 1814 are processed so as to match up; however, there are no particular limitations on the structures of the gate insulating layers 1812 and the gate electrodes 1814, and the gate insulating layers 1812 may be processed so as to be left remaining during etching of the gate electrodes 1814.

Furthermore, when a substance with a high dielectric constant (a substance referred to as a "high-k material") is used in the gate insulating layers 1812, the gate electrodes 1814 are formed of polycrystalline silicon, a silicide, a metal, or a metal nitride. Preferably, forming the gate electrodes 1814 of a metal or a metal nitride is desirable. For example, out of the conductive layers forming each of the gate electrodes 1814, the conductive layer that makes contact with the gate insulating layer 1812 is formed of a metal nitride material and upper conductive layers thereof are formed of a metal material. By use of this kind of combination, the widening of a depletion layer formed in the gate electrode can be prevented even when the gate insulating layer is made to be thin, and reduction of driving performance of the transistor can be prevented even when the transistor is miniaturized.

Next, an insulating layer 1816 is formed over the gate electrodes 1814. Then, an impurity element imparting one type of conductivity is added using the gate electrodes 1814 as masks (FIG. 19C). Here, an example is shown in which impurity elements imparting conductivity of different types are added to the second SOI layer 1831 and the third SOI layer 1841 that are formed in the first driver circuit section 1830. Furthermore, an example is shown in which an impurity element imparting the same type of conductivity as the impurity element added to the second SOI layer 1831 is added to the first SOI layer 1821 that is formed in the display section 1820.

In the first SOI layer 1821 that is formed in the display section 1820, a pair of impurity regions 1823 and a channel formation region 1822 placed between the pair of impurity regions 1823 are formed in a self-aligning manner using the gate electrode 1814 as a mask.

In the second SOI layer 1831 that is formed in the first driver circuit section 1830, a pair of impurity regions 1833 and a channel formation region 1832 placed between the pair of impurity regions 1833 are formed in a self-aligning manner using the gate electrode 1814 as a mask. In the third SOI layer 1841, a pair of impurity regions 1843 and a channel formation region 1842 placed between the pair of impurity regions 1843 are formed in a self-aligning manner using the gate electrode 1814 as a mask. Impurity elements imparting conductivity of different types are added to the impurity regions 1833 and the impurity regions 1843.

For an impurity element imparting one type of conductivity, an element imparting p-type conductivity such as boron (B), aluminum (Al), gallium (Ga), or the like or an element imparting n-type conductivity such as phosphorus (P), arsenic (As), or the like can be used. In the present embodiment mode, an element, for example, phosphorus, imparting n-type conductivity is added to the first SOI layer 1821 formed in the display section 1820 and to the second SOI layer 1831 formed in the first driver circuit section 1830. Moreover, an element, for example, boron, imparting p-type conductivity is added to the third SOI layer 1841. It is to be noted that, in addition of the impurity element to the first SOI layer 1821 and the second SOI layer 1831, the third SOI layer 1841 may be covered as selected using a resist mask or the like. Similarly, in addition of the impurity element to the third SOI layer 1841, the first SOI layer 1821 and the second SOI layer 1831 may be covered as selected using a resist mask or the like.

The insulating layer 1816 can be formed using a material such as silicon oxide, silicon oxynitride, silicon nitride, silicon nitride oxide, or the like using a CVD method, a sputtering method, an ALD method, or the like. In the addition of the impurity element that imparts one type of conductivity, by the configuration being set to be one in which the impurity element that imparts one type of conductivity is added by being passed through the insulating layer 1816, the amount of damage incurred by the SOI layer can be reduced.

Next, sidewall insulating layers 1818 are formed on side surfaces of the gate electrodes 1814. Then, the impurity element imparting one type of conductivity is added using the gate electrodes 1814 and the sidewall insulating layers 1818 as masks (FIG. 19D). It is to be noted that impurity elements of the same conductivities as those of the impurity elements added to the first SOI layer 1821, the second SOI layer 1831, and the third SOI layer 1841 during respective preceding steps (steps in which the impurity region 1823, the impurity region 1833, and the impurity region 1843 are formed). Furthermore, the impurity elements are added at concentrations higher than those of the impurity elements added during the preceding steps.

In the first SOI layer 1821, a pair of high-concentration impurity regions 1826 and a pair of low-concentration impurity regions 1824 are formed in a self-aligning manner using the gate electrode 1814 and the sidewall insulating layer 1818 as masks. Here, each of the high-concentration impurity regions 1826 that are formed functions as a source region or a drain region and the low-concentration impurity regions 1824 that are formed function as lightly doped drain (LDD) regions.

In the second SOI layer 1831, a pair of high-concentration impurity regions 1836 and a pair of low-concentration impurity regions 1834 are formed in a self-aligning manner using the gate electrode 1814 and the sidewall insulating layer 1818 as masks. Here, each of the high-concentration impurity regions 1836 that are formed functions as a source region or a drain region and the low-concentration impurity regions 1834 that are formed function as lightly doped drain (LDD) regions. In the third SOI layer 1841, a pair of high-concentration impurity regions 1846 and a pair of low-concentration impurity regions 1844 are formed in a self-aligning manner using the gate electrode 1814 and the sidewall insulating layer 1818 as masks. It is to be noted that, in addition of the impurity element to the first SOI layer 1821 and the second SOI layer 1831, the third SOI layer 1841 may be covered as selected using a resist mask or the like. Similarly, in addition of the impurity element to the third SOI layer 1841, the first SOI layer 1821 and the second SOI layer 1831 may be covered as selected using a resist mask or the like.

The sidewall insulating layers 1818 are provided on side surfaces of the gate electrodes 1814 with the insulating layer 1816 interposed between the sidewall insulating layers 1818 and the gate electrodes 1814. For example, by performance of anisotropic etching in a perpendicular direction of an insulating layer that is formed so that each of the gate electrodes 1814 is buried, the sidewall insulating layers 1818 can be formed on side surfaces of the gate electrodes 1814 in a self-aligning manner. The sidewall insulating layers 1818 can be formed using a material such as silicon nitride, silicon nitride oxide, silicon oxide, silicon oxynitride, or the like. It is to be noted that when the insulating layer 1816 is formed using silicon oxide or silicon oxynitride, the insulating layer 1816 can be made to function as an etching stopper when the sidewall insulating layers 1818 are formed using silicon nitride or silicon nitride oxide. In addition, when the insulating layer 1816 is formed using silicon nitride or silicon nitride oxide, the sidewall insulating layers 1818 may be formed using silicon oxide or silicon oxynitride. In this way, by provision of an insulating layer that can function as an etching stopper, etching of the SOI layer due to overetching in formation of the sidewall insulating layers can be prevented.

Figures 20A, 20B, 20C:
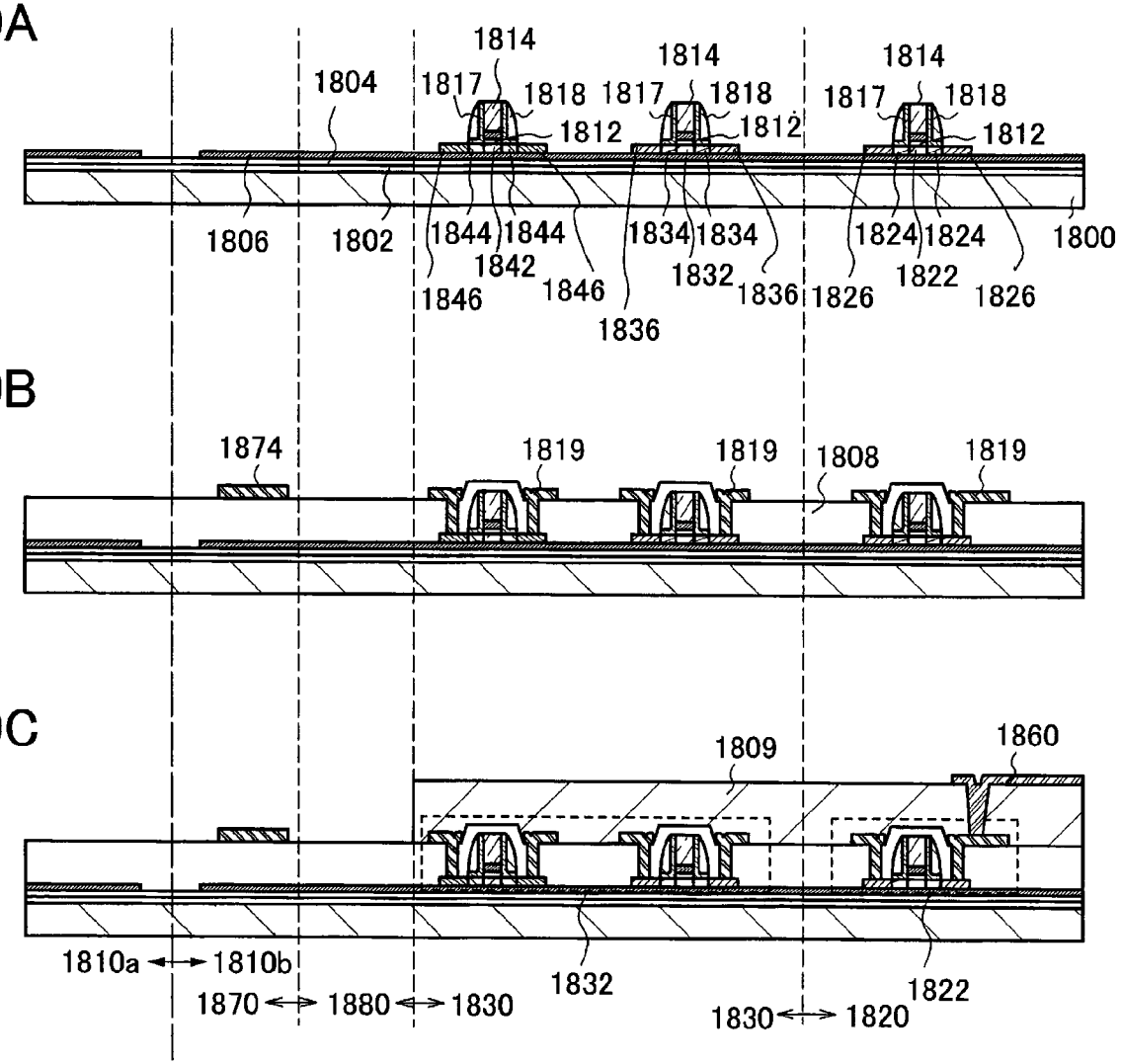
FIGS. 20A to 20C are diagrams used to illustrate a fabrication process of a liquid crystal display device of the present invention.

Next, exposed portions of the insulating layer 1816 are etched (with reference to FIG. 20A). The insulating layer 1816 is left remaining between the sidewall insulating layers 1818 and the gate electrodes 1814, between the sidewall insulating layers 1818 and the first SOI layer 1821, between the sidewall insulating layers 1818 and the second SOI layer 1831, and between the sidewall insulating layers 1818 and the third SOI layer 1841.

It is to be noted that a silicide layer may be formed in order to lower the resistance of each of the high-concentration impurity regions that each function as a source region or drain region. For the silicide layer, a cobalt silicide or a nickel silicide may be applied. When the film thickness of the SOI layer is thin, a silicide reaction may be made to proceed to the bottom portion of the SOI layer in which the high-concentration impurity regions are formed so that the SOI layer in which the high-concentration impurity regions are formed is fully silicided.

Next, after the insulating layer 1808 is formed over the entire surface of the substrate 1800, the insulating layer 1808 is etched as selected, and openings that each reach one of the high-concentration impurity regions 1826 that are formed in the first SOI layer 1821 of the display section 1820 are formed. Furthermore, openings that each reach one of the high-concentration impurity regions 1836 or one of the high-concentration impurity regions 1846 that are formed in the second SOI layer 1831 and the third SOI layer 1841, respectively, of the display section 1830 are formed. Then, conductive layers 1819 are formed so that each of the openings is buried. Moreover, a terminal electrode 1874 is formed in the terminal region 1870 (with reference to FIG. 20B).

The insulating layer 1808 is formed by a CVD method, a sputtering method, an ALD method, a coating method, or the like using an inorganic insulating material that contains oxygen or nitrogen such as silicon oxide, silicon nitride, silicon oxynitride, silicon nitride oxide, or the like; an insulating material that contains carbon such as diamond-like carbon (DLC) or the like; an organic insulating material such as epoxy, polyimide, polyamide, polyvinyl phenol, benzocyclobutene, acrylic, or the like; or a siloxane material such as a siloxane resin or the like. It is to be noted that a siloxane material corresponds to a material that contains Si—O—Si bonds. The skeleton structure of siloxane is formed of bonds of silicon (Si) and oxygen (O). As a substituent, an organic group that contains at least hydrogen (for example, an alkyl group or an aromatic hydrocarbon group) is used. As a substituent, a fluoro group may be used, as well. In addition, an organic group that contains hydrogen at least and a fluoro group may be used. Furthermore, for the insulating layer 1808, after an insulating layer is formed using a CVD method, a sputtering method, or an ALD method, plasma treatment may be performed on the insulating layer in an oxygen atmosphere or a nitrogen atmosphere. Here, an example is shown in which the insulating layer 1808 has a single-layer structure; however, the insulating layer 1808 may be set to have a stacked-layer structure of two or more layers, as well. In addition, the insulating layer 1808 may be formed of any combination of organic insulating layers and organic insulating layers. For example, the insulating layer 1808 can be formed using materials of a silicon nitride film or silicon nitride oxide film that can be made to function as a passivation layer formed over the entire surface of the substrate 1800 and phosphosilicate glass (PSG) or borophosphosilicate glass (BPSG) that can be made to function as a planarization layer formed over the upper layer of the silicon nitride film or silicon nitride oxide film.

The conductive layers 1819 each function as an electrode that functions as a source electrode or a drain electrode. The conductive layers 1819 are electrically connected to the first SOI layer 1821, the second SOI layer 1831, and the third SOI layer 1841 through the openings formed in the insulating layer 1808.

For the conductive layers 1819, after a conductive layer is formed as a single-layer structure or stacked-layer structure over the entire surface of the substrate using a CVD method or a sputtering method using a metal element such as aluminum (Al), tungsten (W), titanium (Ti), tantalum (Ta), molybdenum (Mo), nickel (Ni), platinum (Pt), copper (Cu), gold (Au), silver (Ag), manganese (Mn), neodymium (Nd), carbon (C), silicon (Si), or the like or an alloy material or compound material that contains any of the metal elements, the conductive layers 1819 can be formed by etching of the conductive layer as selected. For an alloy material that contains aluminum, for example, a material that contains aluminum as its main component and nickel and a material that contains aluminum as its main component, nickel, and either one or both of carbon and silicon can be given. Furthermore, for a compound material that contains tungsten, for example, a tungsten silicide can be given. For the conductive layers 1819, for example, a stacked-layer structure of a barrier layer, an aluminum-silicon (Al—Si) layer, and a barrier layer or a stacked-layer structure of a barrier layer, an aluminum-silicon (Al—Si) layer, a titanium nitride layer, and a barrier layer can be employed. It is to be noted that a barrier layer corresponds to a thin film formed of titanium, a nitride of titanium, molybdenum, or a nitride of molybdenum. Because aluminum and aluminum silicon have low resistance and are inexpensive, they are the most suitable for materials used to form the conductive layers that each function as a source electrode or drain electrode. Moreover, setting the conductive layers that each function as a source electrode or drain electrode to have a stacked-layer structure in which barrier layers are provided as a top layer and a bottom layer is preferable because the formation of hillocks of aluminum or aluminum silicon can be prevented with such a structure.

The terminal electrode 1874 formed in the terminal region 1870 functions as an electrode used to electrically connect an external input terminal of an FPC or the like to be formed during a subsequent step and the first driver circuit section 1830 and second driver circuit section 1850. Here, an example is shown in which the terminal electrode 1874 is formed of the same layer and using the same materials of which the conductive layers 1819 are formed.

As described above, the pixel circuit section 1828 in which is formed a transistor that has the first SOI layer 1821 is formed in the display section 1820. Furthermore, the peripheral circuit section 1838 in which are formed a transistor that has the second SOI layer 1831 is formed in the first driver circuit section 1830 and a transistor that has the third SOI layer 1841 is formed in the first driver circuit section 1830 is formed.

Next, the insulating layer 1809 is formed over the display section 1820 and the first driver circuit section 1830. Then, the insulating layer 1809 that is formed over the display section 1820 is etched as selected, and an opening that reaches the conductive layer 1819 of the transistor that is formed in the pixel circuit section 1828 is formed. After the opening is formed in the conductive layer 1819, the pixel electrode 1860 is formed so that the opening is buried (FIG. 20C).

For the insulating layer 1809, it is preferable to form a planarization layer that can planarize unevenness in the display section 1820 and the first driver circuit section 1830 to form a planar surface. For example, the planarization layer can be formed using an organic insulating material such as epoxy, polyimide, polyamide, polyvinyl phenol, benzocyclobutene, or acrylic or a siloxane material such as a siloxane resin or the like. Here, an example is shown in which the insulating layer 1809 has a single-layer structure; however, the insulating layer 1809 may also have a stacked-layer structure of two or more layers. When the insulating layer 1809 is formed as a stacked-layer structure, for example, the insulating layer 1809 can be made to have a stacked-layer structure in which an organic resin layer or the like is used as an upper layer and an inorganic insulating layer of silicon oxide, silicon nitride, silicon oxynitride, or the like is used as a lower layer or a structure in which an organic insulating layer is interposed between inorganic insulating layers. It is to be noted that the insulating layer 1809 can be formed by first being formed over the entire surface of the substrate and then etched as selected in regions other than desired regions (here, regions of the display section 1820 and the first driver circuit section 1830). The insulating layer 1809 can also be formed as selected using any of a variety of different printing methods (screen printing, planographic printing, relief printing, gravure printing, or the like), a liquid droplet discharge method, a dispenser method, or the like.

The pixel electrode 1860 functions as a reflective electrode in the present embodiment mode. Consequently, the pixel electrode 1860 is formed using a conductive material that is reflective. For this kind of material, a metal element such as tantalum (Ta), tungsten (W), titanium (Ti), molybdenum (Mo), aluminum (Al), chromium (Cr), silver (Ag), or the like or an alloy material or compound material that contains any of the metal elements can be used. It is to be noted that, in cases in which an additional reflective layer is formed or in which the liquid crystal display device is set to be a transmissive liquid crystal display device, the pixel electrode may be formed using a conductive material that transmits light. For a conductive material that transmits light, indium tin oxide (ITO), indium tin oxide that contains silicon oxide (ITSO), zinc oxide (ZnO), indium zinc oxide (IZO), zinc oxide to which gallium has been added (GZO), or the like can be used.

Figure 21A:
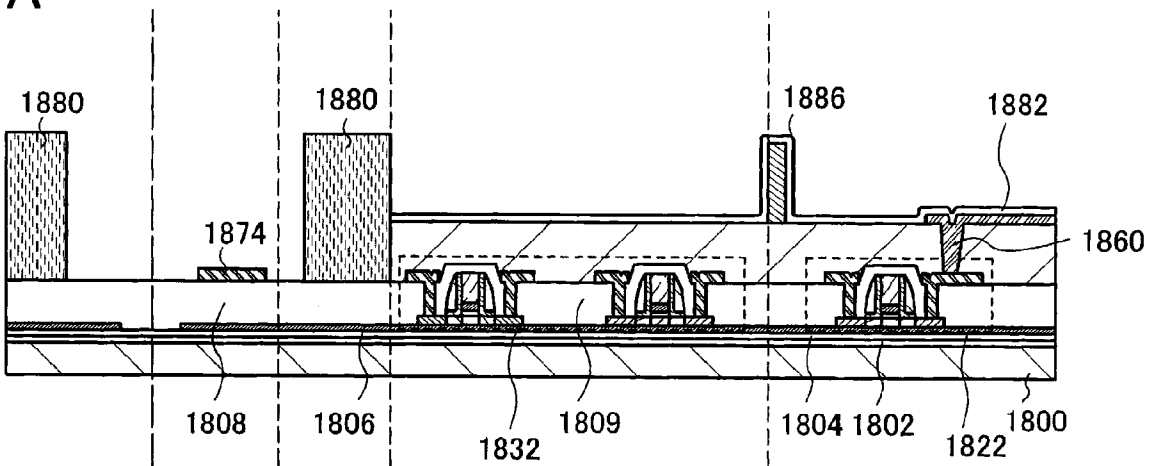
FIGS. 21A and 21B are diagrams used to illustrate a fabrication process of a liquid crystal display device of the present invention.

Next, after the spacer 1886 is formed, the alignment film 1882 is formed so as to cover the pixel electrode 1860 and the spacer. Next, the sealant 1880 is formed so as to enclose the display section 1820, the first driver circuit section 1830, and the second driver section 1850 (FIG. 21A).

The spacer 1886 can be formed using an organic insulating material such as epoxy, polyimide, polyamide, polyimide amide, acrylic, or the like or an inorganic insulating material such as silicon oxide, silicon nitride, silicon oxynitride, silicon nitride oxide, or the like as a single-layer structure or a stacked-layer structure. In the present embodiment mode, in order that a columnar spacer be formed for the spacer 1886, an insulating layer is formed over the entire surface of the substrate and then etched and processed so that a spacer with the desired shape is obtained. It is to be noted that there are no particular limitations on the shape of the spacer 1886, and spherical spacers may be applied, as well. The width of a cell gap can be retained by use of the spacer 1886.

For the alignment film 1882, a material may be selected depending on the operation mode of a liquid crystal, and a layer by which the liquid crystal can be aligned in a uniform direction is formed. For example, a layer is formed using polyimide, polyamide, or the like, and alignment treatment is performed so that the layer can be made to function as an alignment film. For the alignment treatment, rubbing, irradiation with ultraviolet light rays, or the like may be performed. There are no particular limitations on the method of formation of the alignment film 1882, and the alignment film 1882 can be formed over the insulating layer 609 as selected by use of any of a variety of printing methods or a liquid droplet discharge method.

The sealant 1880 is formed so as to enclose at least a display region after completion of a display device. In the present embodiment mode, a frame-shaped seal pattern is formed so as to enclose the periphery of the display section 1820, the first driver circuit section 1830, and the second driver circuit section 1850. For the sealant 1880, a thermally curable resin or light curable resin can be used. It is to be noted that the width of the cell gap can be retained by the sealant being made to contain a filler. The sealant is hardened by performance of irradiation with light thermal treatment, or the like in the sealing of the substrate and another substrate over which a counter electrode, a color filter, and the like are provided that is to be performed in a subsequent step.

Figure 21B:
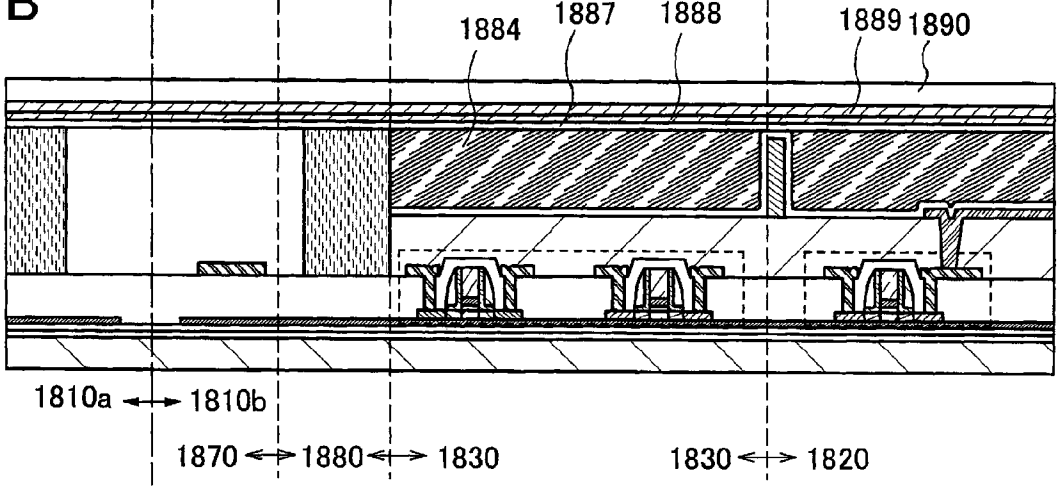

The liquid crystal layer 1884 is formed in a region enclosed by the sealant 1880. In addition, the second substrate 1890 over which the color filter 1889, the counter electrode 1888, and the alignment film 1887 are stacked in the order given is bonded to the first substrate 1800 (FIG. 21B).

The liquid crystal layer 1884 is formed using desired liquid crystal materials. For example, the liquid crystal layer 1884 by dripping of a liquid crystal material into a frame-shaped seal pattern that is formed of the sealant 1880. Dripping of the liquid crystal material may be performed using a dispenser method or a liquid droplet discharge method. It is to be noted that it is preferable that the liquid crystal material be degassed under reduced pressure either in advance or after dripping is completed. Furthermore, it is preferable that dripping of the liquid crystal material be performed under an inert gas atmosphere so that impurities and the like are not introduced into the liquid crystal material. In addition, it is preferable that steps from after dripping of the liquid crystal material to form the liquid crystal layer 1884 up through bonding of the first substrate 1800 and the second substrate 1890 be performed at reduced pressure so that air bubbles and the like are not formed in the liquid crystal layer 1884.

Alternatively, the liquid crystal layer 1884 can be formed by injection of the liquid crystal material into the frame-shaped pattern that is formed of the sealant 1880 by use of a capillary phenomenon after the first substrate 1800 and the second substrate 1890 are bonded together In this case, a portion that is to be an opening through which the liquid crystal material is injected is formed in advance. It is to be noted that it is preferable that injection of the liquid crystal material be performed at reduced pressure.

After the first substrate 1800 and the second substrate 1890 are made to face each other and brought into close contact with each other, the first substrate 1800 and the second substrate 1890 can be attached together by the sealant 1880 being made to harden. At this time, the first substrate 1800 and the second substrate 1890 are attached to each other in such a way that the structure becomes one in which the liquid crystal layer 1884 is clamped between the alignment film 1887 that is provided over the second substrate 1890 and the alignment film 1882 that is provided over the first substrate 1800. It is to be noted that, after the first substrate 1800 and the second substrate 1890 are bonded together and the liquid crystal layer 1884 is formed, correcting disarray of the alignment of the liquid crystal 1884 by performance of heat treatment is possible.

For the second substrate 1890, a substrate that can transmit light is used. For example, any of a variety of glass substrates of aluminosilicate glass, aluminoborosilicate glass, barium borosilicate glass, or the like; a quartz substrate; a ceramic substrate; a sapphire substrate; or the like can be used.

Over the second substrate 1890, before bonding is performed, the color filter 1889, the counter electrode 1888, and the alignment film 1887 are formed in the order given. It is to be noted that a black matrix may be provided over the second substrate 1890 in addition to the color filter 1889. Furthermore, the color filter 1889 may be provided on the outer side of the second substrate 1890. In addition, when display is set to be monochrome display, the color filter 1889 need not be provided. Moreover, a sealant may be provided on the second substrate 1890 side, as well. It is to be noted that when a sealant is provided on the second substrate 1890 side, the liquid crystal material is dripped into a frame-shaped pattern of the sealant that is provided on the second substrate 1890 side.

The counter electrode 1888 can be formed of a conductive material that transmits light, such as indium tin oxide (ITO), indium tin oxide that contains silicon oxide (ITSO), zinc oxide (ZnO), indium zinc oxide (IZO), zinc oxide to which gallium has been added (GZO), or the like. The alignment film 1887 can be formed in the same way as the alignment film 1882 is formed.

As described above, a structure is obtained in which the display section 1820, the first driver circuit section 1830, and the second driver circuit section 1850 that include the liquid crystal layer 1884 are sealed between the first substrate 1800 and the second substrate 1890. It is to be noted that, in addition to transistors, resistors, capacitors, and the like may be formed in circuit sections provided in the display section 1820, the first driver circuit section 1830, and the second driver circuit 1850 at the same time. Furthermore, there are no particular limitations on the structure of any of the transistors. For example, the structure can be set to be a multi-gate structure in which a plurality of gates is provided for each SOI layer.

Figure 22:
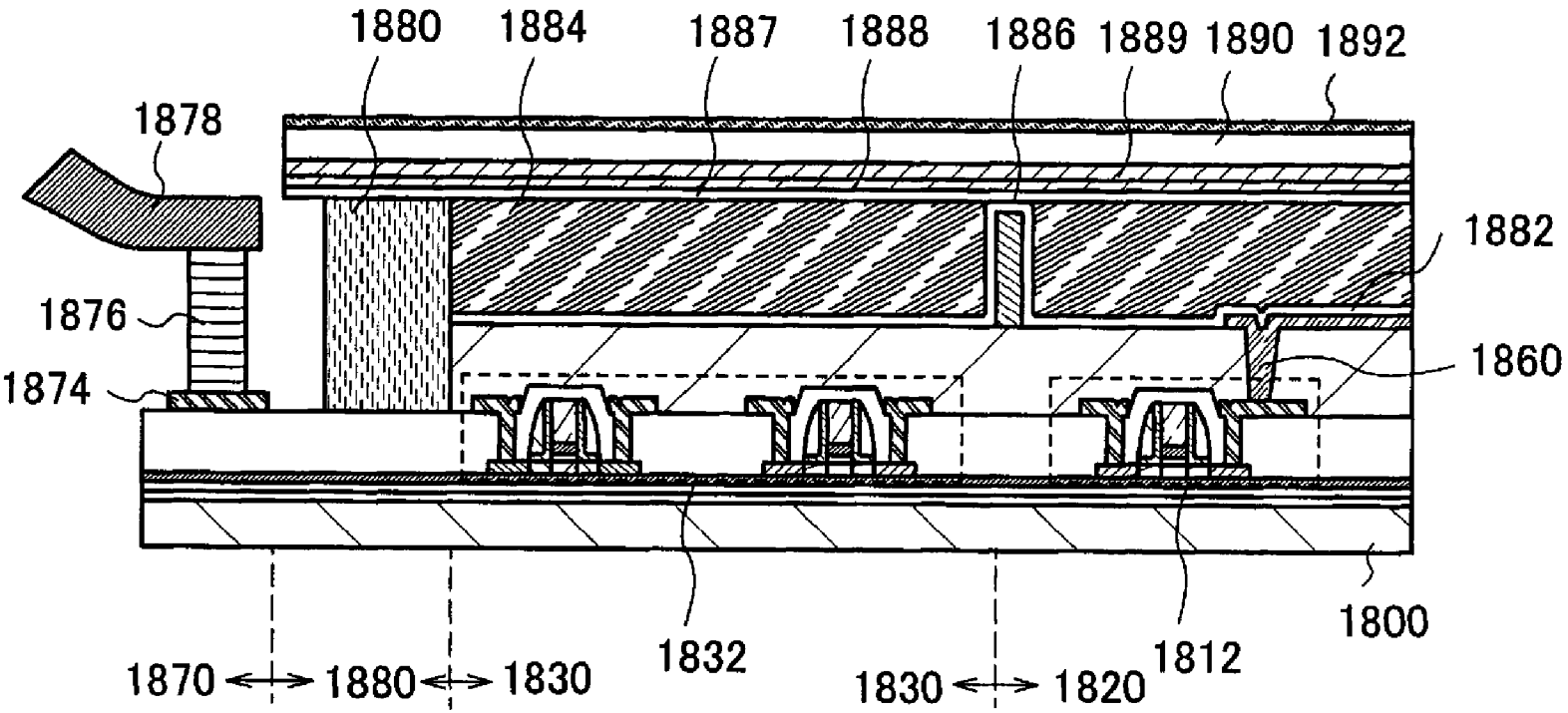
FIG. 22 is a diagram showing a liquid crystal display device of the present invention.

Next, the first substrate 1800 and the second substrate 1890 that are bonded together are separated from each other. Then, a polarizing plate is provided on the second substrate 1890, and the external input terminal 1878 is connected to the terminal electrode 1874 via the anisotropic conductive layer 1876 (FIG. 22).

It is to be noted that when the liquid crystal display is set to be a transmissive liquid crystal display, a polarizing plate may be provided on the outer side of the first substrate 1800 (a surface on the side of the first substrate 1800 on which the liquid crystal layer 1884 and the like are not sealed). Furthermore, in addition to the polarizing plate, an optical film such as a retarder plate, an antireflection film, or the like may be provided, as well.

The external input terminal 1878 assumes the function of transmission of signals (for example, video signals, clock signals, start signals, reset signals, and the like) and electric potential from external. Here, an FPC is connected as the external input terminal 1878. It is to be noted that the terminal electrode 1874 is set to be an electrode that is electrically connected to the first driver circuit section 1830 and the second driver circuit section 1850.

By the steps described above, a liquid crystal display device can be obtained. When the liquid crystal display device is set to be a reflective liquid crystal display device, although display can be performed using external light (sunlight or indoor light) and the like, a front light formed of a light source of a cold cathode-ray tube, an LED element, or the like; a light guide plate; or the like or a reflective sheet or the like may be provided, as well. The front light can be provided on the viewable side of the display device. By provision of a front light, clear display can be achieved even in cases in which not enough external light can be obtained.

Furthermore, when the liquid crystal display device is set to be a transmissive liquid crystal display device or a transflective liquid crystal display device, a backlight formed of a light source of a cold cathode-ray tube, an LED element, or the like; a light guide plate; a reflective sheet; or the like is provided. The backlight is provided on the side opposite from the viewable side (on the back side). With transmissive liquid crystal display devices, display can be performed by transmission of light from a light source to the viewable side.

It is to be noted that the present embodiment mode can be used in combination with Embodiment Mode 1 through Embodiment Mode 6,as appropriate.

Embodiment Mode 8

Electronic devices in which the liquid crystal display device of the present invention is used will be described with reference to FIGS. 23A to 23H.

For electronic devices in which the liquid crystal display device of the present invention is used, cameras such as video cameras, digital cameras, and the like; goggles-type displays (head-mounted displays); navigation systems; audio playback devices (car audio components and the like); computers; game machines; portable information terminals (mobile computers, cellular phones, portable game machines, electronic book readers, and the like); image playback devices provided with storage media (specifically, devices that can play storage media such as digital versatile discs (DVDs) or the like and that are equipped with a display device by which the images can be displayed); and the like can be given.

Figure 23A:
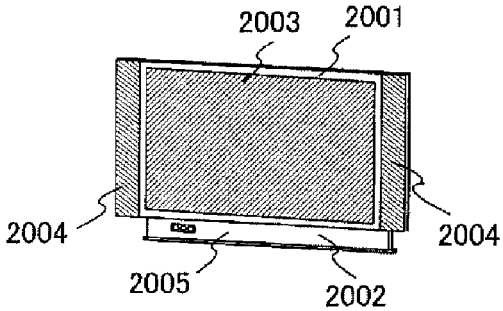
FIGS. 23A to 23H are diagrams each showing an electronic device of the present invention.

FIG. 23A is a diagram of a television set or monitor of a personal computer. The television set or monitor of a personal computer includes a chassis 2001, a support stand 2002, a display 2003, speakers 2004, video input terminals 2005, and the like. The liquid crystal display device of the present invention is used in the display 2003. By the liquid crystal display device of the present invention being used in the display 2003, a television set or monitor of a personal computer in which high-speed response and high image quality are realized can be provided.

Figure 23B:
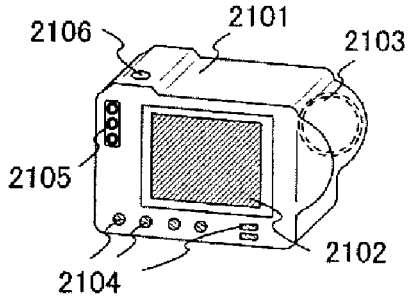

FIG. 23B is a diagram of a digital camera. On the front side part of a main body 2101, an image receiver 2103 is provided, and on the top side part of the main body 2101, a shutter button 2106 is provided. Furthermore, on the back side part of the main body 2101, a display 2102, operation keys 2104, and an external connection port 2105 are provided. The liquid crystal display device of the present invention is used in the display 2102. By the liquid crystal display device of the present invention being used in the display 2102, a digital camera in which high-speed response and high image quality are realized can be provided.

Figure 23C:
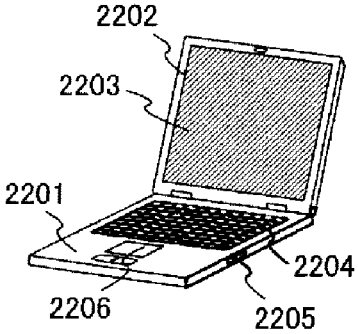

FIG. 23C is a diagram of a notebook computer. In a main body 2201, a keyboard 2204, an external connection port 2205, and a pointing device 2206 are provided. Furthermore, a chassis 2202 that has a display 2203 is attached to the main body 2201. The liquid crystal display device of the present invention is used in the display 2203. By the liquid crystal display device of the present invention being used in the display 2203, a notebook computer in which high-speed response and high image quality are realized can be provided.

Figure 23D:
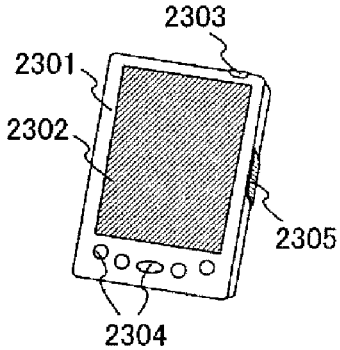

FIG. 23D is a diagram of a mobile computer that includes a main body 2301, a display 2302, a switch 2303, operation keys 2304, an infrared port 2305, and the like. Furthermore, an active matrix display device is provided in the display 2302. The liquid crystal display device of the present invention is used in the display 2302. By the liquid crystal display device of the present invention being used in the display 2302, a notebook computer in which high-speed response and high image quality are realized can be provided.

Figure 23E:
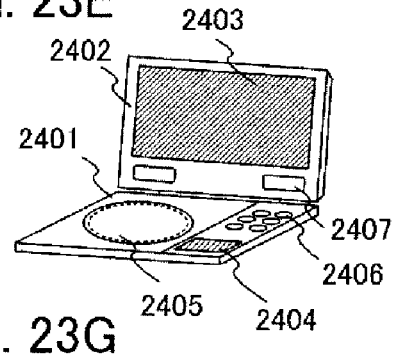

FIG. 23E is a diagram of an image playback device. In a main body 2401, a display 2404, a storage media reader 2405, and operation keys 2406 are provided. Furthermore, a chassis 2402 that has speakers 2407 and a display 2403 is attached to the main body 2401 The liquid crystal display device of the present invention is used in each of the display 2403 and the display 2404. By the liquid crystal display device of the present invention being used in each of the display 2403 and the display 2404, an image playback device in which high-speed response and high image quality are realized can be provided.

Figure 23F:
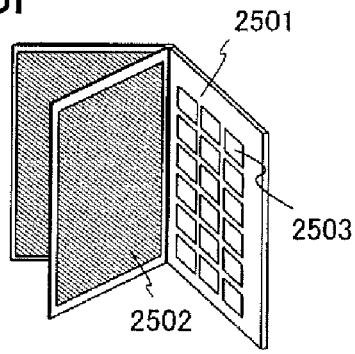

FIG. 23F is a diagram of an electronic book reader. In a main body 2501, operation keys 2503 are provided. Furthermore, a plurality of displays 2502 is attached to the main body 2501. The liquid crystal display device of the present invention is used in each of the displays 2502. By the liquid crystal display device of the present invention being used in the displays 2502, an electronic book reader in which high-speed response and high image quality are realized can be provided.

Figure 23G:
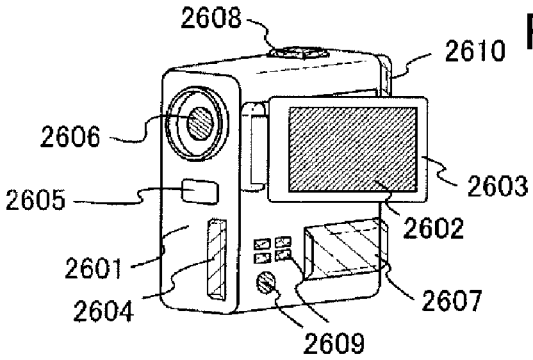

FIG. 23G is a diagram of a video camera. In a main body 2601, an external connection port 2604, a remote control receiver 2605, an image receiver 2606, a battery 2607, an audio input 2608, operation keys 2609, and an eyepiece 2610 are provided. Furthermore, a chassis 2603 that has a display 2602 is attached to the main body 2601. The liquid crystal display device of the present invention is used in the display 2602. By the liquid crystal display device of the present invention being used in the display 2602, a video camera in which high-speed response and high image quality are realized can be provided.

Figure 23H:
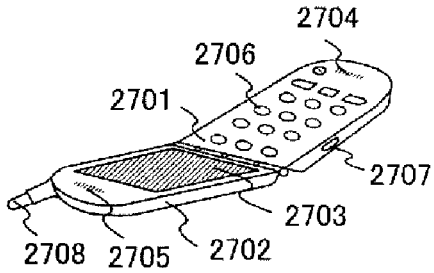

FIG. 23H is a diagram of a cellular phone that includes a main body 2701, a chassis 2702, a display 2703, an audio input 2704, an audio output 2705, operation keys 2706, an external connection port 2707, an antenna 2708, and the like. The liquid crystal display device of the present invention is used in the display 2703. By the liquid crystal display device of the present invention being used in the display 2703, a cellular phone in which high-speed response and high image quality are realized can be provided.

As described above, the range of application of the present invention is extremely wide, and the present invention can be used in electronic devices of all fields. It is to be noted that the present embodiment mode can be used in combination with Embodiment Mode 1 through Embodiment Mode 7, as appropriate.

This application is based on Japanese Patent Application serial no. 2007-116435 filed with the Japan Patent Office on Apr. 26, 2007 , the entire contents of which are hereby incorporated by reference.

What is claimed is:

1. A method for driving a liquid crystal display device configured to display an intended grayscale, comprising the steps of:

dividing a first frame period into n (n: integer, $3 \leqq n$) subframe periods;

applying a signal voltage to a pixel electrode during a subframe period other than an $m^{th}$ (m: integer, $2 \leqq m \leqq n$) subframe period out of the n subframe periods; and applying a voltage, which is a sum of a correction voltage and the signal voltage, to the pixel electrode during the $m^{th}$ subframe period, whereby a grayscale is displayed, wherein the correction voltage corrects for a difference between the intended grayscale and a grayscale that can be obtained by application of the signal voltage to the pixel electrode during the subframe period other than the $m^{th}$ subframe period, the correction voltage being obtained from an insufficiency of response amount of a liquid crystal in the subframe period other than the $m^{th}$ subframe period.

2. The method for driving a liquid crystal display device configured to display an intended grayscale according to claim 1, wherein the signal voltage is a voltage which corresponds to the intended grayscale.

3. The method for driving a liquid crystal display device configured to display an intended grayscale according to claim 1, wherein the correction voltage is a positive voltage or a negative voltage.

4. The method for driving a liquid crystal display device configured to display an intended grayscale according to claim 1, further comprising the step of:

deciding an order of occurrence of the $m^{th}$ subframe period in the first frame period so that the amount of difference between a voltage applied to the pixel electrode during an $n^{th}$ subframe period of the first frame period and a voltage applied to the pixel electrode during a first subframe period of a second frame period is decreased, wherein the second frame period is subsequent to the first frame period.

5. The method for driving a liquid crystal display device configured to display an intended grayscale according to claim 1, wherein the $m^{th}$ subframe period is a subframe period other than a first subframe and an $n^{th}$ subframe in the first frame period.

6. The method for driving a liquid crystal display device configured to display an intended grayscale according to claim 1, wherein a backlight is turned off during a first subframe period out of the n subframe periods.

7. The method for driving a liquid crystal display device configured to display an intended grayscale according to claim 1, wherein an overdrive voltage is applied instead of the signal voltage during a first subframe period out of the n subframe periods.

8. A method for driving a liquid crystal display device configured to display an intended grayscale, comprising the steps of:

dividing a first frame period into n (n: integer, $3 \leqq n$) subframe periods;

selecting k (k: integer, $1 \leqq k \leqq n-1$) subframe periods other than a first subframe period out of the n subframe periods;

applying a signal voltage to a pixel electrode during an (n−k) number of subframe periods other than the selected k subframe periods; and applying a voltage, which is a sum of a correction voltage and the signal voltage, to the pixel electrode during the selected k subframe periods, whereby a grayscale is displayed, wherein the correction voltage corrects for a difference between the intended grayscale and a grayscale that can be obtained by application of the signal voltage to the pixel electrode during the (n−k) subframe periods, the correction voltage being obtained from an insufficiency of response amount of a liquid crystal in the (n−k) subframe periods other than the selected k subframe periods.

9. The method for driving a liquid crystal display device configured to display an intended grayscale according to claim 8, wherein the signal voltage is a voltage which corresponds to the intended grayscale.

10. The method for driving a liquid crystal display device configured to display an intended grayscale according to claim 8, wherein the correction voltage is a positive voltage or a negative voltage.

11. The driving method for a liquid crystal display device configured to display an intended grayscale according to claim 8, further comprising the step of:

deciding an order of occurrence of the k subframe periods in the first frame period so that the amount of difference between a voltage applied to the pixel electrode during an $n^{th}$ subframe period of the first frame period and a voltage applied to the pixel electrode during a first subframe period of a second frame period is decreased, wherein the second frame period is subsequent to the first frame period.

12. The method for driving a liquid crystal display device configured to display an intended grayscale according to claim 8, wherein the k subframe periods are subframe periods other than a first subframe period and an $n^{th}$ subframe in the first frame period.

13. The method for driving a liquid crystal display device configured to display an intended grayscale according to claim 8, wherein a backlight is turned off during a first subframe period out of the n subframe periods.

14. The method for driving a liquid crystal display device configured to display an intended grayscale according to claim 8, wherein an overdrive voltage is applied instead of the signal voltage during a first subframe period out of the n subframe periods.

* * * * *